US007588454B2

(12) United States Patent
Nakata et al.

(10) Patent No.: US 7,588,454 B2
(45) Date of Patent: Sep. 15, 2009

(54) CONNECTOR DEVICE AND LOCKING STRUCTURE

(75) Inventors: Takehiro Nakata, Yokkaichi (JP); Satoshi Morikawa, Yokkaichi (JP); Michiaki Okamoto, Yokkaichi (JP); Toshifumi Ichio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/256,779

(22) Filed: Oct. 23, 2008

(65) Prior Publication Data

US 2009/0111312 A1 Apr. 30, 2009

(30) Foreign Application Priority Data

| | | |
|---|---|---|
| Oct. 24, 2007 | (JP) | 2007-276489 |
| Oct. 24, 2007 | (JP) | 2007-276495 |
| Oct. 24, 2007 | (JP) | 2007-276501 |
| Oct. 24, 2007 | (JP) | 2007-276627 |

(51) Int. Cl.
*H01R 13/627* (2006.01)

(52) U.S. Cl. ..... 439/357; 439/382; 439/352

(58) Field of Classification Search ..... 439/352, 439/357, 382–385
See application file for complete search history.

(56) References Cited

U.S. PATENT DOCUMENTS

| | | | | |
|---|---|---|---|---|
| 2005/0153593 | A1 * | 7/2005 | Takayanagi et al. | 439/352 |
| 2008/0064250 | A1 * | 3/2008 | Lee et al. | 439/352 |

FOREIGN PATENT DOCUMENTS

| | | |
|---|---|---|
| JP | 1-98485 | 6/1989 |
| JP | 2005-183342 | 7/2005 |

* cited by examiner

*Primary Examiner*—Tho D Ta
(74) *Attorney, Agent, or Firm*—Gerald E. Hespos; Anthony J. Casella

(57) ABSTRACT

Rear engageable surfaces (16B) of engageable portions (16) face communicating portions (37) and are inclined to produce forces for pushing another housing (11) forward in a connecting direction with one housing (21) upon receiving resilient restoring forces of leg portions (51) when a pair of connectors (10, 20) reach a properly connected state. A fitting portion (27) of the second connector (20) is formed with slanted surfaces (46) inclined to reduce the width of the fitting portion (27) toward the back side of the fitting portion (27). The slanted surfaces 46 and the first connector (10) are set to come into contact at a position where a clearance is defined before the first connector (10) in the connecting direction with the second connector (20).

20 Claims, 41 Drawing Sheets

CONNECTOR DEVICE AND LOCKING STRUCTURE

BACKGROUND OF THE INVENTION

1. Field of the Invention

The invention relates to a pair of connectors connectable with each other and to a locking construction.

2. Description of the Related Art

Japanese Unexamined Patent Publication No. 2005-183342 discloses a connector device with first and second connectors. The first connector has a lock arm and an engaging portion is disposed at the leading end of the lock arm. The second connector is formed with a lock projection. The connectors can be locked in a properly connected state by engaging the lock arm of the first connector with the lock projection of the second connector. The engaging portion moves onto the lock projection during connection of the connectors to deform the lock arm resiliently. However, the engaging portion moves beyond the lock projection when the connectors reach the properly connected state. As a result, the lock arm restores resiliently so that the engaging portion engages the locking projection to lock the two connectors in the properly connected state.

A specified clearance is defined between the engaging portion and the locking projection of the above-described connector to prevent the engaging portion and the locking projection from interfering with each other when the lock arm resiliently restores. Thus, there may be backlash between the locking projection and the engaging portion, when the connector is subjected to vibration or the like. As a result, abnormal noise may be produced or terminals may slide against each other and abrade. The clearance between the locking projection and the engaging portion may be enlarged due to creep deformation if the connector device is used in a high-temperature and high-vibration environment. Therefore, a countermeasure against backlash is needed.

Japanese Utility Model Publication No. H01-98485 discloses a locking structure that uses a spring for locking two members in a properly connected state. The spring has two resiliently displaceable legs and is vertically displaceably mounted on a housing of a connector. The housing is formed with passages that receive locking projections of a mating housing. The legs of the spring project into the passages when the housing is connected properly with the mating housing, and are located backward of the locking projections in the separating direction from the mating housing. Thus, the connectors are locked in a properly connected state by the engagement of the legs and the locking projections. The spring can be pressed down to retract the legs from the passages so that the locked state can be canceled for separating the two connectors.

The spring of the above-described connector normally is pressed down directly by fingertips during the unlocking operation. However, the spring is narrower than the fingertips and is difficult to press.

The mating connector may have a wall that impedes access to the spring by an operator's fingertips. Thus, the unlocking operation may require use of a jig or the like, thereby requiring additional labor and time.

The spring of the above-described connector may be displaced to cancel the locked state inadvertently, for example, if the connector is used in a high-vibration environment. However, the spring must be in displaceable to a certain extent to cancel the locked state. Thus, a countermeasure is needed.

The invention was developed in view of the above situation, and an object thereof is to provide a connector device having an improved operation.

SUMMARY OF THE INVENTION

The invention relates to a connector assembly comprising first and second connectors that have first and second housings respectively. The connectors can be connected by fitting the first and second housings together. The second housing is formed with passages for receiving engageable portions of the first housing when the connectors are connected. The connector assembly also includes a spring that is mounted on the second housing. The spring has two resiliently displaceable legs that project into the passages of the second housing. The engageable portions of the first housing move forward in the passages as the connectors are being connected. Thus, the engageable portions contact the legs of the spring and displace the legs resiliently. The engageable portions of the first housing receive the resilient restoring forces of the legs of the spring when the connectors reach a properly connected state for pushing the housings together.

The second housing preferably has a fitting space with at least one slanted surface that is inclined to reduce the width of the fitting space towards the rear. The slanted surface and the first housing preferably are set to contact at a position where a clearance is defined before the first and second connectors in a connecting direction. However, the resilient legs of the spring press the engageable portions and push the first housing in the connecting direction. Thus, even if the housings are deformed due to creep or the like, the resilient restoring forces of the legs of the spring move the first housing forward to hold the first and second connectors in a properly connected state. Therefore, backlash of the two connectors is prevented.

The first housing may have an inclined surface that contacts the slanted surface of the second housing. The inclined surface preferably is inclined substantially in conformity with the slanted surface. Thus, the two housings are held in surface contact for strongly preventing backlash.

The spring may be displaceable between an inserted position where the legs project into the passages and a retracted position where the legs are substantially retracted from the passages. The second housing and/or the legs may include guides inclined with respect to a displacing direction of the spring. Thus, the spring can be displaced smoothly.

The second housing may have a mounting portion for the spring, and peripherally extending walls may be provided before and after the mounting portion. Thus, the spring is mounted between the walls to reduce backlash of the spring.

One of the connectors may include at least one unlocking arm extending substantially in the connecting direction of the connectors. The unlocking arm preferably is inclinable like a seesaw. A pressing portion is defined at the front end of the unlocking arm in the connecting direction and is arranged for deflecting the spring. An unlocking portion is defined at the rear end of the unlocking arm and can be pressed for deflecting the unlocking arm and displacing the spring from the inserted position to the retracted position. Accordingly, the spring need not be operated directly with fingertips and operational efficiency is good. Further, the rear disposition of the unlocking portion enables efficient access to the unlocking portion regardless of the size or shape of the other connector. Therefore, a separate jig is not needed so that labor and time required for an unlocking operation can be saved.

A supporting arm may extend in the connecting direction for supporting the unlocking arm. One end of the supporting arm may be connected with the rear end of the unlocking arm and the opposite end of the supporting arm may be connected with one of the housings.

A support may be disposed between one of the housings and a central part of the unlocking arm in forward and backward directions. The support contacts the unlocking arm or the housing during deflection of the unlocking arm. Therefore, the strength of the connecting part between the unlocking arm and the housing can be reduced. In contrast, the connecting part would be enlarged to have sufficient strength if the connecting part of the unlocking arm and the housing was the entire support for a seesaw-like inclining movement. The rigidity of the connecting part then would have to be increased and a correspondingly large force would be required for pressing the unlocking portion. However, the rigidity of the connecting part of the one connector and the unlocking arm can be reduced according to the invention. Therefore, a smaller force is required for the unlocking operation and the unlocking operation can be performed easily.

The locking structure may comprise guiding tapers at entrances for the legs to the passages. The guiding tapers guide the engaging portions towards the passages by resilient restoring forces of the legs. Accordingly, the engaging portions are pressed against the guiding tapers and are guided into the passages by the resilient restoring forces of the legs when the unlocking portion is pressed, and the spring is displaced from the retracted position to the inserted position. Thus, the spring need not be set to the inserted position again when the connectors are reconnected and locked after an unlocking operation is performed. As a result, the locking operation can be performed easily.

The pressing portion may be shaped to be deflected towards a side in which the spring is pressed. Thus, the spring will not separate from the front end of the unlocking arm during the unlocking operation.

The spring is displaced from the inserted position to the retracted position by being displaced away from the housing.

The unlocking arm may include at least one bulge at a side of the spring substantially opposite to the pressing portion. The pressing portion of the unlocking arm displaces the spring away from the connector to cancel the locked state when the operable portion of the unlocking arm is pressed. However, the spring is held between the bulge and the pressing portion to prevent the spring from separating from the housing.

The bulge may be disposed to correspond with a substantially middle of the spring between the two legs. Accordingly, a widthwise central part of the spring between the legs is held between the bulge and the pressing portion. Thus, one side of the spring will not be lifted up from the pressing portion.

The connector assembly may include a movable member, such as a slider, as an alternative to the unlocking arm. The movable member may be displaceable substantially along the connecting direction and may be formed with at least one pressing surface disposed for sliding contact with the spring as the movable member is moved. The pressing surface preferably is inclined for pressing the spring to the retracted position as the movable member is moved. Accordingly, the spring need not be operated directly with fingertips and operational efficiency is good. Further, the locked state can be canceled without difficulty even if there is no space to place fingertips near the front end of the connector due to the shape of the mating connector. The unlocking operation is more efficient than connector assemblies that require the use of a jig or the like for unlocking.

A contact may project from the slider for contacting the mating connector after the spring is displaced to the retracted position. Accordingly, the connector can be pulled out in a separating direction while the contact is held in contact with the other mating connector. Thus, an operation of separating the connectors can be performed more easily as compared with the case where the connector is pulled out of the mating connector while being held by fingertips.

The contact may project in the connecting direction at a side of the spring substantially opposite to the connector. Accordingly, the spring cannot displace away from the connector and the spring will not detach from the connector.

The spring may be at least partly mounted in a substantially circumferentially extending groove in the connector. Thus, the longitudinal displacement of the spring can be prevented.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
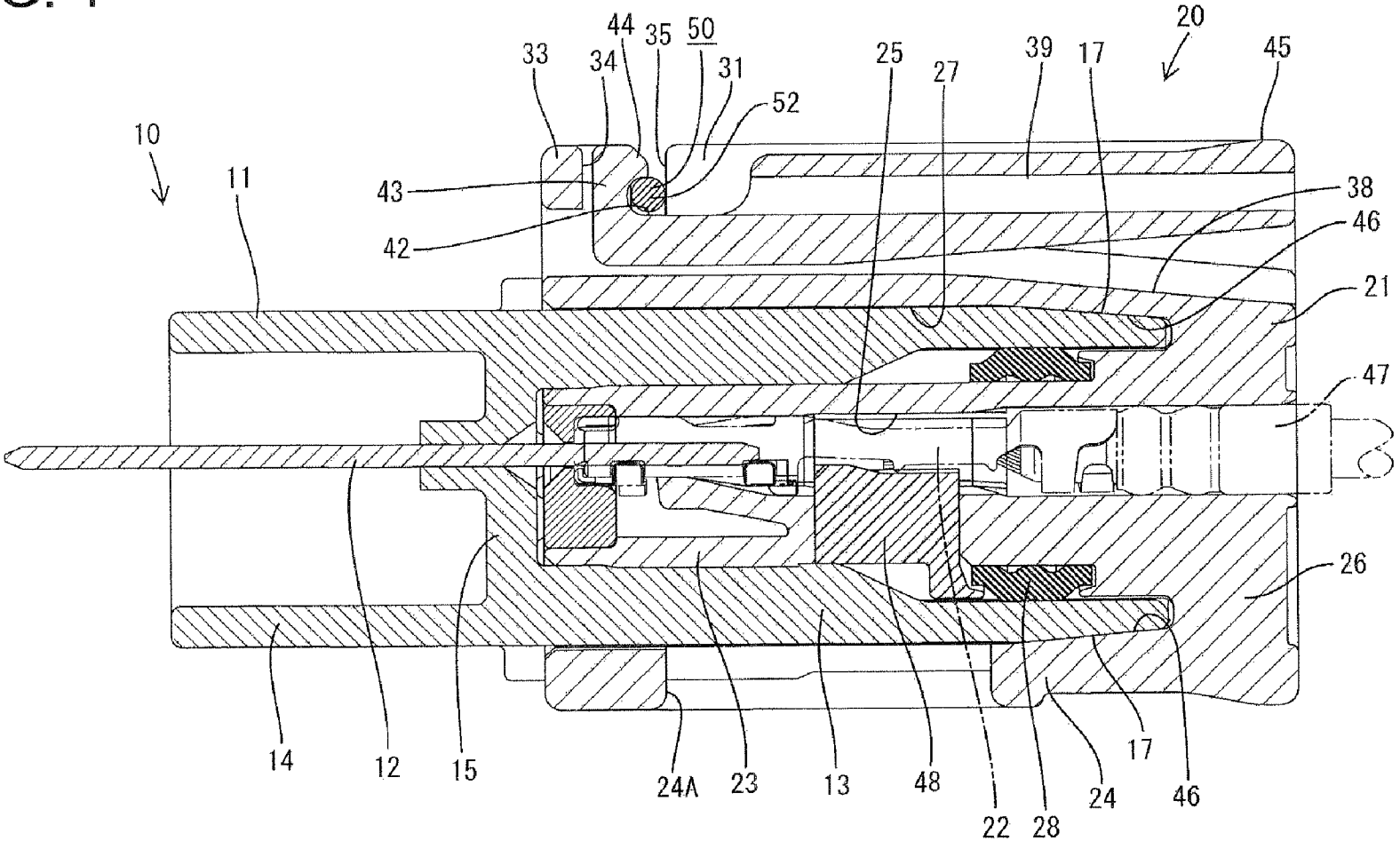
FIG. 1 is a longitudinal section showing a properly connected state of a connector device according to one embodiment.
Figure 2:
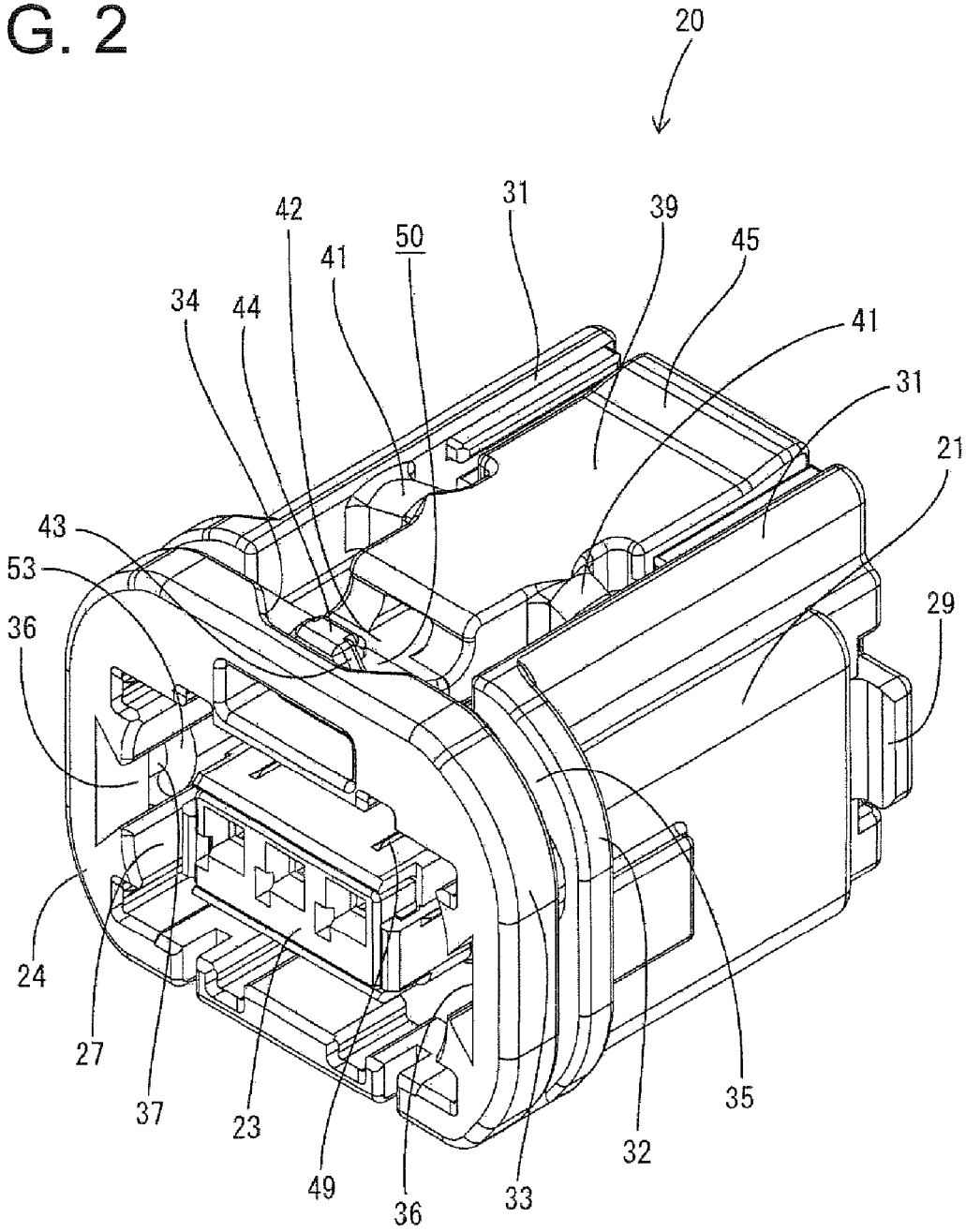
FIG. 2 is an external perspective view of a female connector.
Figure 3:
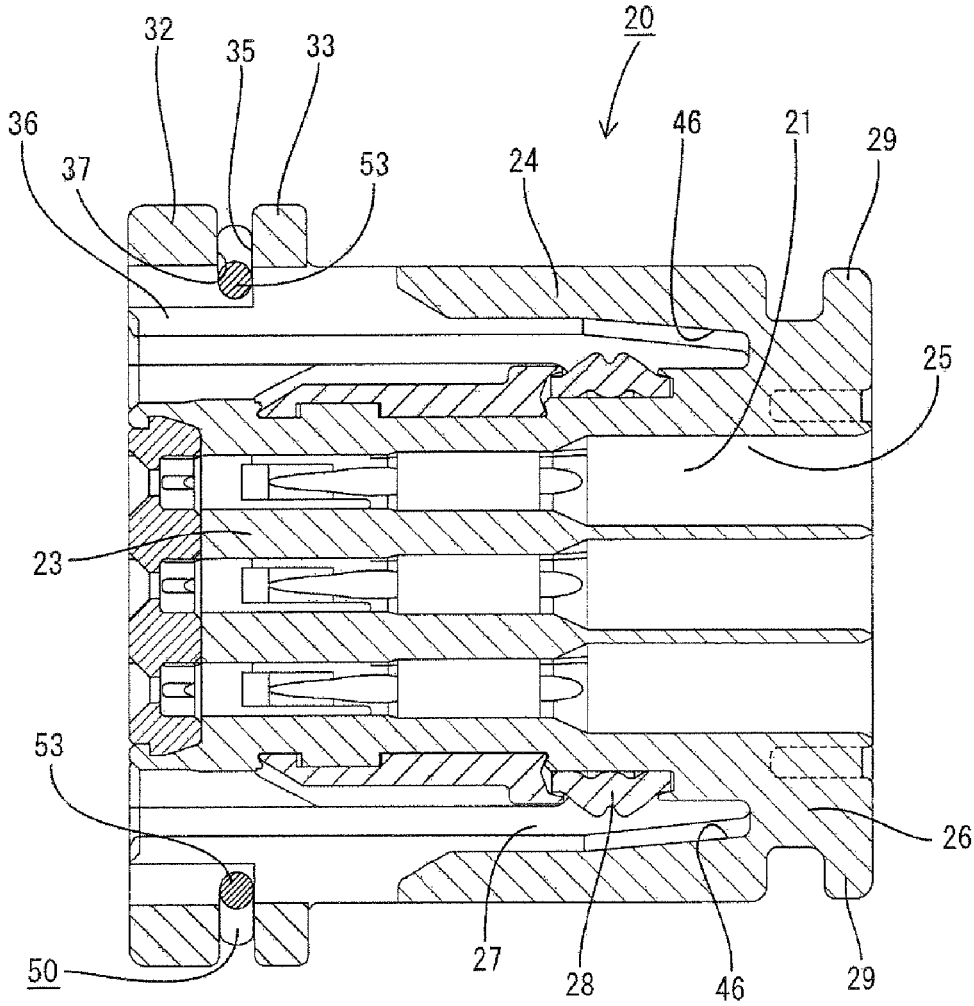
FIG. 3 is a plan view in section of the female connector.
Figure 4:
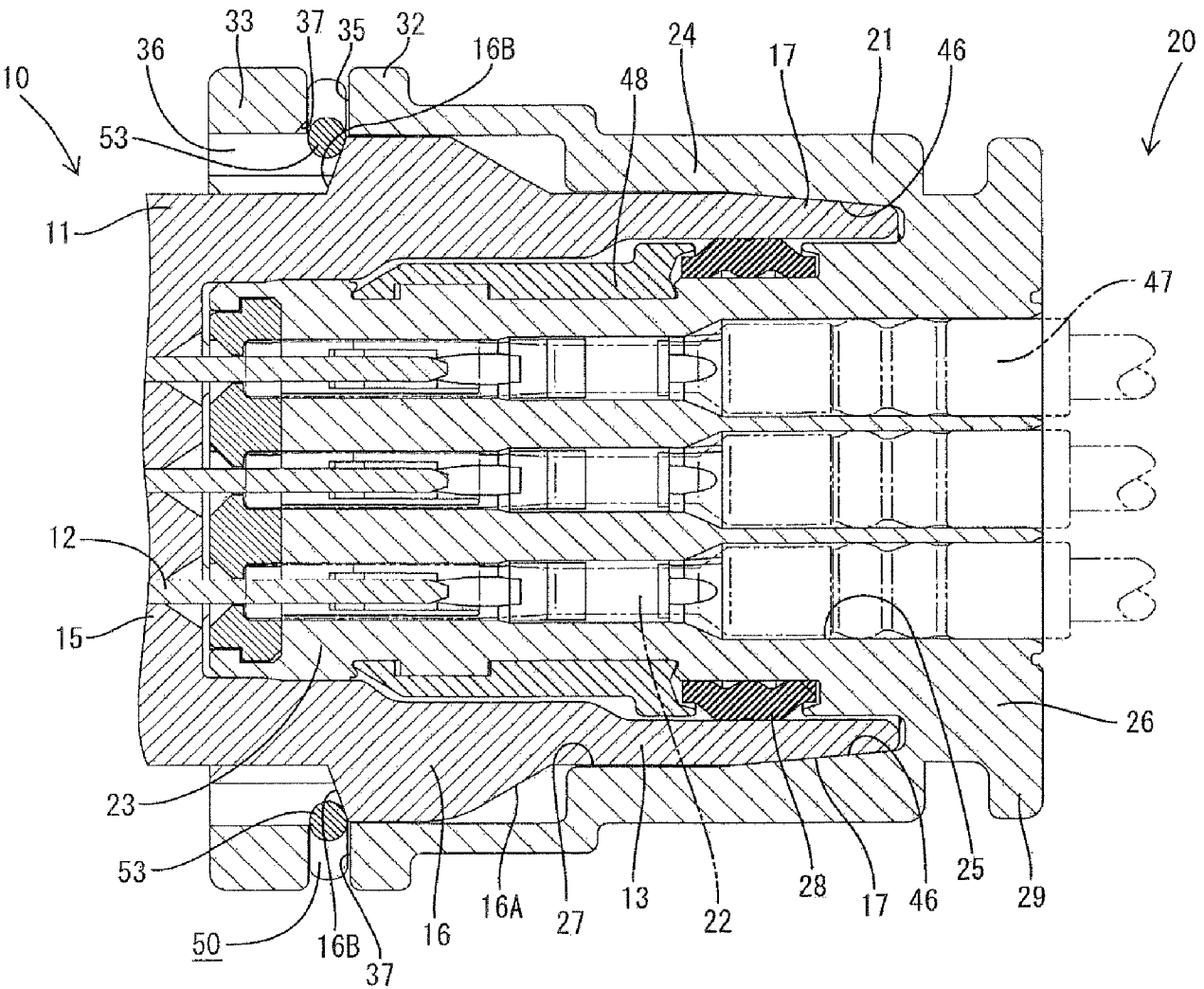
FIG. 4 is a plan view in section showing the properly connected state of the two connectors.
Figure 5:
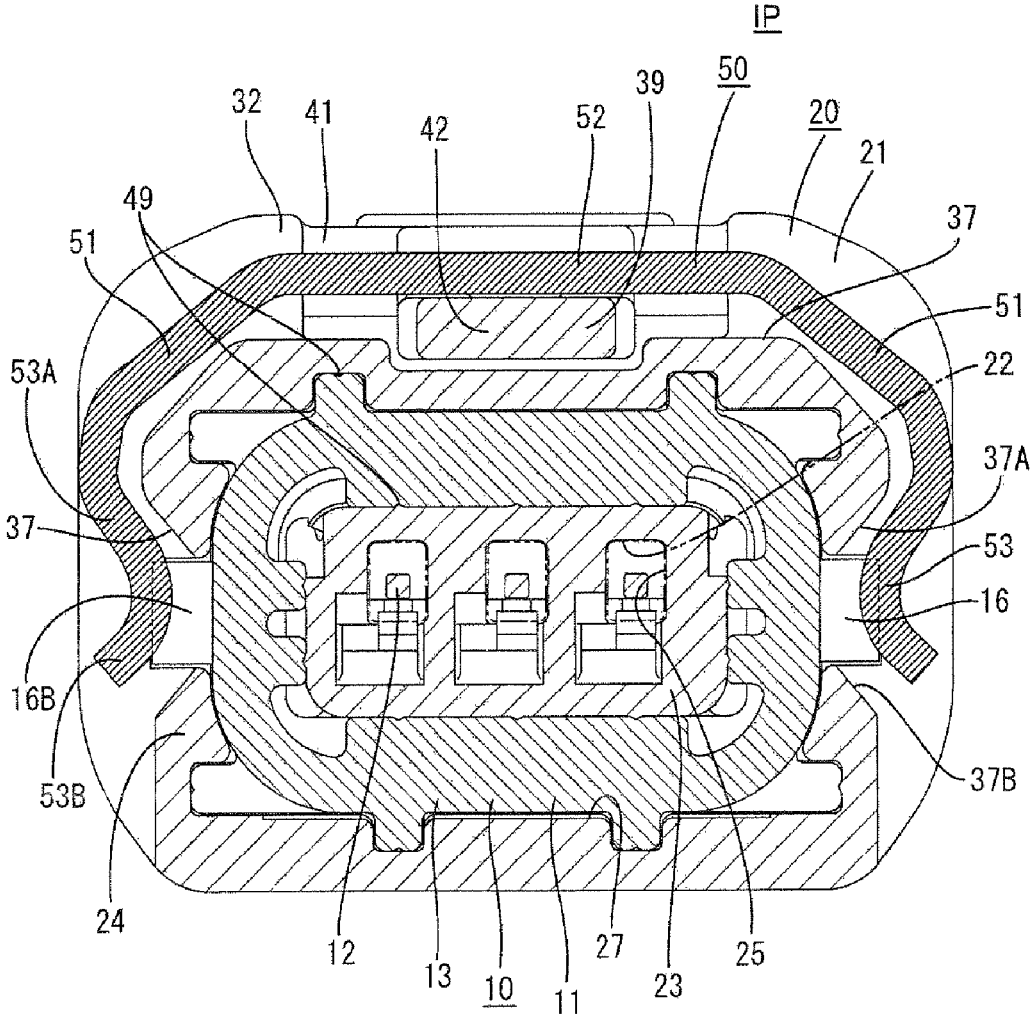
FIG. 5 is a lateral section showing the properly connected state of the two connectors.
Figure 6:
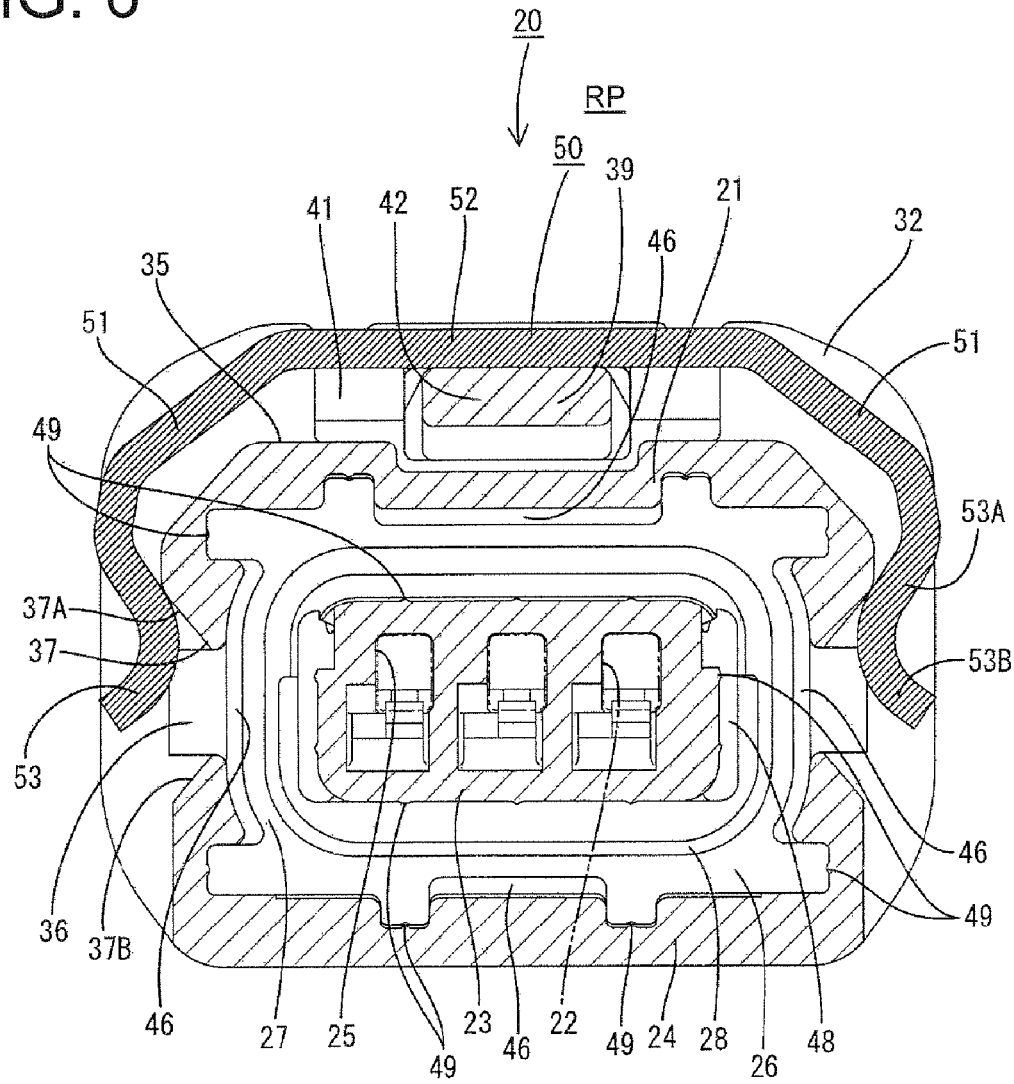
FIG. 6 is a lateral section of the female connector showing a state where a locked state is canceled.
Figure 7:
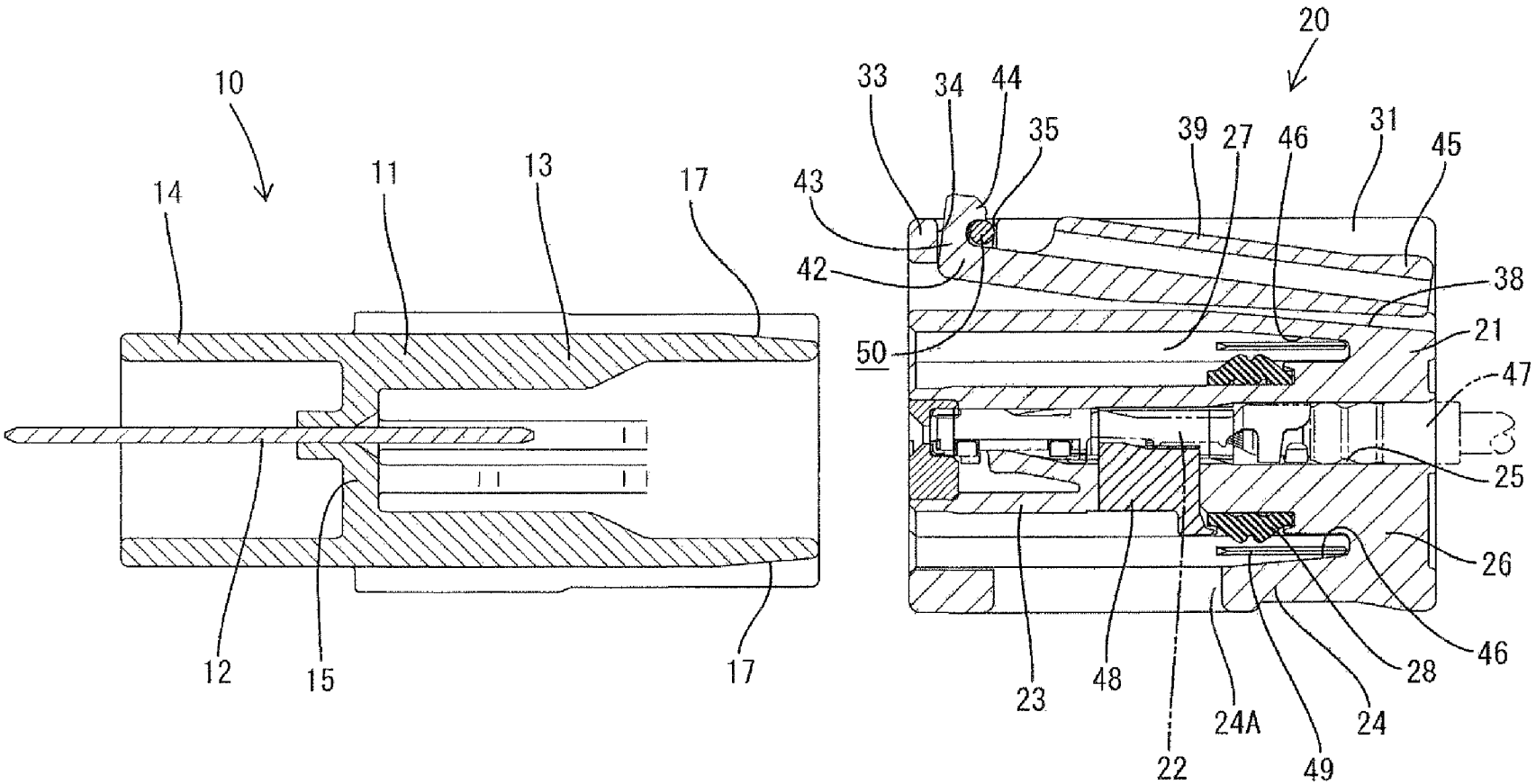
FIG. 7 is a longitudinal section showing a state where the two connectors are separated.
Figure 8:
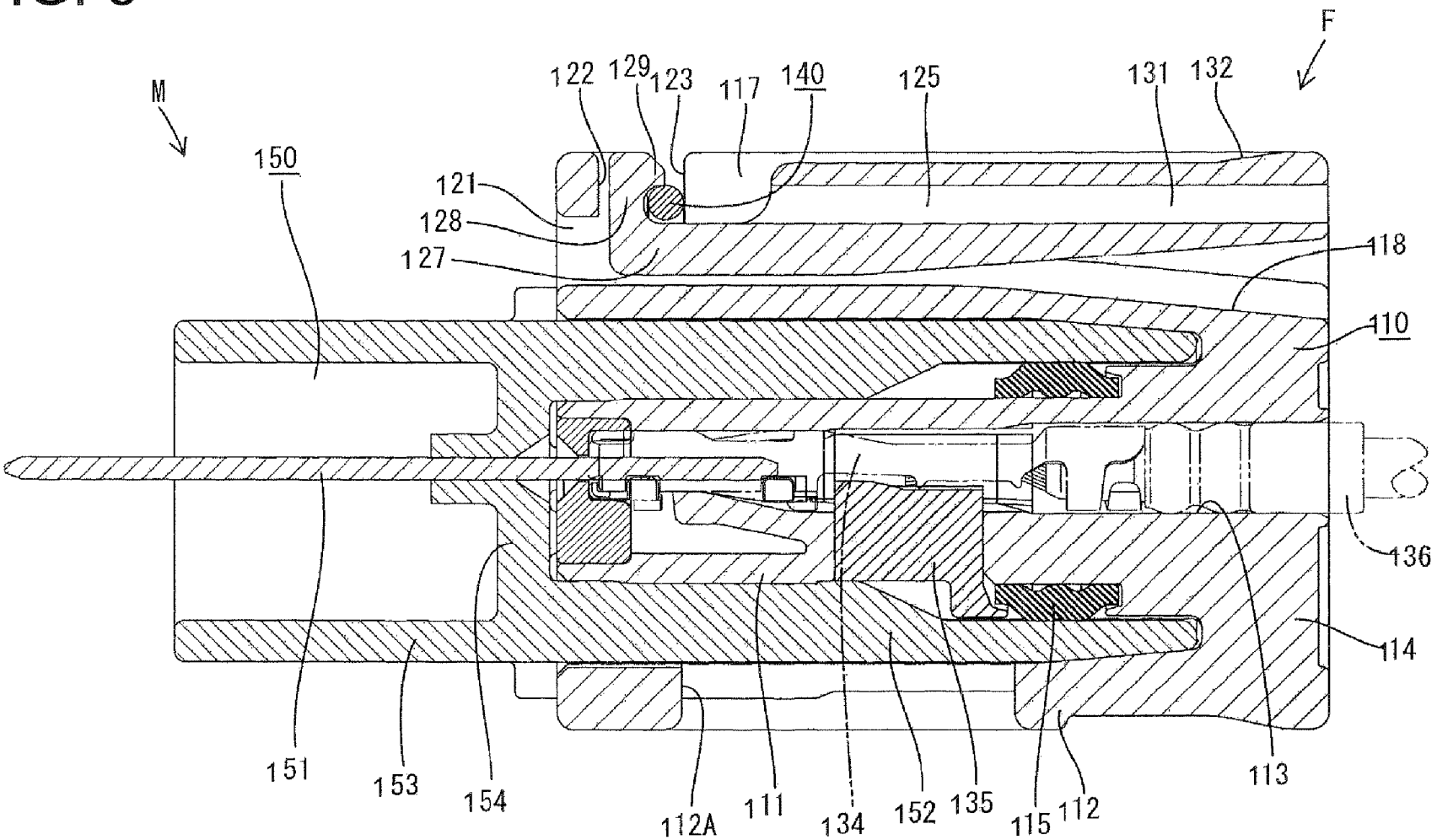
FIG. 8 is a longitudinal section showing a connector assembly according to a further embodiment locked in a properly connected state.
Figure 9:
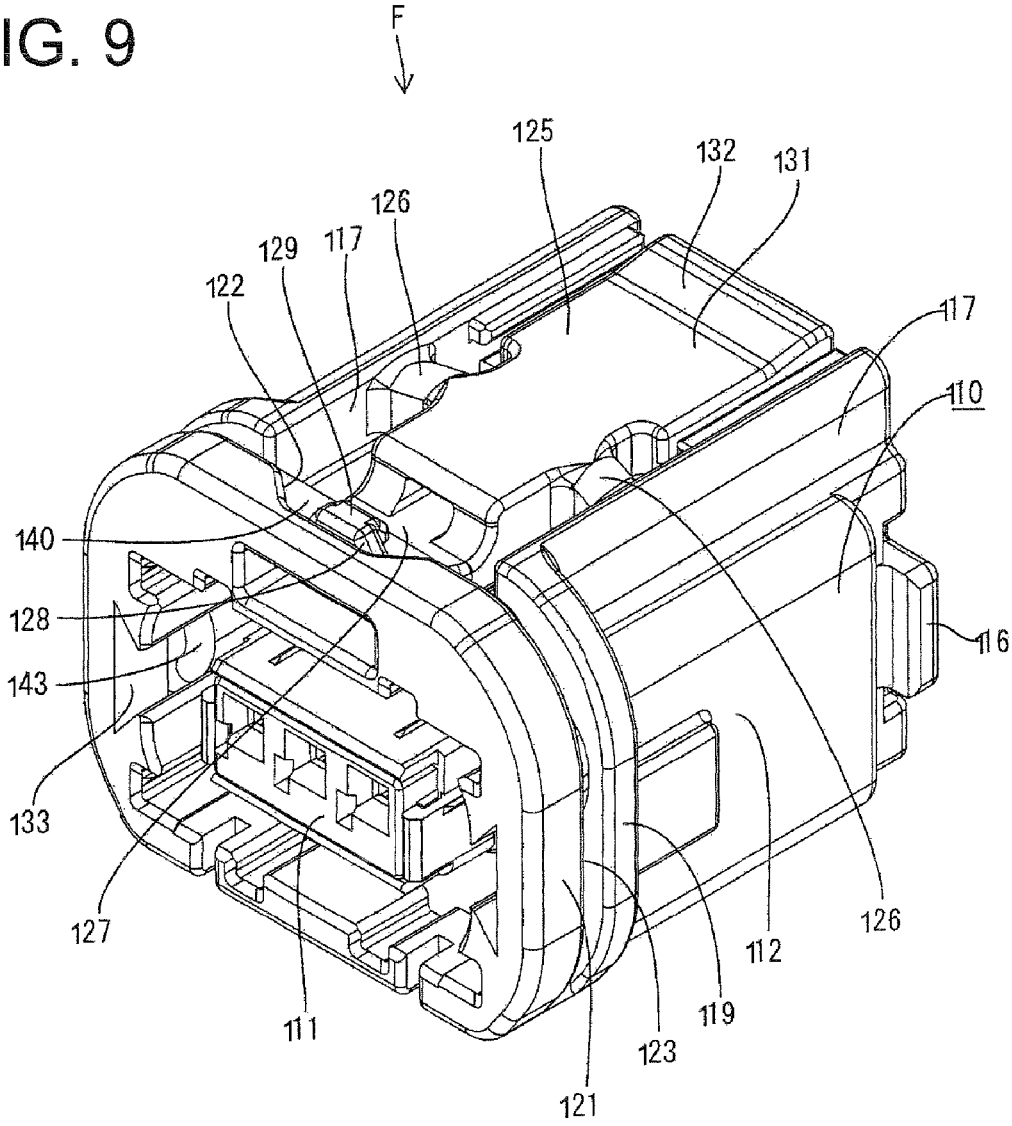
FIG. 9 is a front perspective view of a female connector.
Figure 10:
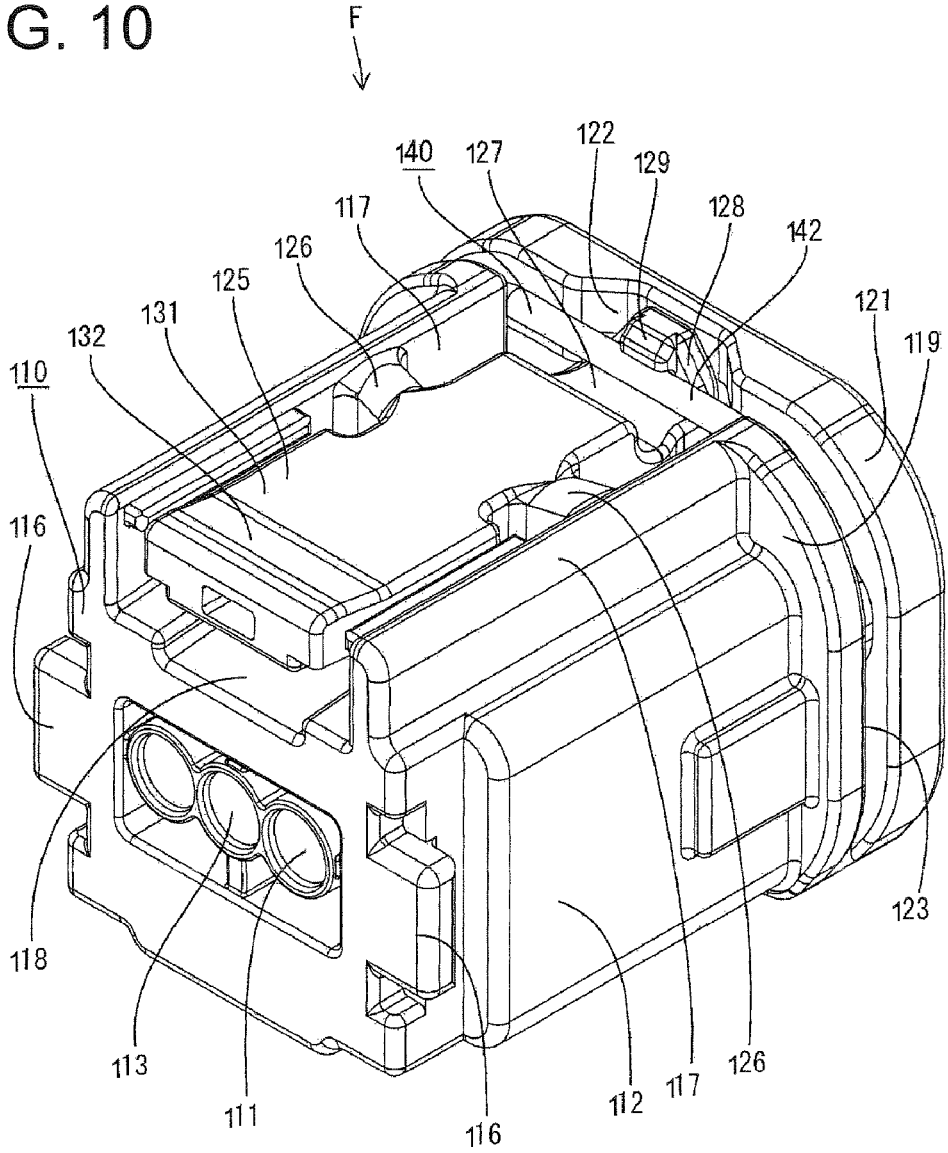
FIG. 10 is a rear perspective view of the female connector.
Figure 11:
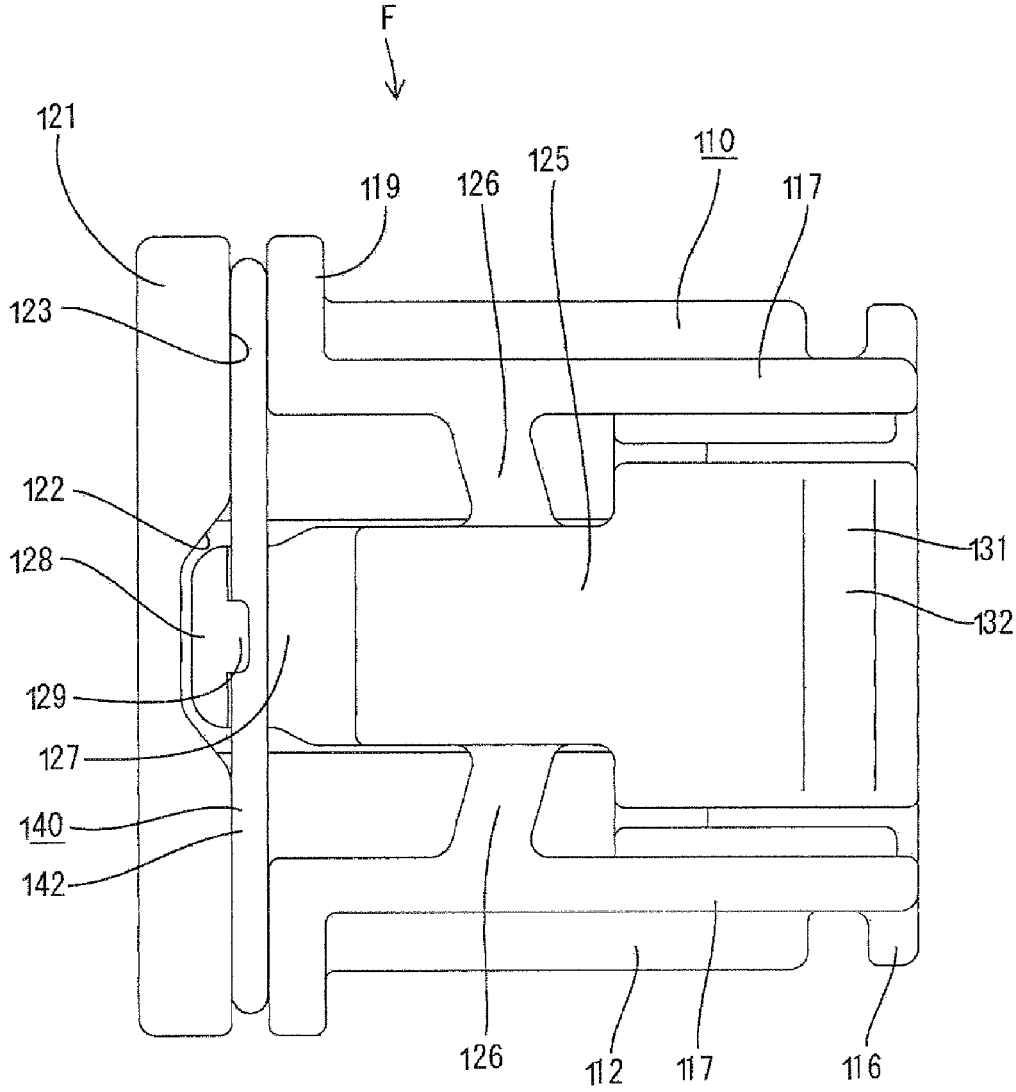
FIG. 11 is a plan view of the female connector.
Figure 12:
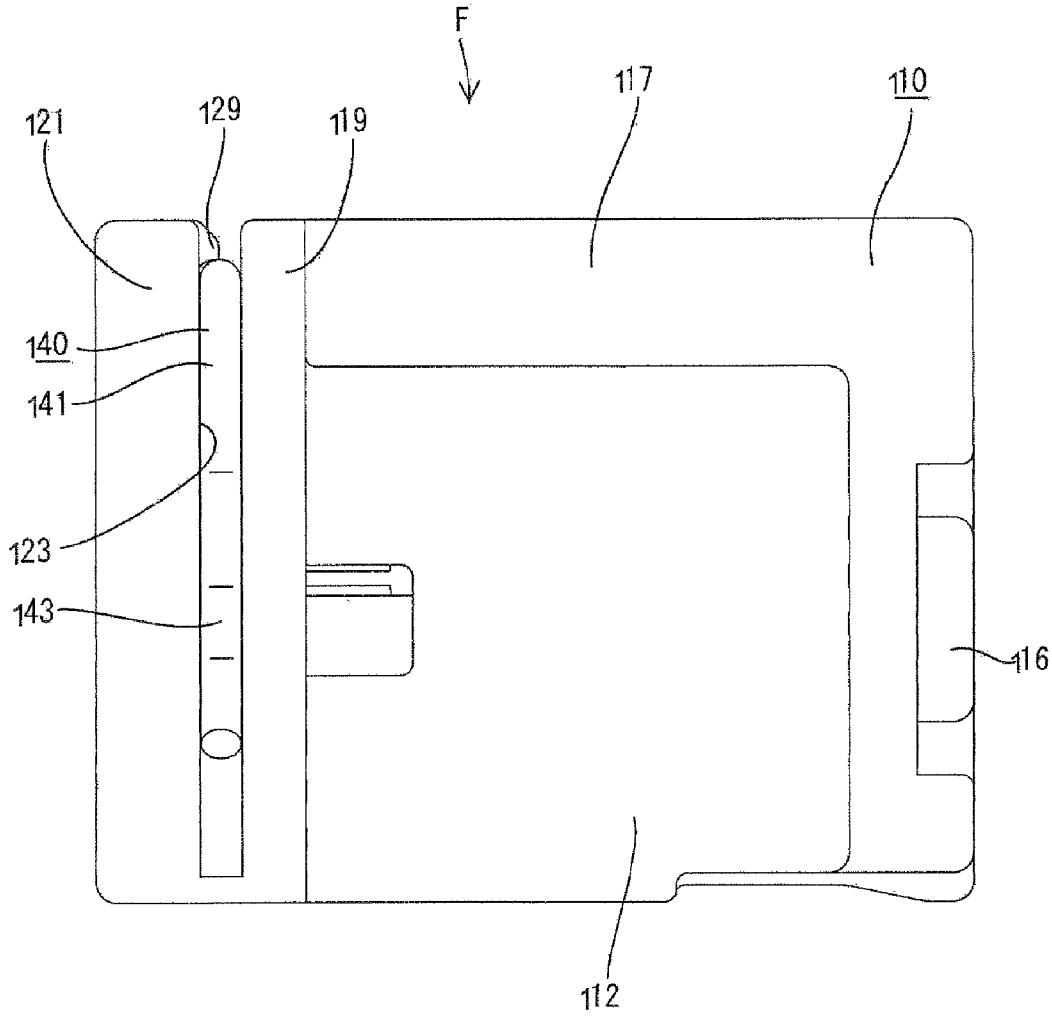
FIG. 12 is a side view of the female connector.
Figure 13:
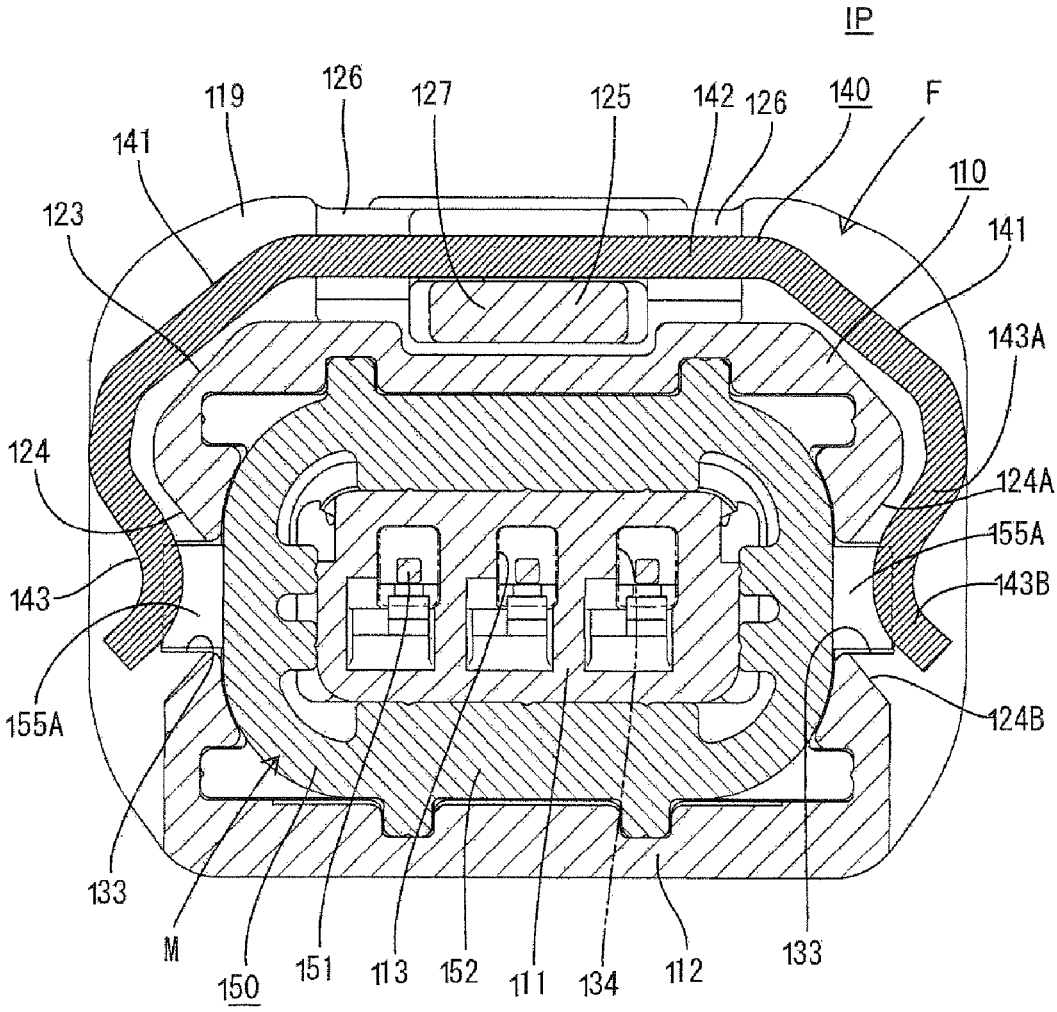
FIG. 13 is a lateral section showing a state where the connector device is locked in the properly connected state.
Figure 14:
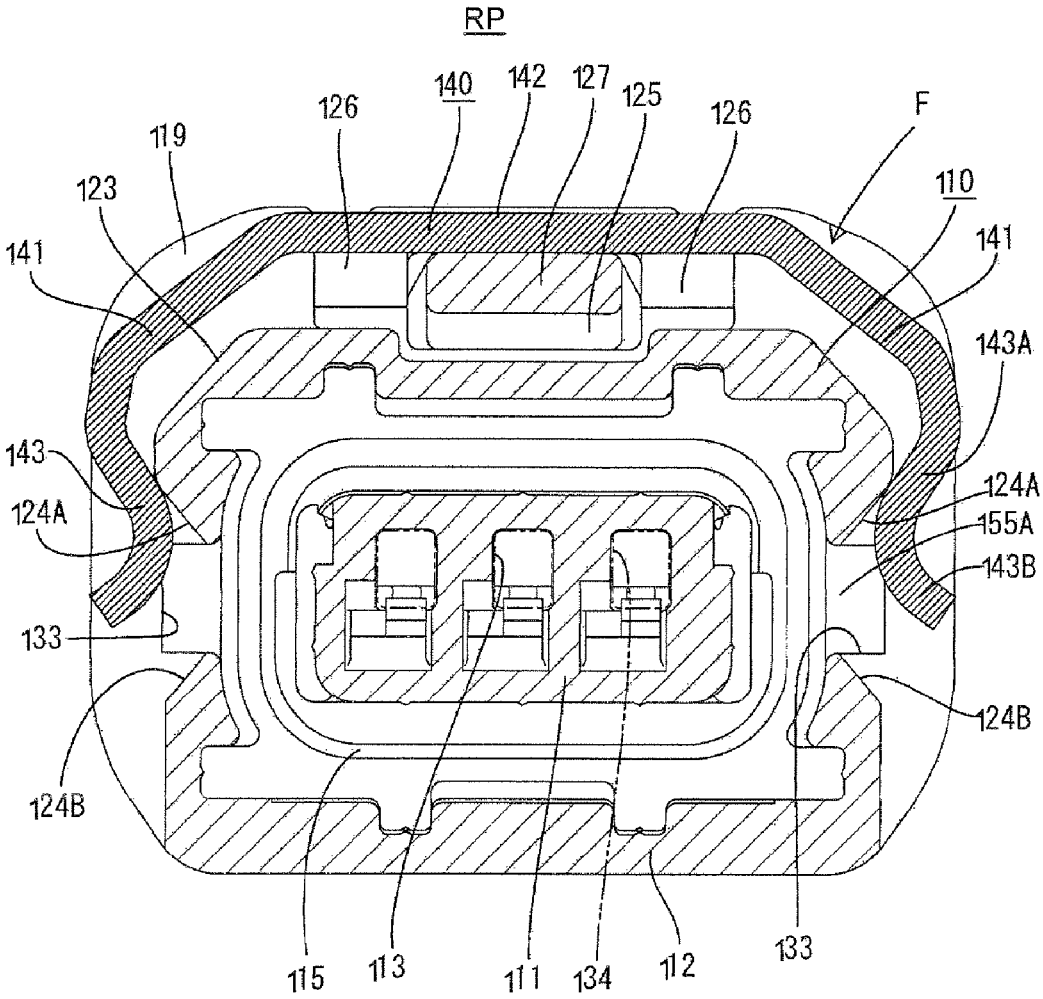
FIG. 14 is a lateral section showing the female connector in an unlocked state.
Figure 15:
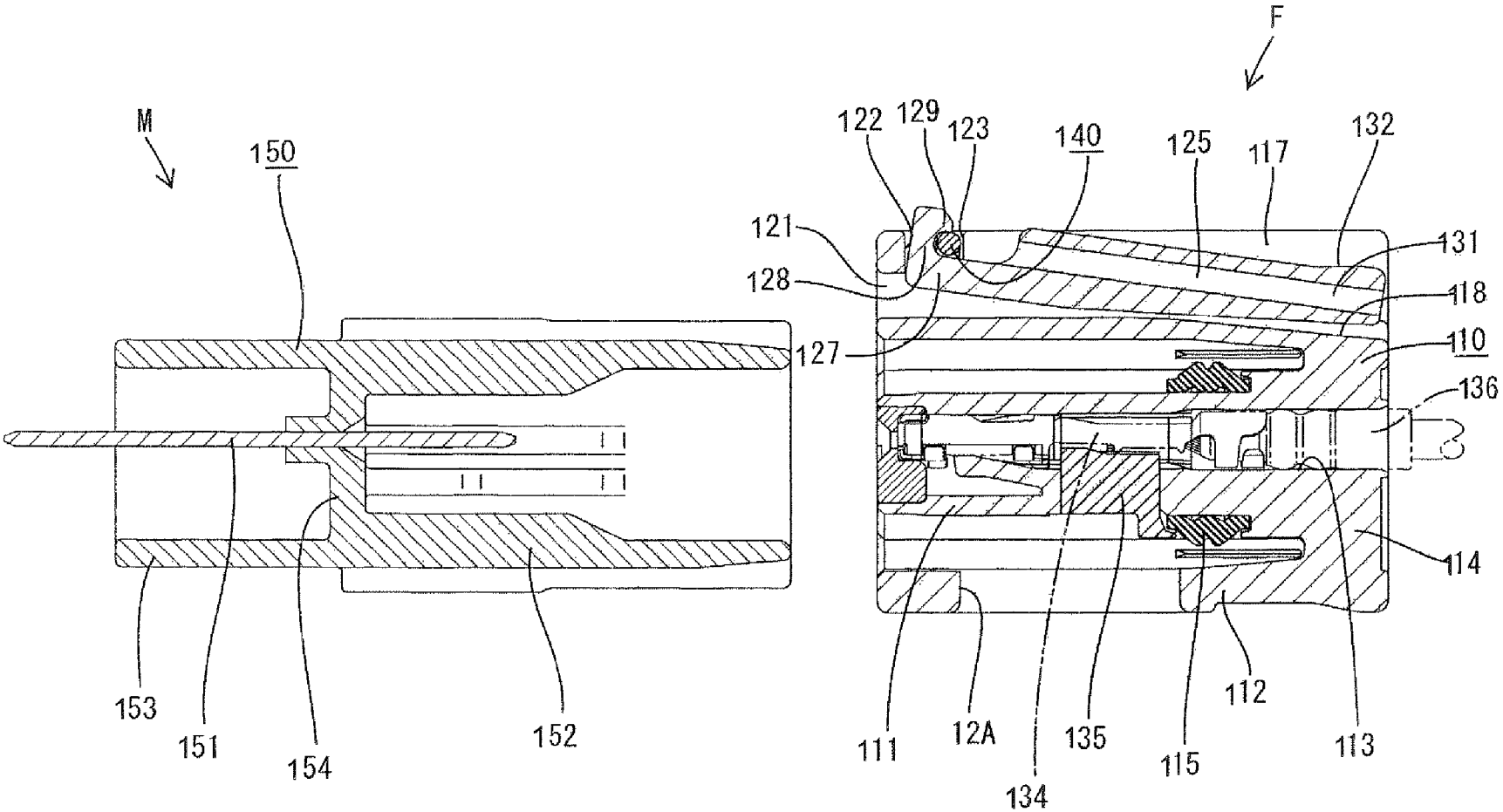
FIG. 15 is a longitudinal section showing the connectors separated.
Figure 16:
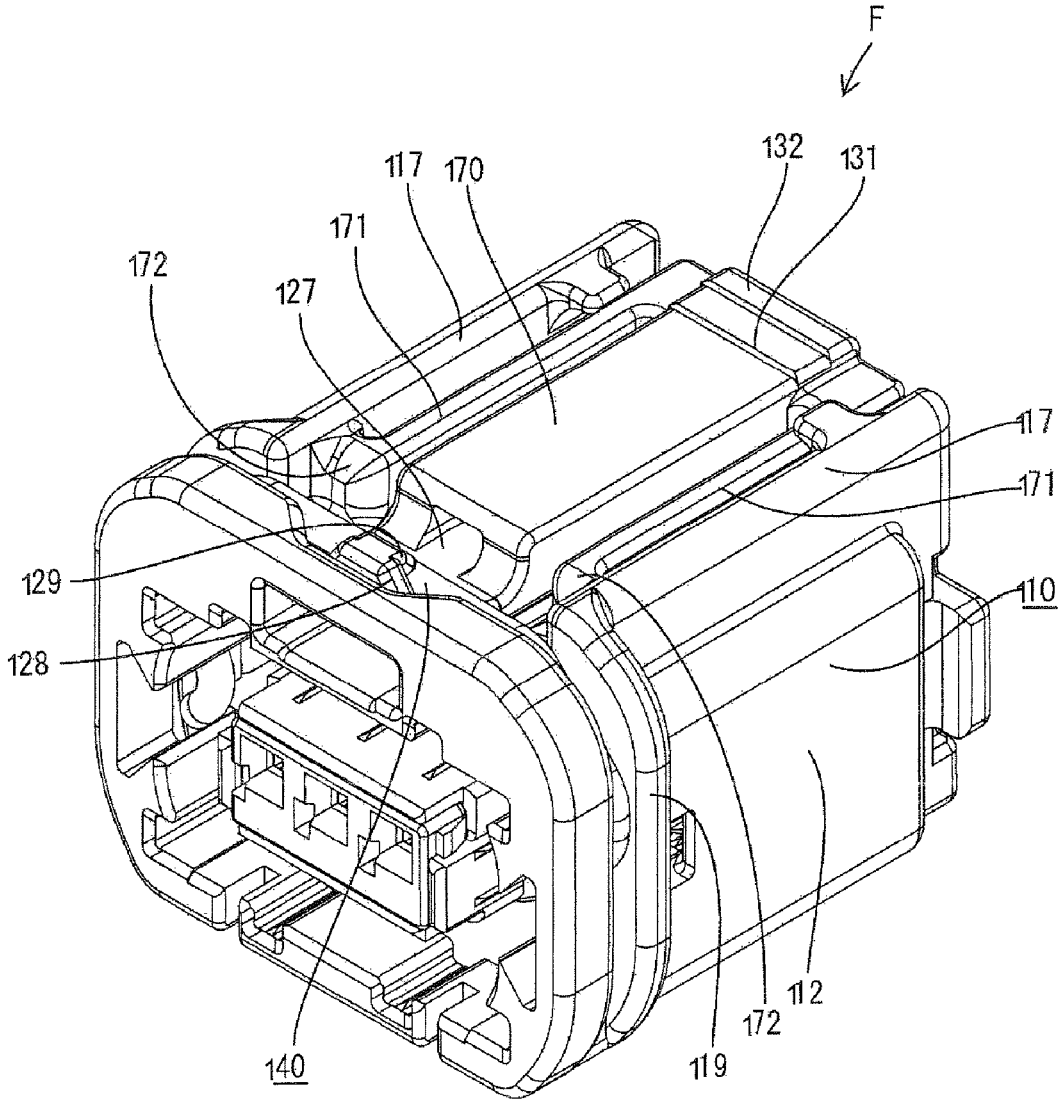
FIG. 16 is an external perspective view showing a female connector according to a still further embodiment when viewed from front.
Figure 17:
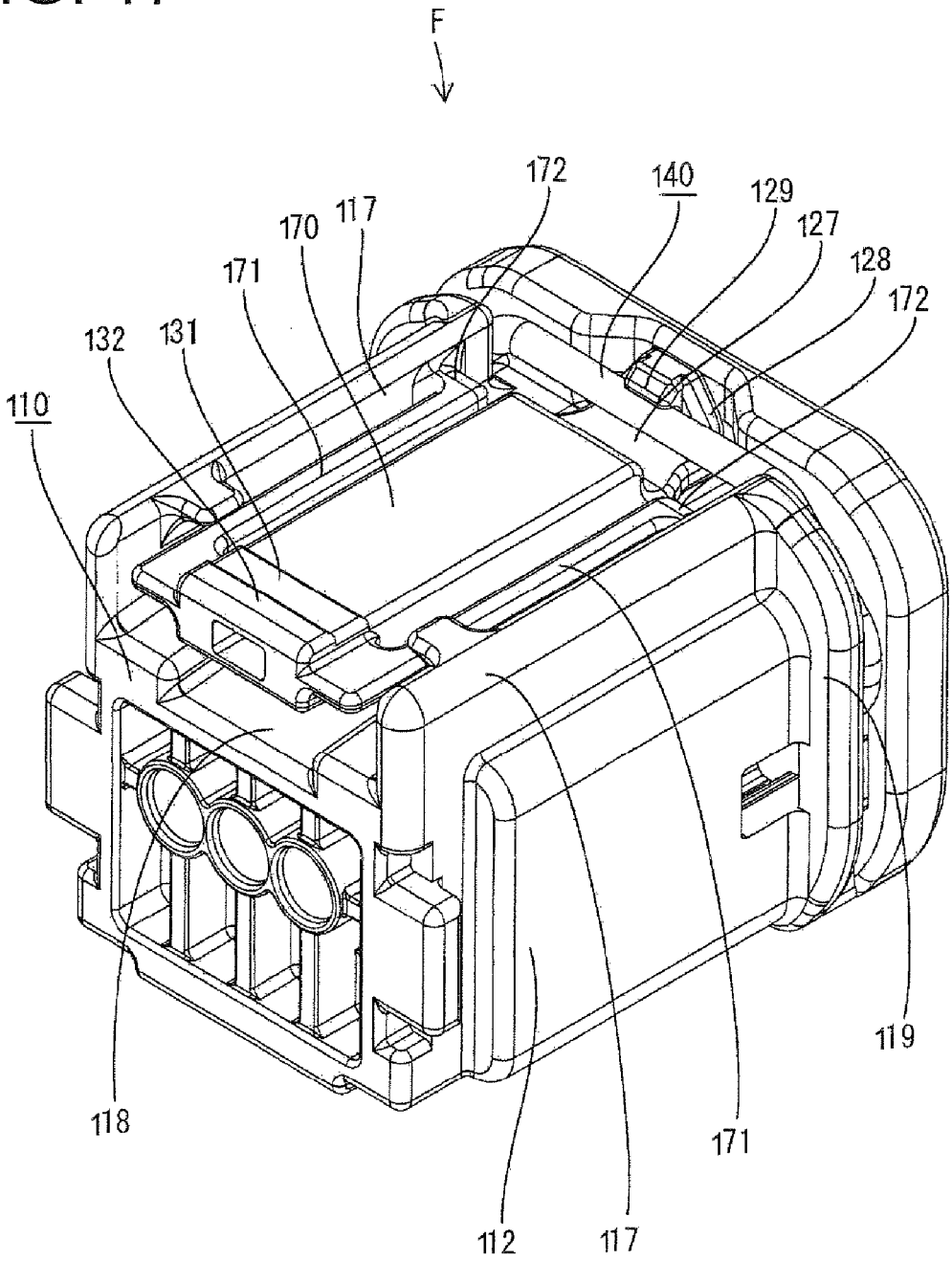
FIG. 17 is a rear perspective view of the female connector when viewed from behind.
Figure 18:
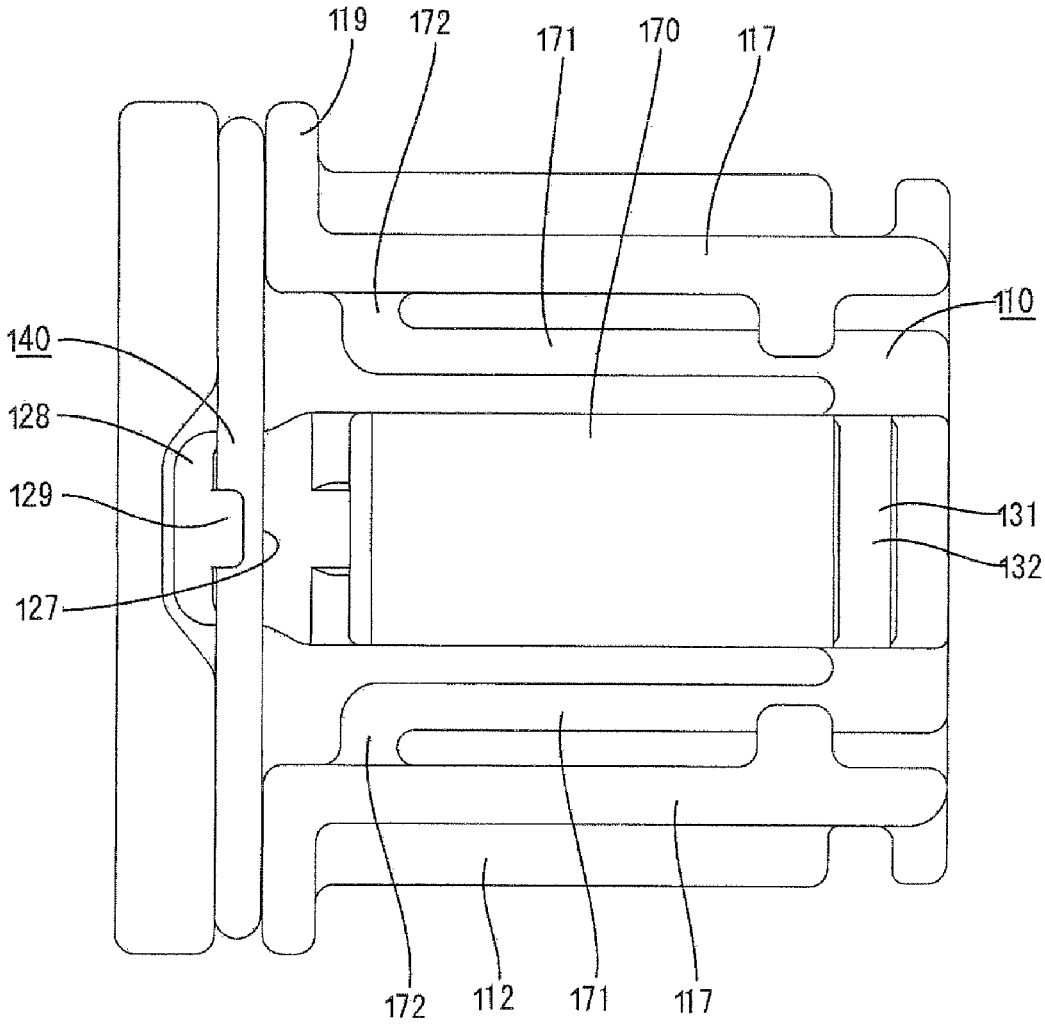
FIG. 18 is a plan view of the female connector.
Figure 19:
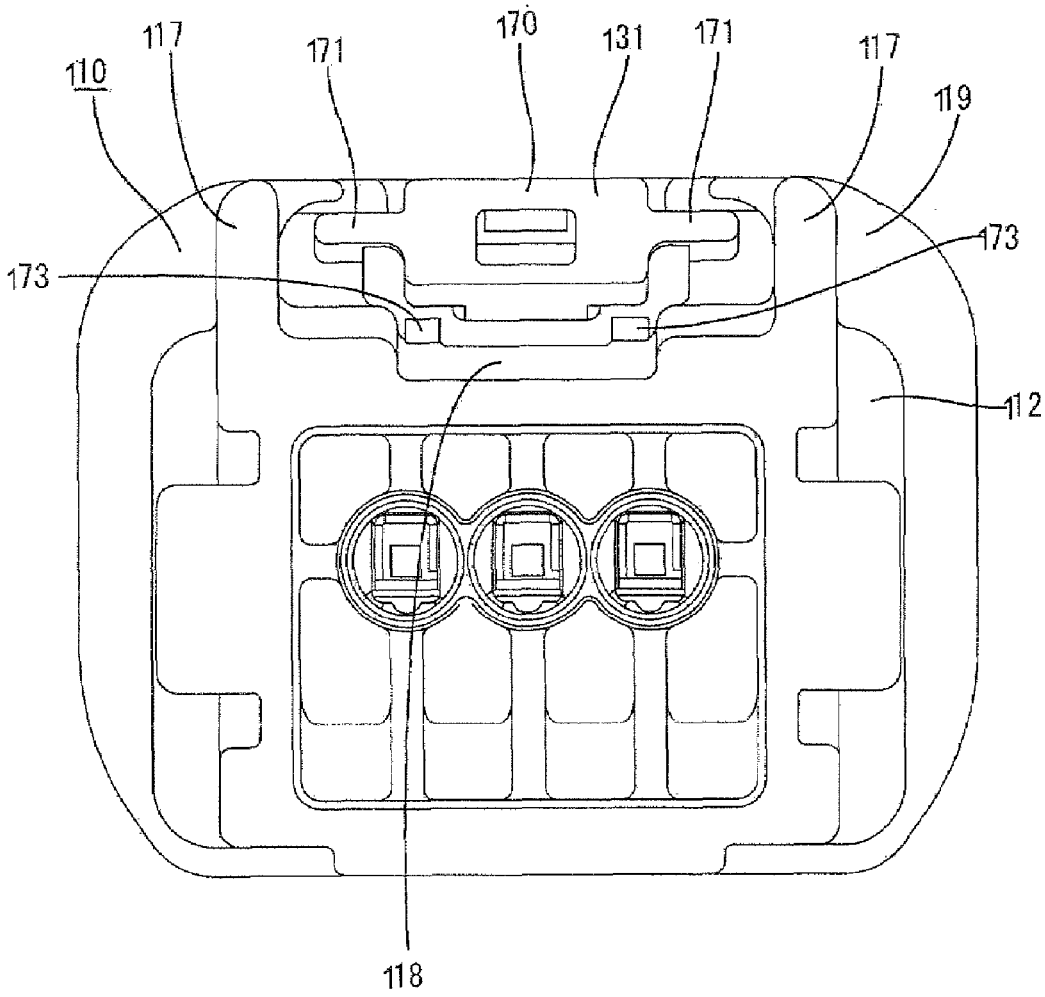
FIG. 19 is a rear view of the female connector.
Figure 20:
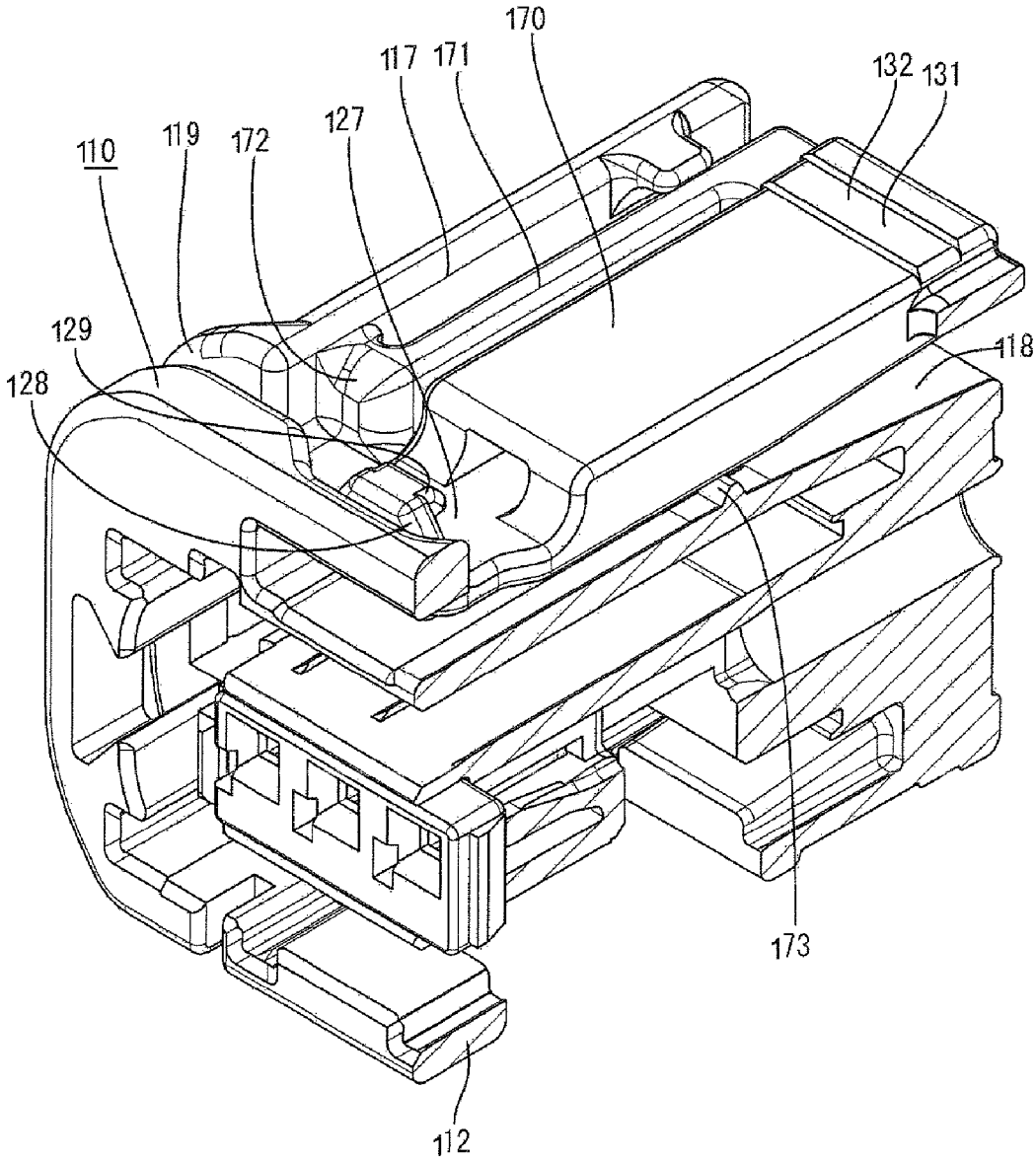
FIG. 20 is an external perspective view partly in section showing the female connector.
Figure 21:
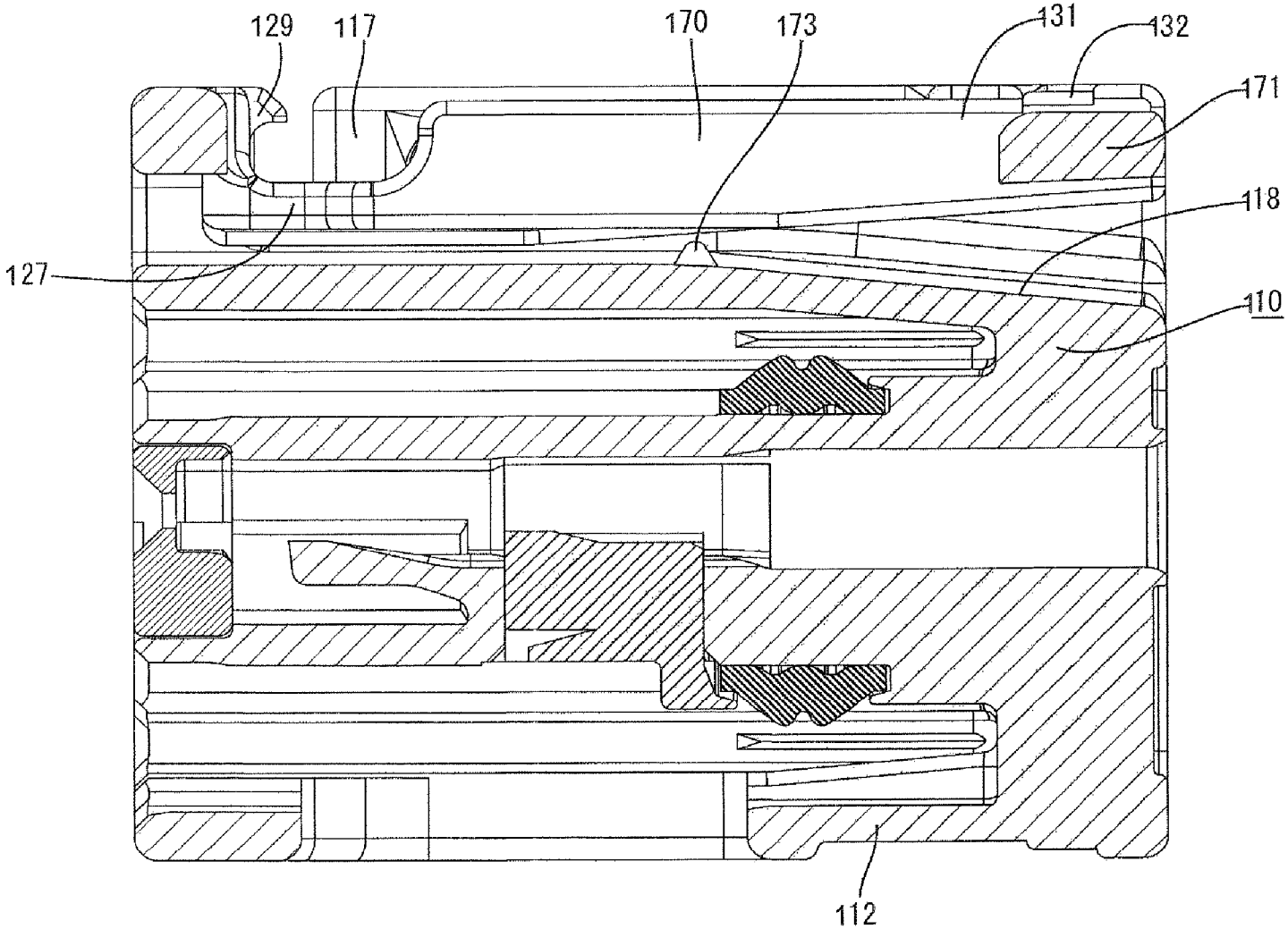
FIG. 21 is a longitudinal section of the female connector.

A connector in accordance with a first embodiment of the invention is illustrated in FIGS. 1 to 7 and includes a male connector 10 and a female connector 20 that are connectable with each other. Ends of the two connectors 10, 20 that are connected to one another are referred to herein as the front ends and reference is made to FIG. 1 concerning upper and lower sides.

The male connector 10 includes a male housing 11 and male terminals 12 are held in the male housing 11. The male housing 11 is made e.g. of synthetic resin and includes front and rear receptacles 13 and 14, each of which is a wide substantially rectangular tube. The front receptacle 13 has an open front end and the rear receptacle 14 has an open rear end. The thickness of the front portion of the front receptacle 13 in inward and outward directions is less than the thickness of the rear portion of the front receptacle 13. Engaging projections 16 project laterally out from the opposite left and right surfaces of the male housing 11.

Male terminals 12 are provided side by side in the width direction and are held while penetrating a back wall 15 of the male housing 11 between the front and rear receptacles 13 and 14. Thus, front and rear parts of the male terminals 12 project respectively into the front and rear receptacles 13 and 14.

The female connector 20 includes a female housing 21 made e.g. of synthetic resin and connectable with the male housing 11. The female housing 21 includes a terminal accommodating portion 23 that accommodates female terminals 22 and an outer tube 24 surrounds the outer circumferential surface of the terminal accommodating portion 23.

The terminal accommodating portion 23 is a wide substantially rectangular column that can fit into the front receptacle 13 of the male housing 11. Three cavities 25 are formed side by side in the terminal accommodating portion 23 and the female terminals 22 can be inserted into the cavities 25 from behind.

A connecting portion 26 extends unitarily out from the rear end of the terminal accommodating portion 23 and the outer tube 24 projects unitarily forward from the connecting portion 26 to a position substantially aligned with the front end of the terminal accommodating portion 23. A fitting space 27 is defined between the outer tube 24 and the terminal accommodating portion 23 for receiving the front receptacle 13 of the male housing 11. Backlash preventing ribs 49 project into the fitting space 27 from positions on the outer peripheral surface of the terminal accommodating portion 23 and the inner peripheral surface of the outer tube 24 (see FIG. 6) for preventing backlash between the front receptacle 13 and the outer tube 24. An opening 24A is formed in the lower surface of the outer tube 24 and can receive a retainer 48 for retaining the female terminals 22 in the terminal accommodating portion 23.

A seal ring 28 is fit at a position near the rear end of the outer peripheral surface of the terminal accommodating portion 23. The seal ring 28 can be squeezed or deformed between the front receptacle 13 and the terminal accommodating portion 23 to provide sealing between the housings 11 and 12.

Finger placing portions 29 project laterally out from the opposite left and right surfaces of the female housing 21 near the rear end of the female housing 21. Fingertips can be placed on the finger placing portions 29 to pull the female housing 21 out for separating the connectors 10, 20.

Two laterally spaced standing walls 31 project out from the upper surface of the outer tube 24. The standing walls 31 extend continuously in forward and backward directions from the rear end of the female housing 21 to a position near the front end thereof.

First positioning walls 32 are provided on the opposite side surfaces of the outer tube 24 extend circumferentially from the front ends of the standing walls 31. A second positioning wall 33 is provided on the outer tube 24 before the first positioning walls 32. The second positioning wall 33 extends circumferential wall over the upper surface and the opposite side surfaces of the outer tube 24. The first and second positioning walls 32 and 33 are substantially parallel to each other and are spaced in forward and backward directions.

A forwardly open front recess 34 is formed in a widthwise intermediate position of a part of the second positioning wall 33 and extends substantially along the upper surface of the outer tube 24. The front recess 34 becomes gradually deeper from the opposite widthwise ends thereof towards the center thereof, and its depth in an intermediate part is less than ⅔, preferably about half the thickness of the second positioning wall 33 in forward and backward directions.

A mounting portion 35 is defined on the outer tube 24 between the first and second positioning walls 32 and 33. The mounting portion 35 is formed by an inwardly recessed part of the outer peripheral surface of the outer tube 24 between the first positioning walls 32 and the second positioning wall 33.

Passages 36 are formed in opposite left and right walls of the outer tube 24 for receiving the engaging projections 16 of the male housing 11. Each passage 36 opens inwardly towards the terminal accommodating portion 23 and communicates with the mounting portion 35.

Communicating portions 37 provide communication between the mounting portion 35 and the passages 36 and upper and lower surfaces 37A and 37B of communicating portions 37 are inclined to approach each other from the outer side towards the inner side. A vertical dimension of the communicating portions 37 at the inner sides is substantially equal to that of the engaging projections 16 (see FIG. 5).

The connector further includes a U-shaped spring 50 with two legs 51 that extend down from opposite ends of an upper side 52. The legs 51 are substantially normal to the upper side 52 in an undeflected state of the spring 50. However, the legs 51 can be deflected resiliently away from one another.

Engaging portions 53 are bent to define inwardly pointed shapes at bottom parts of the legs 51. The engaging portions 53 project into the passages 36 via the communicating portions 37. Each engaging portion 53 includes an upper inclined side 53A inclined in towards the other leg 51 and a lower inclined sides 53B. Thus, the engaging portions 53 are shaped to have a smaller dimension in a vertical direction towards the inner side. The upper and lower inclined sides 53A and 53B have substantially the same inclinations as the upper and lower surfaces 37A and 37B of the communicating portions 37. Boundaries between the upper and lower inclined sides 53A and 53B of the engaging portions 53 are rounded.

The spring 50 is mounted for displacement between an inserted position IP (see FIG. 5) where the engaging portions 53 project into the passages 36 and a retracted position RP (see FIG. 6) where the engaging portions 53 are retracted from the passages 36. The engaging portions 53 projecting into the passages 36 are pressed by the engaging projections 16 passing the passages 36 when the spring 50 is at the inserted position IP. Thus, the legs 51 are deformed resiliently out. The legs 51 restore resiliently so that the engaging portions 53 engage engageable surfaces 16B of the engaging projections 16 to lock the male housing 11 when the two connectors 10, 20 reach a properly connected state.

The spring 50 can be displaced up and away from the female housing 21 from the inserted position IP to the retracted position RP. The engaging portions 53 are retracted from the passages 36 to cancel the locked state when the spring 50 reaches the retracted position RP. More particularly, the engaging portions 53 that are retracted from the passages 36 are located at the outer sides of the upper surfaces 37A of the communicating portions 37.

A rear recess 38 is formed at a part of the upper surface of the outer tube 24 between the standing walls 31. The rear recess 38 is in an intermediate position in forward and backward directions and extends to the rear edge of the female housing 21 (see FIG. 7). The depth of the rear recess 38 gradually increases towards the back.

An unlocking arm 39 is provided on the outer tube 24 between the standing walls 31. The unlocking arm 39 extends forward and backward along the connecting direction with the male housing 11. Rotary shafts 41 extend in the width direction to connect the unlocking arm 39 with the standing walls 31 so that the unlocking arm 39 is inclinable like a seesaw.

A pressing portion 42 is defined near the front end of the unlocking arm 39 and is located below the spring 50 for pressing the spring 50 up and away from the female housing 21 when the unlocking arm 39 is inclined. A front wall 43 stands up at the front end of the unlocking arm 39. The front wall 43 enters the front recess 34 of the second positioning wall 33, and the rear surfaces of the front wall 43 and the second positioning wall 33 are substantially flush. The front wall 43 has a substantially mountain shape so that the width of the front wall 43 decreases gradually towards the upper end.

A hook 44 projects back near the upper end of the front wall 43. A projecting distance of the hook 44 from the front wall 43 is substantially equal to or more than about half the dimension of the spring 50 in forward and backward directions. The hook 44 is above the upper side 52 of the spring 50. A clearance is defined between the hook 44 and the pressing portion 42 and has a dimension substantially equal to the vertical dimension of the spring 50. The upper side 52 of the spring 50 is held between the hook 44 and the pressing portion 42 with substantially no clearance in the vertical direction. The hook 44 is at a position corresponding to a widthwise central part of the spring 50 between the legs 51.

The spring 50 is held substantially entirely between the first positioning walls 32 and the front wall 43, the second positioning wall 33 with substantially no clearance defined in forward and backward directions. The heights of the first and second positioning walls 32 and the second positioning wall 33 are set so that the spring 50 is held therebetween over a displaceable range between the inserted position IP and the retracted position RP.

An unlocking portion 45 is provided near a rear end of the unlocking arm 39. The lower surface of the unlocking portion 45 is inclined out and up towards the rear end to reduce the thickness of the unlocking portion 45. The inclination of the lower surface of the unlocking portion 45 and the rear recess 38 of the female housing 21 ensures a sufficient downward displacement of the unlocking portion 45 while the height of the female housing 21 is suppressed.

The spring 50 is at the inserted position IP and the female housing 21 is in a state lockable into the male housing 11 when the unlocking arm 39 is in a natural state. A state of the unlocking arm 39 at this time is called a lockable state. The unlocking portion 45 can be pressed to incline the unlocking arm 39 so that the pressing portion 42 displaces the spring 50 up and out towards the retracted position RP to cancel the locked state with the male housing 11. This state of the unlocking arm 39 is called an unlocking state.

The rear part of the fitting space 27 of the female connector 20 has slanted surfaces 46 that incline to approach the terminal accommodating portion 23 and to reduce the width and height of the fitting space 27. The slanted surfaces 46 are formed on the inner peripheral surface of the outer tube 24 facing the terminal accommodating portion 23 and at a back end of the fitting space 27. More specifically the slanted surfaces 46 are in a range of the inner peripheral surface of the outer tube 24 from a position immediately before the connecting portion 26 to a position near the front end of the seal ring 28. Additionally, the slanted surfaces 46 extend around substantially the entire inner peripheral surface of the outer tube 24 (specifically, upper, lower, left and right surfaces excluding four corners) to reduce the dimensions of the fitting space 27 in vertical and transverse directions. The width at the back end of the fitting space 27 is less than the thickness of a front end part of the front receptacle 13 of the male housing 11. Thus, the front receptacle 13 contacts the slanted surfaces 46 when the two connectors 10, 20 reach the properly connected state and before the front end of the front receptacle 13 reaches the back end of the fitting space 27. Thus, a clearance is defined forward of the front receptacle 13.

The front part of the front receptacle 13 is formed with inclined surfaces 17 that conform with the inclinations of the slanted surfaces 46. The inclined surfaces 17 are formed around substantially the entire outer periphery of the front receptacle 13 and are inclined outwardly from the front end of the front receptacle 13 towards the rear end. Thus, the inclined surfaces gradually thin the front receptacle 13 towards the front. Parts of the inner peripheral surface of the front receptacle 13 corresponding to the inclined surfaces 17 are to be held in close contact with the seal ring 28.

The engaging projections 16 of the male connector 10 are arranged at intermediate positions of the male housing 11 in forward and backward directions, and height positions that are substantially in the vertical center of the female housing 11. A riding surface 16A is defined at the front of each engaging projections 16 and is inclined moderately up from the front towards the rear so that the spring 50 can be moved easily onto the engaging projections 16. An engageable surface 16B is defined at the rear of each engaging projection 16 and is engageable with the spring 50.

The engageable surfaces 16B are inclined to reduce the projecting distance from the front receptacle 13 towards the rear. Hence the engageable surfaces 16B produce forces for pushing the engaging projections 16 forward in the connecting direction upon receiving resilient restoring forces of the legs 51 in directions from the outer side toward the inner side of the front receptacle 13. The inclination of the engageable surfaces 16B is steeper than the inclination of the riding surfaces 16A and is defined by the projecting distance of the engaging projections 16 with respect to a dimension smaller than the width of the spring 50 in forward and backward directions. The engageable surfaces 16B face the communicating portions 37 when the two connectors 10, 20 reach the properly connected state. More specifically, the front edges of the engageable surfaces 16B coincide with front edges of the communicating portions 37 and substantially the entire engageable surfaces 16B are exposed to the space outside the outer tube 24 via the communicating portions 37 in the properly connected state of the connectors 10, 20. The slanted surfaces 46 ensure the clearance before the front receptacle 13 and ensure that the engageable surfaces 16B can be positioned easily with respect to forward and backward directions. For example, if the front end of the front receptacle contacted the back end of the fitting, the positions of the two housings with respect to forward and backward directions would be determined by such contact. However, the clearance is provided before the front receptacle 13 in this embodiment. Therefore, a slight error can be compensated by inserting the front receptacle 13 forward.

The unlocking arm 39 is set in the lockable state and the spring 50 is set at the inserted position IP prior to the start of a connecting operation. The female housing 21 then is gripped by fingers and gradually pushed into the male connector 10 while the passages 36 of the female housing 21 are positioned with respect to the engaging projections 16 of the male housing 11. The engaging projections 16 then move forward in the passages 36 and the riding surfaces 16A contact the engaging portions 53 of the spring 50. The engaging portions 53 of the spring 50 move onto the engaging projections 16 and the legs 51 are displaced outwardly in directions away from each other as the engaging projections 16 move further forward. At this time, the hook 44 of the unlocking arm 39 is above the spring 50 and prevents the spring 50 from being lifted as the legs 51 displace resiliently.

The front end part of the front receptacle 13 of the male housing 11 then is inserted towards the back side of the fitting 27 while pressing and deforming the seal ring 28. The inclined surfaces 17 of the front receptacle 13 contact the slanted surfaces 46 when the connectors 10, 20 reach the properly connected state to prevent further forward movement. The projecting end surfaces between the riding surfaces 16A and the engageable surfaces 16B of the engaging projections 16 pass the spring 50. Thus, the legs 51 resiliently restored and contact the engageable surfaces 16B arranged to face the communicating portions 37. As a result, the two housings 11, 21 are locked into together. At this time, the engaging portions 53 of the legs 51 are pressed against the engageable surfaces 16B at positions near the front end. In the properly connected state of the two connectors 10, 20, the seal ring 28 and the rubber plugs 47 seal inner spaces of the two housings 11, 21 and the male and female terminals 12, 22 are properly electrically connected.

The inclined surfaces 17 of the male connector 10 and the slanted surfaces 46 of the female connector 20 are held in contact so that the clearance is before the male connector 10 when the connectors 10, 20 are connected properly. Additionally, the engaging projections 16 are pressed forward by resilient forces of the legs 51 to hold the connectors 10, 20 in close contact. The male connector 10 or the female connector 20 could be deformed due to creep or the like, and, for example, the outer tube portion 24 may be deformed outwardly. However, the male housing 11 is pushed forward by the resilient restoring forces of the legs 51 and a forward movement corresponding to this deformation is made to hold the two connectors 10, 20 in close contact. Therefore, backlash of the connectors 10, 20 is prevented even if the connectors 10, 20 are used in a high-temperature and/or high-vibration environment and fine sliding abrasion of the terminals 12, 22 can be avoided.

The close surface contact between the inclined surfaces 17 and the slanted surfaces 46 prevent backlash. In addition, the seal ring 28 is squeezed between the front receptacle 13 and the terminal accommodating portion 23 and exerts a resilient force to press the front receptacle 13 against the outer tube 24. In this way, the slanted surfaces 46 and the inclined surfaces 17 are held in close contact over substantially their entire peripheries.

The spring 50 is mounted between the first and second positioning walls 32 and 33 to have its displacements in forward and/or backward directions prevented. Vertical displacements of the spring 50 are prevented by the hook 44 and the pressing portion 42. As a result, the backlash between the spring 50 and the female housing 21 is prevented.

The two locked connectors 10, 20 can be separated if necessary by placing fingertips on the unlocking arm 39 in the lockable state and pressing the unlocking portion 45 down. Thus, the unlocking arm 39 inclines and the pressing portion 42 displaces the spring 50 up and out. The upper inclined sides 53A of the engaging portions 53 are guided out along the upper surfaces 37A of the communicating portions 37 as the spring 50 moves up. Thus, the legs 51 deform resiliently away from each other. The upper inclined sides 53A and the upper surfaces 37A of the communicating portions 37 are inclined. Therefore, the legs 51 are unlikely to get caught while being deformed and the spring 50 can be displaced smoothly. The engaging portions 53 are at the upper ends of the upper surfaces 37A of the communicating portions 37 and are retracted from the passages 36 when the unlocking arm 39 reaches the unlocking state. Thus, the engaging projections 16 are freed from the locked state and can move backward. Accordingly, pressing the unlocking portions 45 displaces the spring 50 from the inserted position IP to the retracted position RP and cancels the locked state. Operational efficiency is good since the spring 50 need not be operated directly by fingertips. Fingers grip the finger placing portions 29 of the female housing 21 from the opposite sides and pull the female housing 21 backward after the locked state is canceled to separate the two connectors 10, 20.

The fingers that had pressed the unlocking portion 45 are moved away after separating the connectors 10, 20. As a result, the unlocking arm 39 naturally returns to the lockable state and the engaging portions 53 of the legs 51 are pressed against the upper surfaces 37A of the communicating portions 37 with the resilient restoring forces. The engaging portions 53 then are guided into the passages 36 by the inclinations of the upper surfaces 37A of the communicating portions 37 and, accordingly, the spring 50 is displaced from the retracted position RP to the inserted position IP. Thus, the spring 50 is set automatically to the inserted position IP merely by moving the fingertips away from the unlocking portion 45. The spring 50 need not be set to the inserted position IP again upon reconnecting the two connectors 10, 20 and time and labor for the connecting and separating operations of the connectors 10, 20 is saved.

As described above, the male connector 10 and the slanted surfaces 46 of the female connector 20 contact while defining a clearance before the male connector 10 when the connectors 10, 20 reach the properly connected state. Additionally, the resiliently restored legs 51 press the engageable surfaces 16B so that the male connector 10 is pressed forward towards the female connector 20. Accordingly, even if the connectors 10, 20 are deformed due to creep or the like, the male housing 11 is pushed forward by the resilient restoring forces of the legs 51 and moves forward. Accordingly, the male connector 10 and the slanted surfaces 46 of the female connector 20 are held in contact. Therefore, backlash of the connectors 10, 20 is prevented.

The invention is not limited to the above described and illustrated embodiment. For example, the following modifications are also embraced by the technical scope of the present invention.

Although the spring 50 is mounted on the female connector 20 in the above embodiment, the invention is not limited to this and the spring may be mounted on the male connector while being held in such a state engageable with the female connector. At this time, the female connector may be provided with the engageable portions, the male connector may be formed with the passages, and the spring may be mounted, for example, on a rear end part of the male housing. Alternatively or additionally, the engageable portions may be provided on the inner side of the outer tube of the female housing, and the legs of the spring may contact the engageable portions to be displaced resiliently in upon connecting the two connectors, whereas the legs may be restored resiliently out to engage the engageable surfaces of the engaging portions when the two connectors reach the properly connected state.

Although the spring 50 reaches the retracted position RP by being displaced up and out from the inserted position IP in the above embodiment, it may reach the retracted position by being displaced down from the inserted position.

Although the locked state is canceled by operating the unlocking arm 39 in the above embodiment, the locked state may be canceled by directly displacing the spring with fingertips.

Although the upper surfaces 37A of the communicating portions 37 and the upper inclined sides 53A of the engaging portions 53 are both inclined in the above embodiment, only either ones thereof may be inclined.

A second embodiment of the invention is illustrated in FIGS. 8 to 15 and relates to a locking structure for locking female and male connectors F and M together. Ends of the two connectors to be connected are referred to as front ends and reference is made to FIG. 8 concerning upper and lower sides.

The male connector M includes a male housing 150 and male terminals 151 are held in the male housing 150. The male housing 150 is made e.g. of synthetic resin and includes wide tubular front and rear receptacles 152 and 153. The front receptacle 152 has an open front end and the rear receptacle 153 has an open rear end. Male terminals 151 are held while penetrating a back wall 154 between the front and rear receptacles 152 and 153 of the male housing 150. Front and rear parts of the male terminals 151 project forward and backward in the front and rear receptacles 152 and 153.

Engaging projections 155 project laterally out from the left and right surfaces of the male housing 150. The engaging projections 155 are arranged at intermediate positions of the male housing 150 in forward and backward directions, and the height positions of the engaging projections 155 are located at a vertically intermediate position of the female housing 150. The front surfaces of the engaging projections 155 are inclined moderately out from the front towards the rear so that the spring 140, while engageable surfaces 155A face rearward on the engaging projections 155.

The female connector F includes a female housing 110 made e.g. of synthetic resin and connectable with the male housing 150. The female housing 110 includes a terminal accommodating portion 111 that accommodates female terminals 134. An outer tube 112 surrounds the outer peripheral surface of the terminal accommodating portion 111.

The terminal accommodating portion 111 is a substantially rectangular column that can fit into the front receptacle 152 of the male housing 150 and has a wide cross section. Cavities 113 are formed substantially side by side in the terminal accommodating portion 111 and the female terminals 134 can be inserted into the cavities 113 from behind.

A connecting portion 114 unitarily connects the front end of the terminal accommodating portion 111 to the rear end of the outer tube 112, and the outer tube 112 extends forward from the connecting portion 114. A clearance is defined between the outer tube 112 and the rear end of the outer tube 112 for receiving the front receptacle 152 of the male housing 150. A seal ring 115 is fit on a rear part of the outer peripheral surface of the terminal accommodating portion 111. The seal ring 115 is dimensioned to be squeezed between the front receptacle 152 and the terminal accommodating portion 111 to provide sealing between the housings. An opening 112A is formed in the lower surface of the outer tube 112 to assemble a retainer 135 for retaining the female terminals 134 in the terminal accommodating portion 111.

Finger placing portions 116 project sideways from the opposite left and right surfaces near a rear end of the female housing 110. Fingertips can be placed on the finger placing portions 116 to pull the female housing 110 for separating the connectors F, M.

Standing walls 117 are provided on the upper surface of the outer tube 112 and extend in forward and backward directions. The standing walls 117 extend continuously from the rear end of the female housing 110 to a position near the front end. An unlocking arm 125 is provided between the standing walls 117.

A rear recess 118 is formed in a part of the upper surface of the outer tube 112 between the standing walls 117 and extends from an intermediate position in forward and backward directions to the rear edge. The depth of the rear recess 118 is increased gradually towards the back side.

First positioning walls 119 are provided on the opposite left and right surfaces of the outer tube 112. The first positioning walls 119 extend substantially circumferentially along the opposite side surfaces of the outer tube 112 from the front ends of the standing walls 117. A second positioning wall 121 is provided on the outer tube 112 before the first positioning walls 119. The second positioning wall 121 extends substantially circumferentially over the upper surface and the opposite side surfaces of the outer tube 112. The second positioning wall 121 and the first positioning walls 119 are substantially parallel to each other, and are spaced in forward and backward directions.

A front recess 122 is recessed in a widthwise intermediate position of the second positioning wall 121 and becomes gradually deeper from the opposite widthwise sides towards the center. The front recess 122 has a depth in an intermediate part of less than about ⅔, more preferably about half the thickness in forward and backward directions of the second positioning wall 121 (see FIG. 11).

A mounting portion 123 is defined on a part of the outer tube 112 between the first positioning walls 119 and the second positioning wall 121. The mounting portion 123 is formed by an inwardly recessed part of the outer peripheral surface of the outer tube 112 between the first positioning walls 119 and the second positioning wall 121.

Passages 133 are formed in the opposite left and right walls of the outer tube 112. Each passage 133 extends back from the front end of the outer tube 112 and communicates with the mounting portion 123.

Upper surfaces 124A and lower surfaces 124B of communicating portions 124 provide communication between the mounting portion 123 and the passages 133, and are inclined to approach each other from the mounting portion 123 side towards the inner side. A vertical dimension of the communicating portions 124 at the inner sides is substantially equal to a vertical dimension of the engaging projections 155 (see FIG. 13). The upper surfaces 124A of the communicating portions 124 are inclined from the mounting portion 123 towards the passages 133.

The connector also includes a substantially U-shaped spring 140 with two legs 141 connected at their top ends by an upper member 142. the legs 141 are resiliently displaceable towards and away from one another. The spring 140 can be mounted on the mounting portion 123 of the female housing 110 while the legs 141 extend substantially vertically down along a moving direction of the spring 140 with respect to the upper member 142.

Engaging portions 143 are defined at bottom ends of the legs 141 and are bent to have triangular shapes pointed inwardly and towards each other. These bent engaging portions 143 project into the passages 133 when the spring 140 is mounted. The engaging portions 143 include upper inclined sides 143A that incline towards each other and lower inclined sides 143B that incline away from one another. The lower inclined sides 143B have substantially the same inclinations as the lower surfaces 124B of the communicating portions 124, and the upper inclined sides 143A have substantially the same inclinations as the upper surfaces 124A of the communicating portions 124. Boundaries between the upper inclined sides 143A and the lower inclined sides 143B of the engaging portions 143 are rounded.

The spring 140 is so mounted for displacement between an inserted position IP (see FIG. 13) where the engaging portions 143 project into the passages 133 and a retracted position RP (see FIG. 14) where the engaging portions 143 are retracted from the passages 133. The engaging portions 143 project into the passages 133 when the spring 140 is at the inserted position IP and are pressed by the engaging projections 155 as the engaging projections 155 pass the passages 133. Thus, the legs 141 deform resiliently out. The legs 141 restore resiliently when the connectors F, M reach a properly connected state, so that the engaging portions 143 engage the engageable surfaces 155A to lock the male housing 150. The spring 140 can be displaced outwardly and away from the female housing 110 from the inserted position IP to the retracted position RP. The engaging portions 143 are retracted from the passages 133 when the spring 140 reaches the retracted position RP to cancel the locked state. The engaging portions 143 that are retracted from the passages 133 are at the outer sides of the upper surfaces 124A of the communicating portions 124. The heights of the first and second positioning walls 119, 122 are set to be located before and after the spring 140 over a displaceable range of the spring 140 between the inserted position IP and the retracted position RP.

An unlocking arm 125 extends in forward and backward directions between the standing walls 117 and is connected unitarily to the standing walls 117 by rotary shafts 126 so that the unlocking arm 125 is above the outer tube 112. The rotary shafts 126 extend slightly obliquely forward from the side surfaces of the unlocking arm 125 to the standing walls 117. The unlocking arm 125 extends substantially from the rear end of the female housing 110 to the front recess 122 of the second positioning wall 121 and the rotary shafts 126 are at a substantially lengthwise intermediate position of the unlocking arm 125 (see FIG. 11). The rotary shafts 126 permit resilient pivotable movement of the unlocking arm 125 like a seesaw about the rotary shafts 126. However, the unlocking arm 125 is substantially parallel to the upper surface of the outer tube 112 (see FIG. 8) when the unlocking arm 125 is in the natural state.

A pressing portion 127 is defined near the front end of the unlocking arm 125 and is below the spring 140. Thus, the pressing portion 127 presses the spring 140 up and away from the female housing 110 when the unlocking arm 125 is inclined. A front wall 128 projects up at the front end of the unlocking arm 125, and the pressing portion 127 is urged down by the front wall 128 as the spring 140 is moved up. The front wall 128 enters the front recess 122 of the second positioning wall 121, and the rear surfaces of the front wall 128 and the second positioning wall 121 are substantially flush when the unlocking arm 125 is in a natural state. The front wall 128 has a substantially mountain or converging shape that gradually narrows towards the upper end.

A hook 129 projects back from the upper end of the front wall 128 and aligns with a substantially widthwise central position of the upper member 142 of the spring 140. A projecting distance of the hook 129 preferably is less than about ⅔ of the spring 140, more preferably substantially equal to half the width of the spring 140 in forward and backward directions. A clearance is defined between the hook 129 and the pressing portion 127 and has a dimension substantially equal to the vertical width of the spring 140. Thus, the upper side member 142 of the spring 140 is held between the hook 129 and the pressing portion 127 with substantially no clearance defined in the vertical direction. The spring 140 is held between the first positioning walls 119, the front wall 128 and the second positioning wall 121 with substantially no clearance in forward and backward directions.

An unlocking portion 131 is at a rear end of the unlocking arm 125 and can be pressed down to displace the pressing portion 127 up. The unlocking portion 131 is wider than a front part of the unlocking arm 125 before the rotary shafts 126 (see FIG. 11), and a pressable slant 132 is inclined up towards the rear on the upper surface of the unlocking portion 131 (see FIG. 8). The lower surface of the unlocking portion 131 inclines up towards the rear so that the unlocking portion 131 is thinned vertically towards the rear. The inclination of the lower surface of the unlocking portion 131 and the rear recess 118 of the female housing 110 ensure sufficient downward displacement of the unlocking portion 131 without increasing the height of the female housing 110.

The spring 140 is at the inserted position IP when the unlocking arm 125 is in the natural undeflected state and the female housing 110 is locked with the female housing 150. This state of the unlocking arm 125 is called a lockable state. The pressing portion 127 presses the spring 140 up when the unlocking portion 131 is pressed down to incline the unlocking arm 125 and to displace the spring 140 to the retracted position RP for canceling the locked state with the male housing 150. This state of the unlocking arm 125 is called an unlocking state (see FIGS. 14 and 15).

The unlocking arm 125 is in the lockable state, and the spring 140 is at the inserted position IP prior to connecting the male and female connectors M and F. The female housing 110 then is gripped by fingers and pushed gradually into the male connector M while the passages 133 of the female housing 110 are positioned with respect to the engaging projections 155 of the male housing 150. Thus, the engaging projections 155 move forward in the passages 133 and the front surfaces of the engaging projections 155 contact the engaging portions 143 of the spring 140. The engaging portions 143 of the spring 140 move onto the engaging projections 155 as the engaging projections 155 move farther forward and the legs 141 displace resiliently out and away from each other. The hook 129 of the unlocking arm 125 is above the spring 140 and prevents the spring 140 from being lifted up as the legs 141 deflect.

The projecting end surfaces of the engaging projections 155 pass the spring 140 as the two connectors F, M reach the properly connected state and the legs 141 resiliently restore. Thus, the engaging portions 143 and the engageable surfaces 155A of the engaging projections 155 face each other in forward and backward directions to lock the two housings 110, 150 together. The seal ring 115 and the rubber plugs 136 for wires seal inner spaces of the two housings 110, 150 in the properly connected state of the two connectors F, M, and the male and female terminals 134, 151 are connected electrically.

The two connectors F, M may have to be separated. Therefore, fingertips are placed on the pressable slant 132 of the unlocking arm 125 in the lockable state to press the unlocking portion 131 down. The rotary shafts 126 rotate and function as supports so that the unlocking arm 125 is inclined and the pressing portion 127 presses the spring 140 up towards the retracted position RP. The engaging portions 143 are guided out along the inclinations of the upper surfaces 124A of the communicating portions 124 and the legs 141 are resiliently deformed away from each other. The engaging portions 143 are at the upper ends of the upper surfaces 124A of the communicating portions 124 and are retracted from the passages 133 when the unlocking arm 125 reaches the unlocking state. Thus, the engaging projections 155 are freed from the locked state and can move back. The fingers that had been placed on the finger placing portions 116 of the female housing 110 hold the female housing 110 from opposite sides and pull back to separate the two connectors F, M.

The spring 140 is displaced from the inserted position IP to the retracted position RP to cancel the locked state by pressing the unlocking portions 131. Thus, the spring 140 need not be operated directly by fingertips, and operability is good. Further, the unlocking portion 131 is at the rear end of the unlocking arm 125. Thus, the locked state can be canceled without any problem even if a male housing has a flange or the like projecting radially out at the front end. Therefore, labor and time is saved as compared with the case where unlocking requires a jig or the like as in the prior art.

The fingers that press the unlocking portion 131 can be moved away after separating the two connectors F, M. As a result, the unlocking arm 125 resiliently returns to release a force for displacing the spring 140 down and the resilient restoring forces of the legs 141 press the engaging portions 143 against the upper surfaces 124A of the communicating portions 124. The engaging portions 143 then are guided into the passages 133 by the inclinations of the upper surfaces 124A of the communicating portions 124 and, accordingly, the spring 140 is displaced from the retracted position RP to the inserted position IP. Thus, the spring 140 is set automatically to the inserted position IP merely by moving the fingertips away from the unlocking portion 131. Therefore, the spring 140 need not be set to the inserted position IP again upon reconnecting the two connectors F, M and labor required for locking the connectors F, M again in the connected state can be saved.

The pressing portion 127 is deflected towards the side towards which the spring 140 is pressed. Thus, the spring 140 will not separate from the unlocking arm 125 during the unlocking operation and the unlocking operation can be performed reliably.

The hook portion 129 of the unlocking arm 125 is arranged above the upper member 142 of the spring 140. Thus, the hook 129 prevents upward displacement and separation of the spring 140.

The pressing portion 127 of the unlocking arm 125 presses the widthwise central part of the spring 140 between the legs 141. Thus, the force for pressing the spring 140 acts in a well-balanced manner and the unlocking operation is performed efficiently.

The spring 140 is displaced from the inserted position IP to the retracted position RP by pressing the unlocking portion 131. Thus, the spring 140 need not be pressed directly by the fingertips to cancel the locked state.

A locking structure according to a further embodiment of the invention is illustrated in FIGS. 16 to 21. The locking structure of this embodiment differs from the previous embodiment in the shape of an unlocking arm 170. Elements with same construction as the previous embodiment are described again and merely are identified by the same reference numerals.

This locking structure locks female and male connectors F, M together by at least one spring 140 mounted on a female housing 110. Similar to the previous embodiment, the spring 140 is displaceable between an inserted position IP and a retracted position RP and reaches the retracted position RP by being displaced up and out from the inserted position IP.

The unlocking arm 170 is between two standing walls 117 provided on the upper surface of the female housing 110 and can be inclined like a seesaw. More particularly, the unlocking arm 170 is a substantially rectangular plate that is long in forward and backward directions and extends from the rear end of the female housing 110 to a front recess 122 of a second positioning wall 121, similar to the previous embodiment. Additionally, the unlocking arm 170 is arranged substantially at an intermediate position between the standing walls 117 and is connected to the standing walls 117 by supporting arms 171 provided at the opposite sides.

The supporting arms 171 are long and narrow in an extending direction of the unlocking arm 170 and are provided for supporting the unlocking arm 170 in a state lifted up from the female housing 110. The supporting arms extend substantially in forward and backward directions at intermediate positions between the unlocking arm 170 and the standing walls 117. Substantially uniform clearances are defined at the opposite sides of each supporting arm 171. Front end portions of the supporting arms 171 are connected with front parts of the standing walls 117 at positions near the first positioning walls 119, and rear end portions of the standing portions 117 are connected with a rear part of the unlocking arm 170 near the unlocking portion 131. Rotary shafts 172 are defined near front ends of the supporting arms 171 and the standing walls 117 and rotate when the unlocking arm 170 is inclined.

Similar to the previous embodiment, a pressing portion 127 is defined near a front end of the unlocking arm 170 for pressing the spring 140 up and out away from the female housing 110 when the unlocking arm 170 is inclined. A front wall 128 and a hook 129 are provided near the front end of the pressing portion 127. An unlocking portion 131 is provided at the rear end of the unlocking arm 170 and can be pressed down to displace the pressing portion 127 up. A pressable slant 132 is formed on the upper surface of the unlocking portion 131 and the lower surface of the unlocking portion 131 is inclined up and out towards the rear end.

Two supports 173 project up from a part of the upper surface of the outer tube 112 between the standing walls 117. The supports 173 are directly below a longitudinal central position of the unlocking arm 170 and before a rear recess 118. Additionally, the supports 173 are spaced apart in the width direction of the unlocking arm 170 and have a mountain-shaped cross section so that the projecting distance gradually increases from the front and rear ends. The projecting distances of the supports 173 are set so that the projecting ends are distanced down from the lower surface of the unlocking arm 170 when the unlocking arm 170 is in a natural or locking state parallel to the upper surface of the outer tube 112. However, the supports 173 contact the unlocking arm 170 when the unlocking portion 131 is pressed down to incline the unlocking arm 170 into an unlocking state. Thus, the supports 173 support and limit an inclining movement of the unlocking arm 170

An operation of locking the male connector M and the female connector F in a properly connected state is performed similar to the previous embodiment. More particularly, fingertips are placed on the pressable slant 132 of the unlocking arm 170 in the unlocking state to displace the unlocking portion 131 down. The rotary shafts 172 rotate to incline the supporting arms 171 and to bring the rear ends of the supporting arms 171 down. The entire unlocking arm 170 is displaced down towards the outer tube 112 as the supporting arms 171 are inclined, and the lower surface of the unlocking arm 170 contact the supports 173. The unlocking portion 131 can be pressed further to incline the unlocking arm 170 about the supports 173. As a result, the pressing portion 127 presses the spring 140 up to cancel the locked state, similar to the previous embodiment. The female housing 110 can be pulled back to separate the two connectors F, M after the locked state is canceled.

As described above, the locked state is canceled by pressing the unlocking portion 131 similar to the previous embodiment. Therefore the unlocking operation can be performed easily.

This unlocking arm 170 inclines like a seesaw with the supports 173 provided separately from the rotary shafts 172. The supports 173 function as the supporting points for the inclining movement of the unlocking arm 170 and have strength for sustaining the force for pressing the pressing portion 127 up and for displacing the spring up towards the retracted position RP. The rotary shafts would have to be enlarged to have sufficient strength if the rotary shafts doubled as the supports. The rigidities of the rotary shafts then would have to be increased and a correspondingly larger force would be required for pressing the unlocking portion. However, the rigidities of the rotary shafts 172 can be reduced by separately providing the supports 173 in addition to the connecting rotary shafts 172. Thus, the force required to press the unlocking portion 131 can be reduced, and the unlocking operation can be performed easily.

The invention is not limited to the above described and illustrated embodiments. For example, the following modifications are also embraced by the technical scope of the present invention.

Although the invention is applied to the locking structure of the connector device in the above embodiments, it can be applied to a locking structure for a pair of any members connectable with each other without being limited to the above.

The unlocking arm 125 is made inclinable like a seesaw by the rotatable connecting rotary shafts 126. However, the unlocking arm may be in any mode that is inclinable like a seesaw. For example, a supporting leg standing up from the upper surface of the female housing may be provided and the unlocking arm may be inclined with this supporting leg as a support.

The supports 173 are provided on the outer tube 112. However, the supports may be provided on the unlocking arm and may function as supporting points by contacting the outer tube when the unlocking portion is pressed to displace the unlocking arm down.

A further embodiment of the invention is illustrated in FIGS. 22 to 32. In this embodiment, a locking structure locks female and male connectors F, M that have been connected properly with each other. Ends of the two connectors F, M to be connected are referred to herein as front ends and reference is made to FIG. 22 concerning upper and lower sides.

The male connector M is connected directly with a device, such as an automotive junction box, an instrument panel or the like. The male connector M has a male housing 250 with a front receptacle 252A that projects forward from an outer wall 251 of the device and a rear receptacle 252B that projects backward. The two receptacles 252A, 252B are substantially rectangular tubes. The front receptacle 252A has an open front end and the rear receptacle 252B having an open rear end. Male terminals 254 penetrate a back wall 253 between the front and rear receptacles 252A and 252B of the male housing 250. Front and rear parts of the male terminals 254 project respectively forward and backward in the front and rear receptacles 252A and 252B. The outer wall 251 of the device projects from the outer peripheral surface of the female housing 210 over substantially the entire periphery.

Engaging projections 255 project laterally from the left and right surfaces of the male housing 250. The engaging projections 255 are at intermediate positions of the male housing 250 in forward and backward directions, and are at substantially the vertical center of the female housing 250. Front surfaces of the engaging projections 255 are inclined moderately up from the front towards the rear and engaging surfaces 255A are defined at the rear ends of the engaging projections 255.

The female connector F includes a female housing 210 made e.g. of synthetic resin and connectable with the male housing 250. The female housing 210 includes a terminal accommodating portion 212 for accommodating female terminals 211 and an outer tube 213 surrounding the outer peripheral surface of the terminal accommodating portion 212.

The terminal accommodating portion 212 is a substantially rectangular column that can fit into the front receptacle 252A of the male housing 250 and has a slightly vertically longer cross section. Cavities 214 are formed in the terminal accommodating portion 212 and the female terminals 211 are insertable into the cavities 214 from behind.

The outer tube 213 extends substantially from the rear end to the front end of the terminal accommodating portion 212, and a connecting portion 215 unitarily joins the rear end of the outer tube 213 to the rear end of the terminal accommodating portion 212.

A clearance is defined between the outer tube 213 and the terminal accommodating portion 212 for receiving the front receptacle 252A of the male housing 250. A seal ring 216 is mounted in a rear position on the terminal accommodating portion 212 and is squeezed between the front receptacle 252A of the male housing 250 and the terminal accommodating portion 212 of the female housing 210 to provide sealing.

A finger placing portion 217 projects out at a rear end of the female housing 210. Fingers can be placed on the finger placing portion 217 to pull the female housing 210 out for separating the connectors F, M.

Standing walls 218 are provided on the upper surface of the outer tube 213 and extend in forward and backward directions. Guides 219 are provided on the opposed facing inner side surfaces of the standing walls 218. The guides 219 preferably are substantially flat plates that project substantially perpendicularly from the inner side surfaces of the standing walls 218 (see FIG. 24). The guides 219 are provided at vertical intermediate positions of the standing walls 218 and extend substantially continuously in forward and backward directions along the standing walls 218.

A long narrow rectangular engaging window 221 is formed at an intermediate position of each guide 219 in forward and backward directions. The engaging window 221 is at a position on the respective guide 219 near the standing wall 218 and penetrates the guides 219 vertically.

Figure 22:
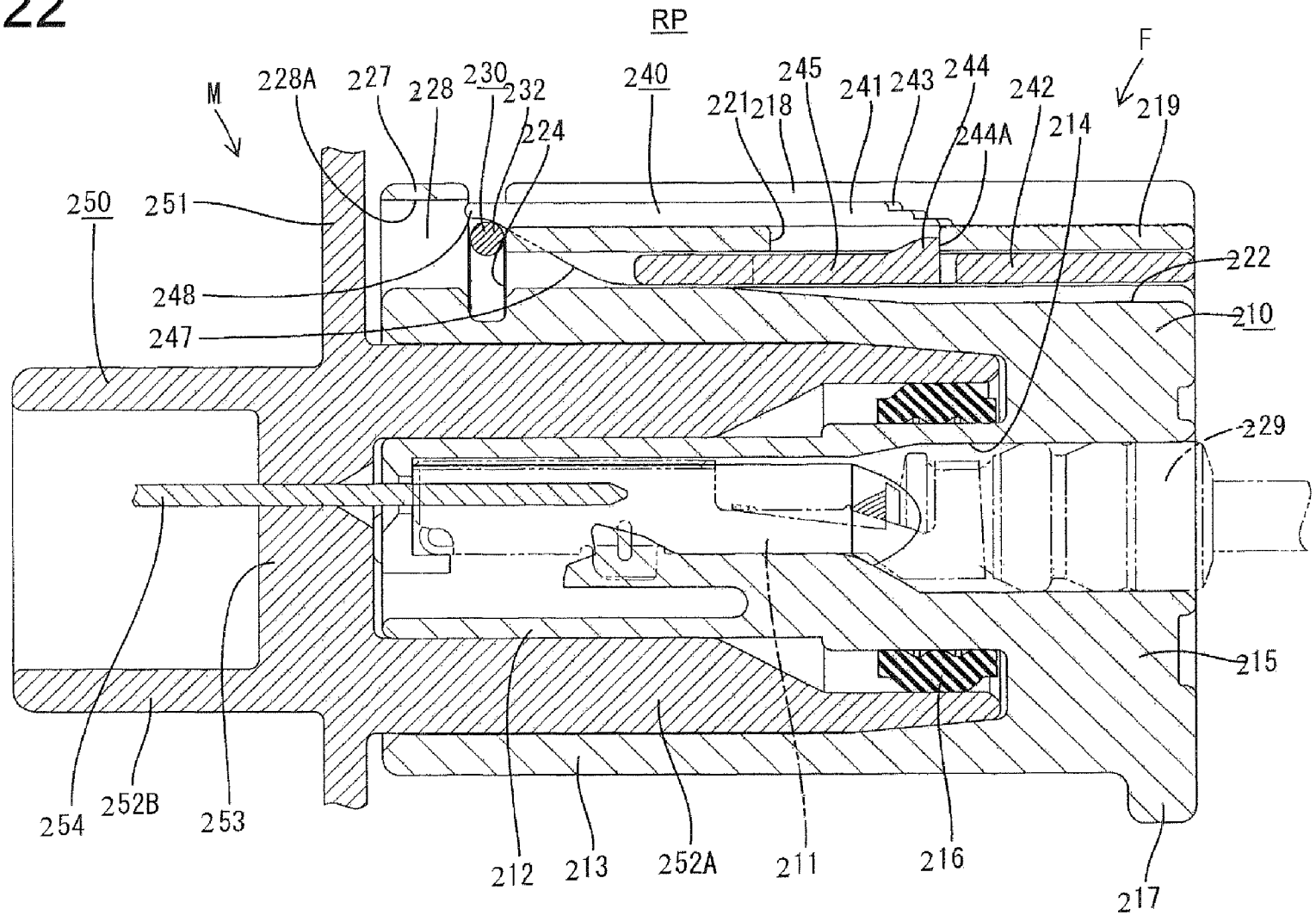
FIG. 22 is a longitudinal section showing a state where two connectors are locked by a locking structure according to a first embodiment.
Figure 23:
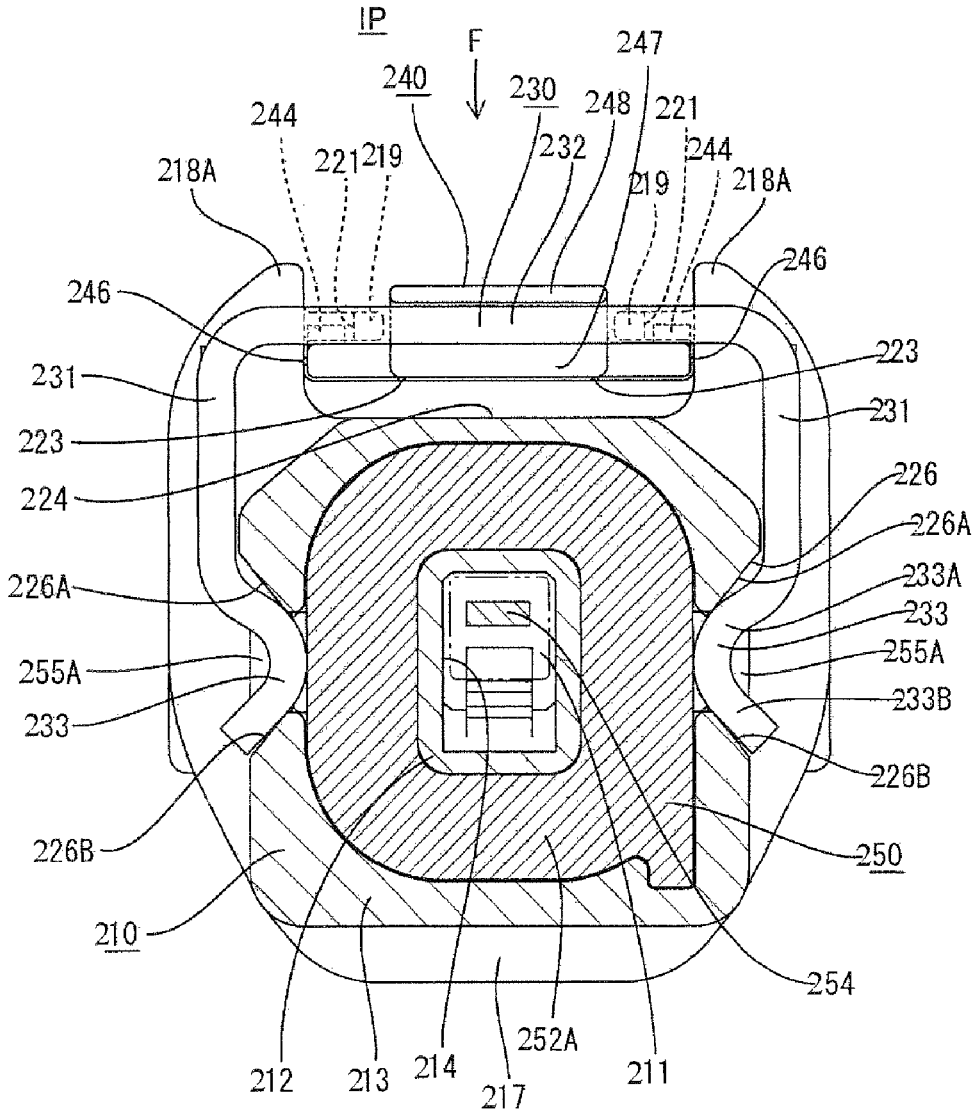
FIG. 23 is a lateral section showing the state of FIG. 22.
Figure 24:
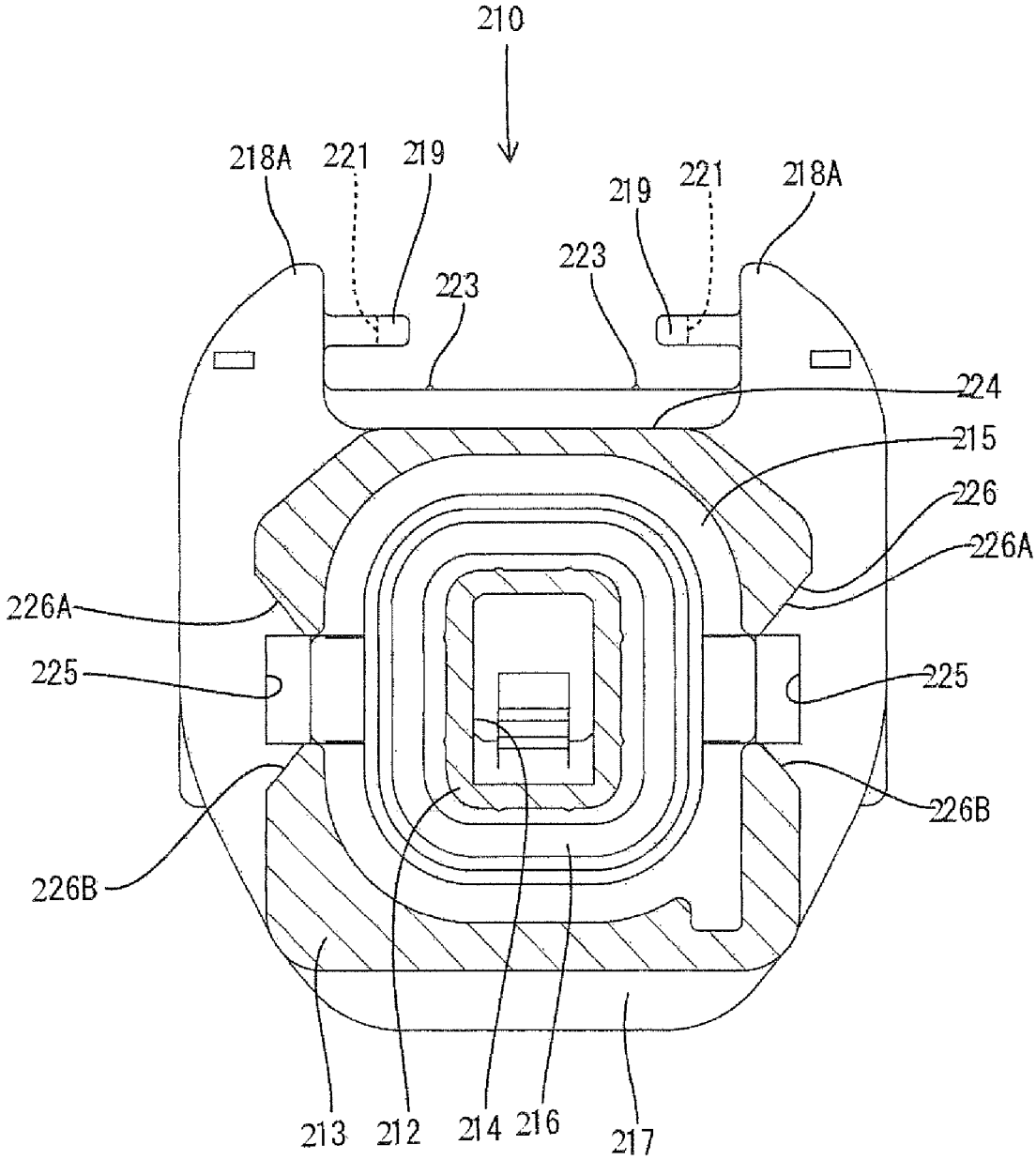
FIG. 24 is a lateral section of a female housing.
Figure 25:
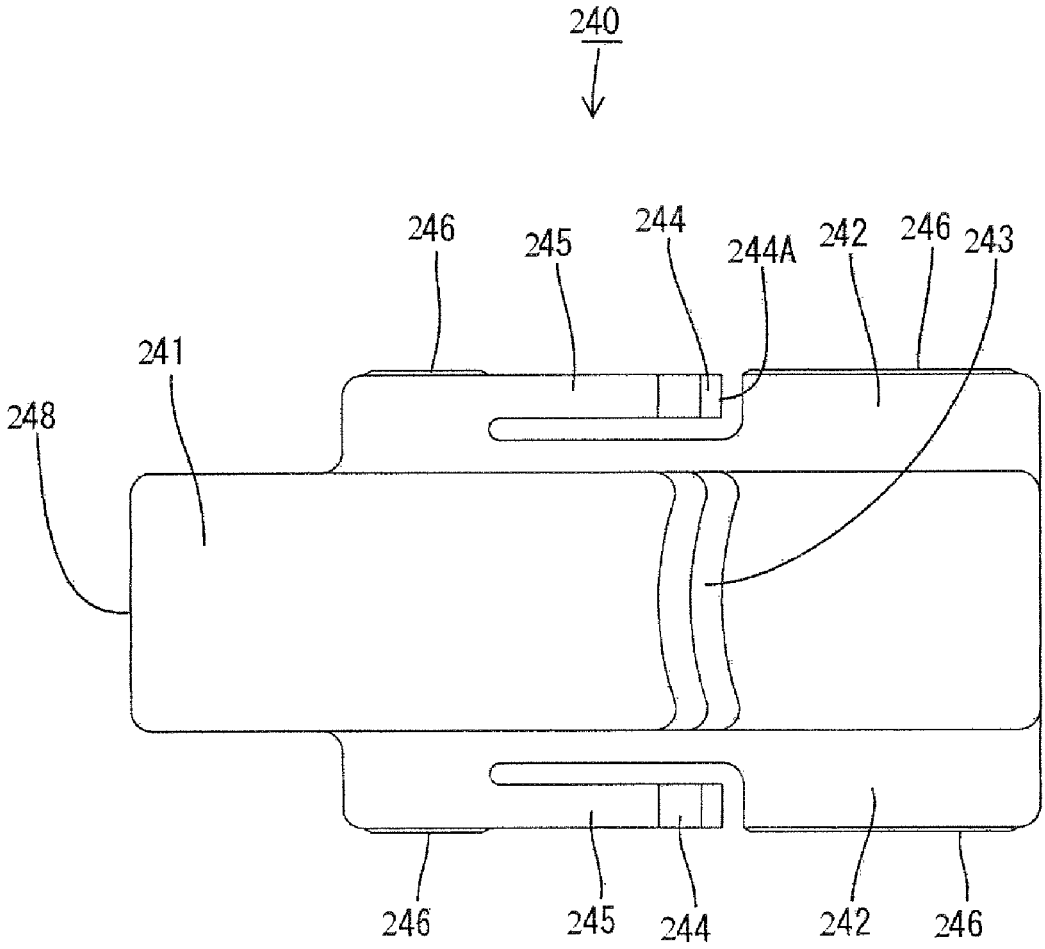
FIG. 25 is a plan view of a slider.
Figure 26:
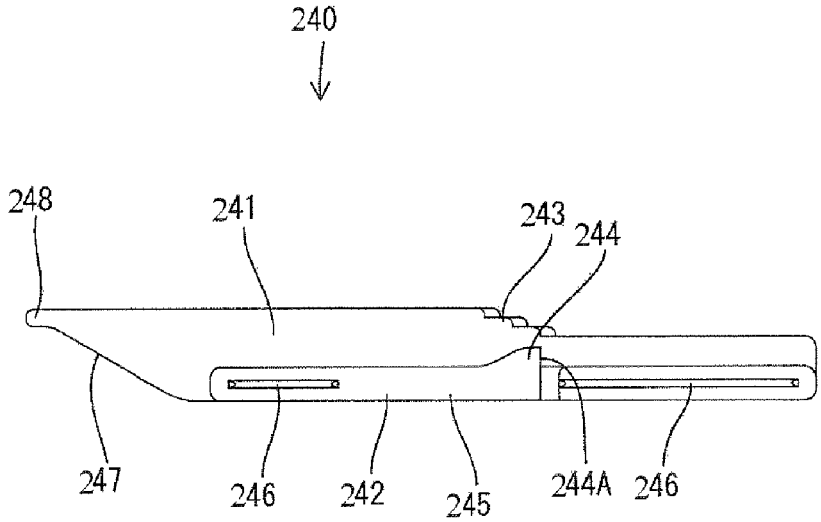
FIG. 26 is a side view of the slider.

Escaping recesses 222 are formed in parts of the upper surface of the outer tube 213 substantially facing the guides 219 (see FIG. 22). The escaping recesses 222 extend from the rear edge of the female housing 210 to positions slightly before the front edges of the engaging windows 221. The depth of each escaping recess 222 is reduced gradually from a part facing the engaging window 221 towards the front. Backlash preventing ribs 223 are provided on a part of the upper surface of the outer tube 213 between the standing walls 218 and extend in substantially forward and backward directions (see FIG. 24).

First positioning walls 218A are provided on the left and right surfaces of the outer tube 213 and extend circumferentially along the opposite side surfaces of the outer tube 213 from the front ends of the standing walls 218. A second positioning wall 228 extends circumferentially on the outer tube 213 before the first positioning walls 218A. The second positioning wall 228 and the first positioning walls 218A are substantially parallel to each other and are spaced apart in forward and backward directions.

A wide rectangular insertion hole 228A penetrates a widthwise central part of the second positioning wall 228 in forward and backward directions (see FIG. 28) and a lift-preventing portion 227 is defined at an upper edge of the second positioning wall 228 above the insertion hole 228A.

An inwardly recessed mounting portion 224 is defined on a part of the outer tube 213 between the first positioning walls 218A and the second positioning wall 228.

Passages 225 are formed in the opposite left and right walls of the outer tube 213 and receive the engaging projections 255 of the male housing 250. Each passage 225 extends back from the front end of the outer tube 213 and communicates with the mounting portion 224.

Upper and lower surfaces 226A and 226B of communicating portions 226 between the mounting portion 224 and the passages 225 are inclined to approach each other from the outer side towards the inner side. A vertical dimension of the communicating portions 226 at the inner sides is substantially equal to the vertical dimension of the engaging projections 255 (see FIG. 23).

A spring 230 is mounted on the mounting portion 224. The spring 230 has a substantially U-shape with an open bottom. Two legs 231 extend vertically down from opposite ends of an upper member 232 and are resiliently displaceable in directions substantially facing each other.

Bottom parts of the legs 231 are bent to have converging triangular engaging portions 233 that project into the passages 225. The engaging portions 233 include upper inclined sides 233A that incline in towards each other and lower inclined sides 233B. The engaging portions 233 have smaller extensions in a vertical direction towards the inner side. Projecting ends between the upper and lower inclined sides 233A and 233B of the engaging portions 233 are rounded.

The spring 230 is displaceable between an inserted position IP (see FIG. 23) where the engaging portions 233 project into the passages 225 and a retracted position RP (see FIG. 22) where the engaging portions 233 are retracted from the passages 225. The engaging portions 233 project into the passages 225 when the spring 230 is at the inserted position IP and are pressed by the engaging projections 255 passing the passages 225 deform the legs 231 outwardly. The legs 231 resiliently restore when the housings 210, 250 reach a properly connected state. As a result, engage the engaging portions 233 engage the respective engaging surfaces 255A to lock the male housing 250. The spring 230 reaches the retracted position RP by being displaced down from the inserted position IP towards the female housing 210. The engaging portions 233 are retracted from the passages 225 when the spring 230 reaches the retracted position RP and are at the outer sides of the lower surfaces 226B of the communicating portions 226 to cancel the locked state.

A slider 240 is assembled with the female housing 210 and is slidable in forward and backward directions along the connecting direction with the male housing 250. The slider 240 has a main body 241 that is long in forward and backward directions and guiding ribs 242 are provided on the opposite sides of the main body 241 (see FIG. 25).

The main body 241 is a substantially rectangular plate and has a length substantially equal to a distance from the rear end of the female housing 210 to the rear end of the lift preventing portion 227. A finger contact portion 243 is provided substantially in a central part of the main body 241 in forward and backward directions and defines steps that climb up towards the front. The slider 240 can be slid easily using this finger contact portion 243 (see FIG. 26).

The guiding ribs 242 are thin plates that project laterally from lower parts of the side surfaces of the main body 241 and extend from the rear of the main body 241 towards or to front. The guiding ribs 242 are inserted into clearances between the outer tube 213 of the female housing 210 and the guides 219 and are slidable in forward and backward directions to prevent a lift of the slider 240 from the female housing 210.

A projection 244 projects up and out at a substantially central position of the guiding rib 242 in forward and backward directions. The projection 244 is shaped to fit into the engaging window 221 and is slidable in forward and backward directions therein. The front surface of each projection 244 is inclined to project gradually more toward the rear and a restricting surface 244A is defined at the rear of each projection 244 for engaging the rear edge of the engaging window 221 to prevent the slider 240 from being detached backward. The projection 244 is provided at the rear end of an engaging piece 245 that is cantilevered backward along the side edge of the guiding rib 242. The slider 240 is assembled with the female housing 210 from behind and resiliently deforms the engaging pieces 245 down and in towards the escaping recesses 222 of the female housing 210.

Backlash preventing ribs 246 are provided on the side surfaces of the both guiding ribs 242 before and after the engaging pieces 245 and extend in forward and backward directions. The backlash preventing ribs 246 and the backlash preventing ribs 223 of the outer tube 213 prevent backlash between the slider 240 and the female housing 210.

Figure 27:
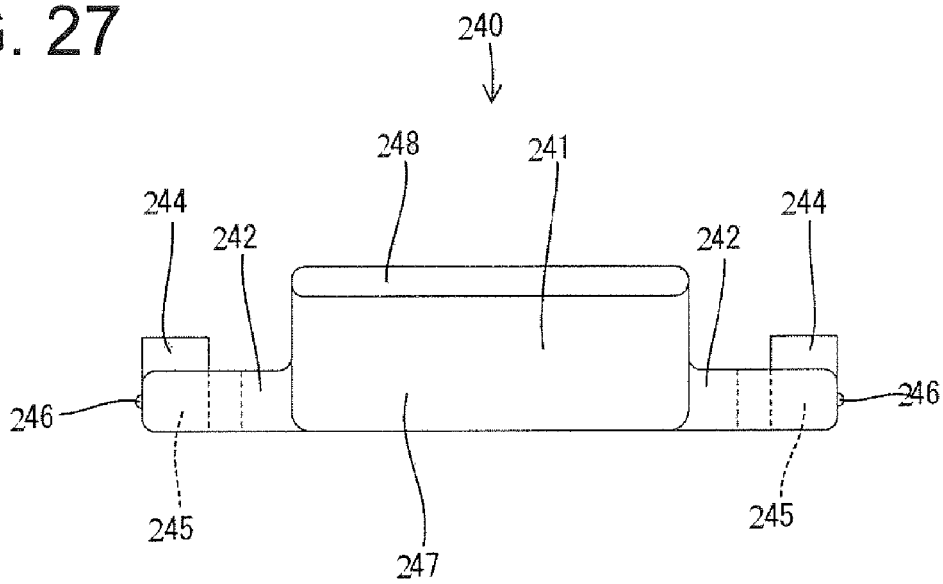
FIG. 27 is a front view of the slider.
Figure 28:
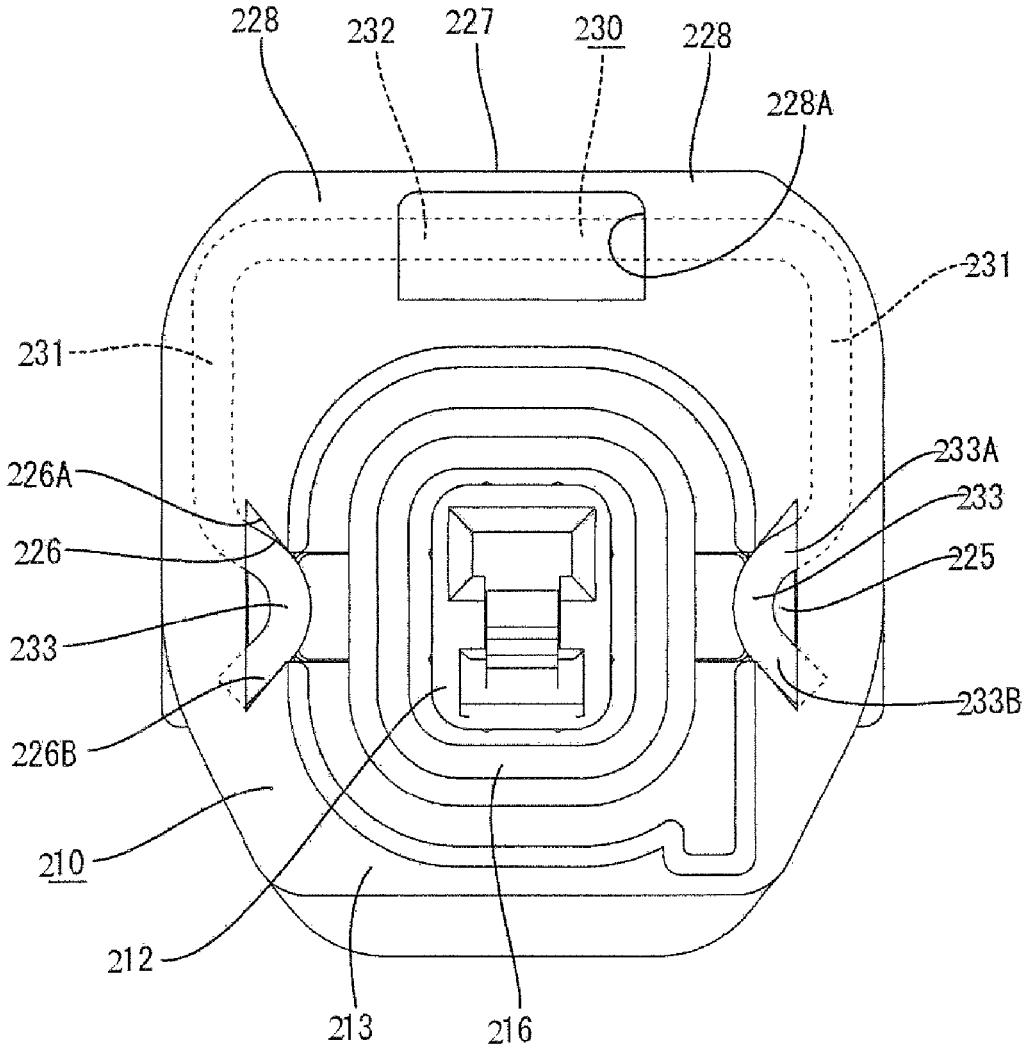
FIG. 28 is a front view of the female housing having a spring mounted thereon.
Figure 29:
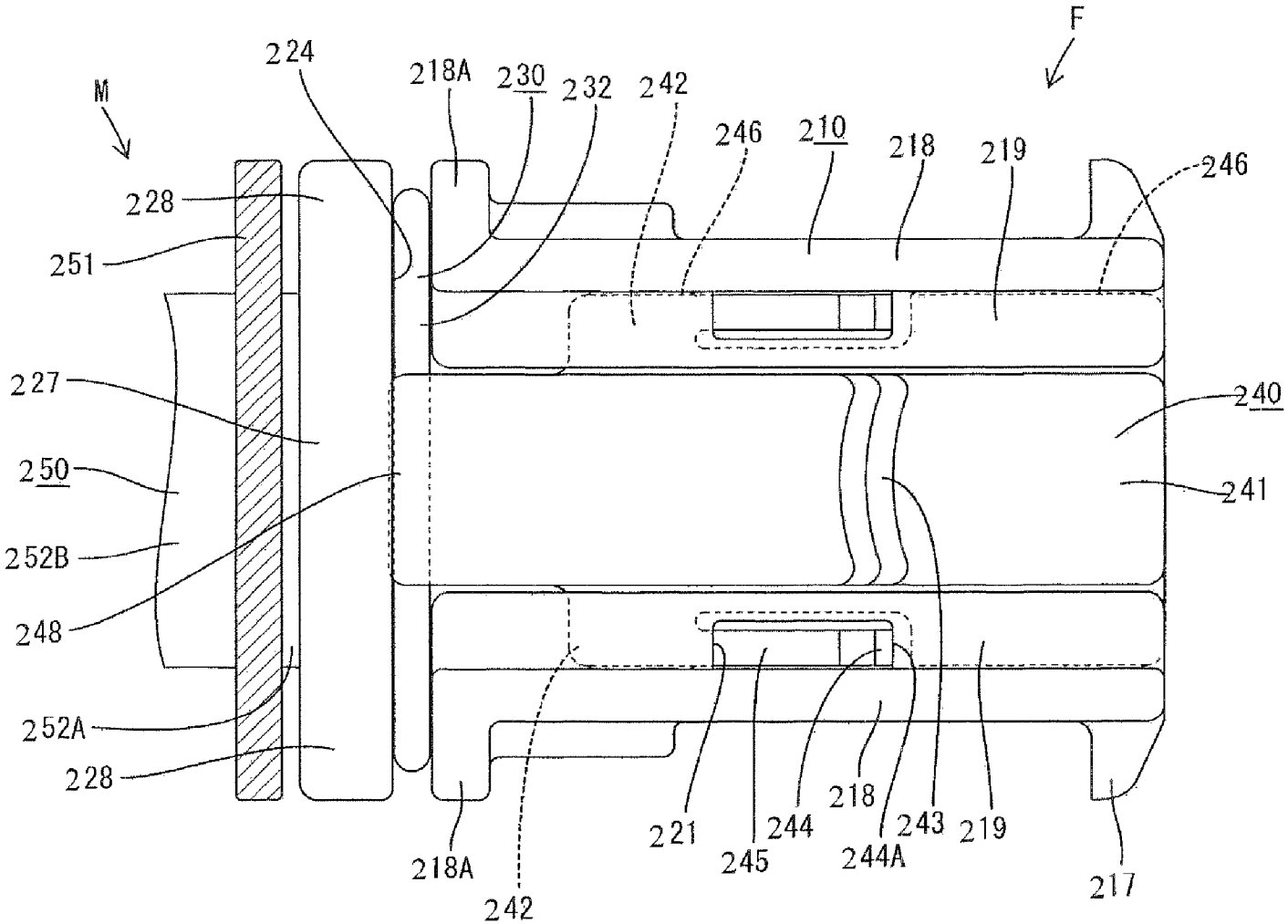
FIG. 29 is a plan view in section of the pair of connectors when the slider is at a lockable position.
Figure 30:
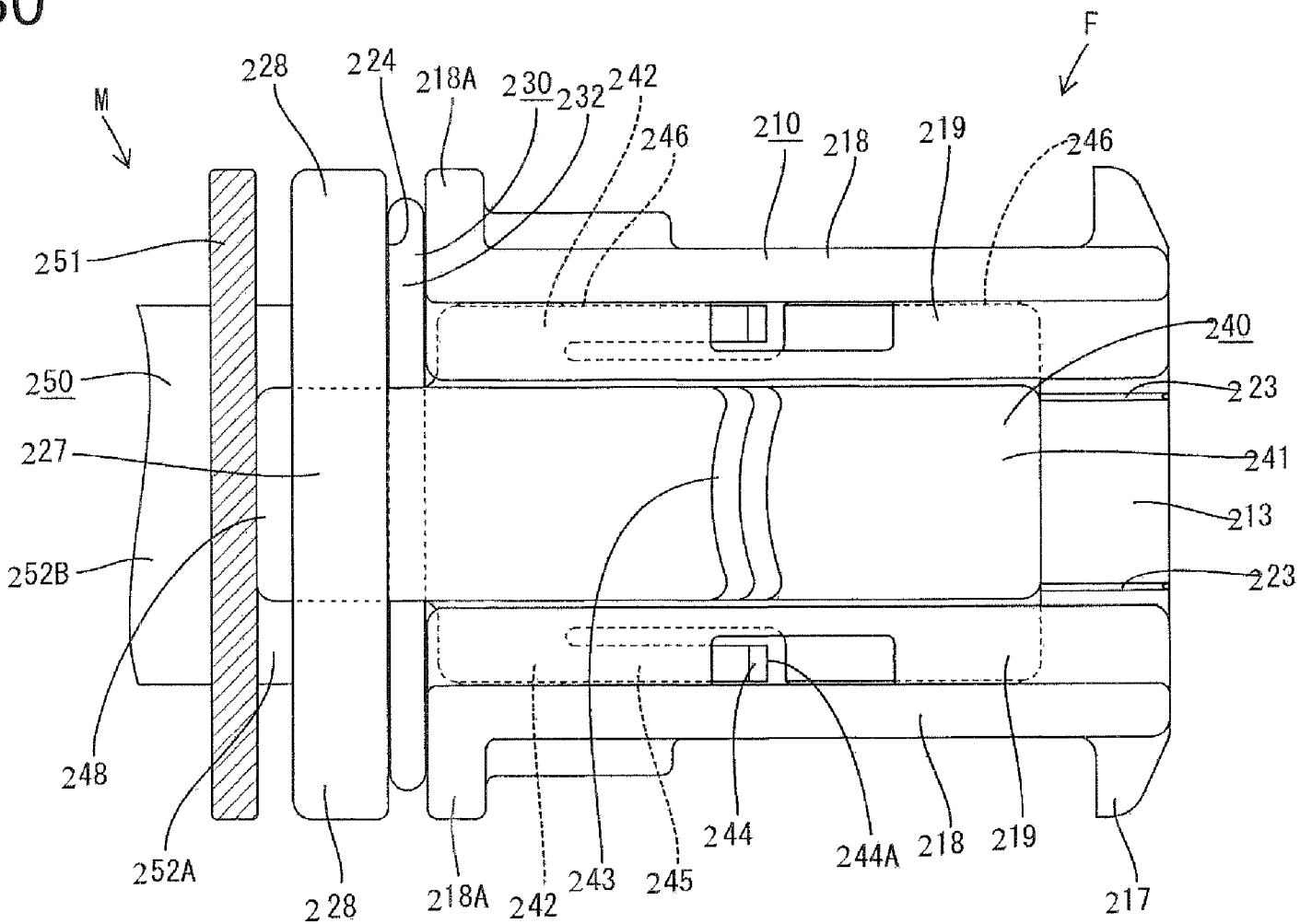
FIG. 30 is a plan view in section of the pair of connectors when the slider is at an unlocking position.
Figure 31:
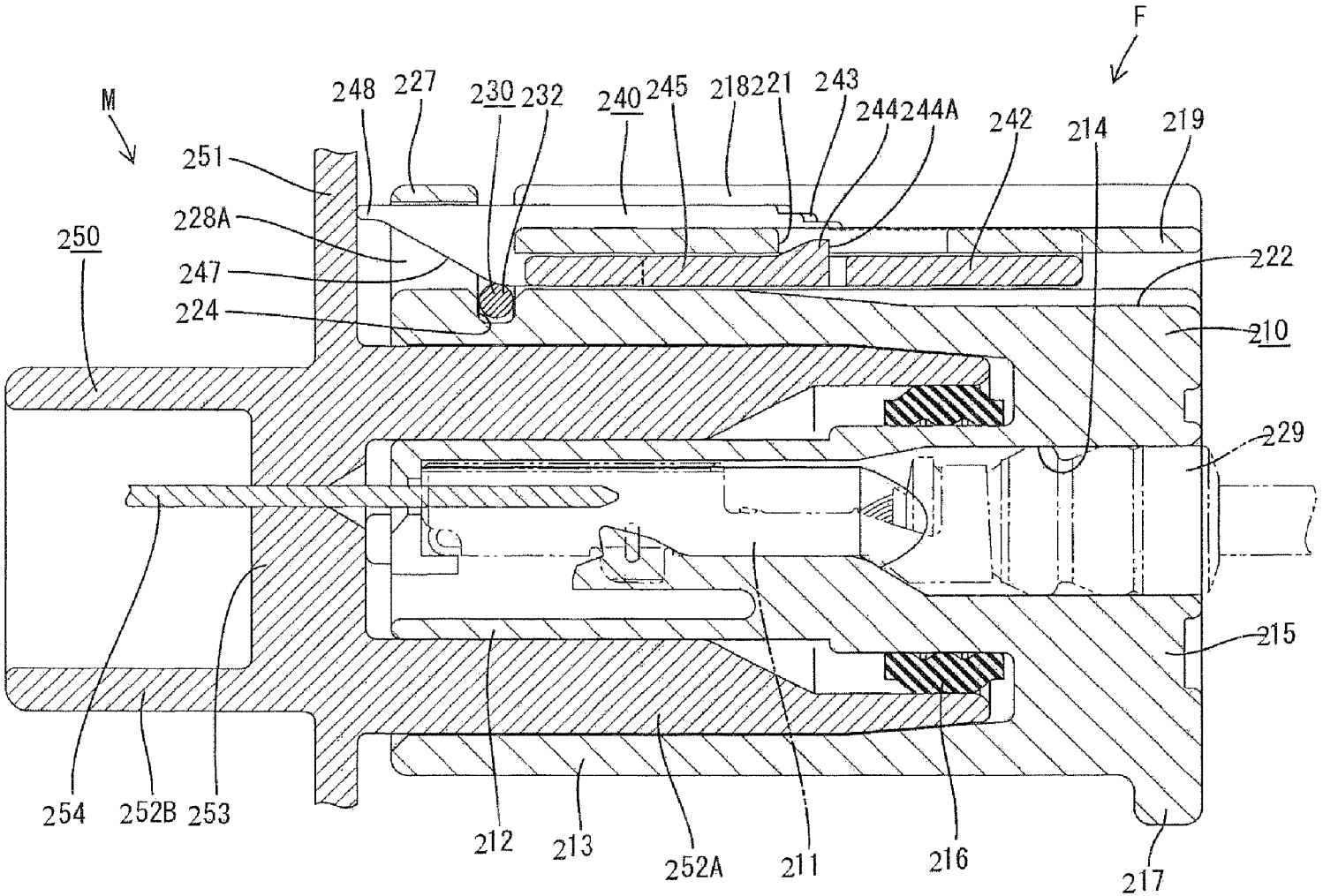
FIG. 31 is a longitudinal section showing a state where a locked state of the pair of connectors is canceled.
Figure 32:
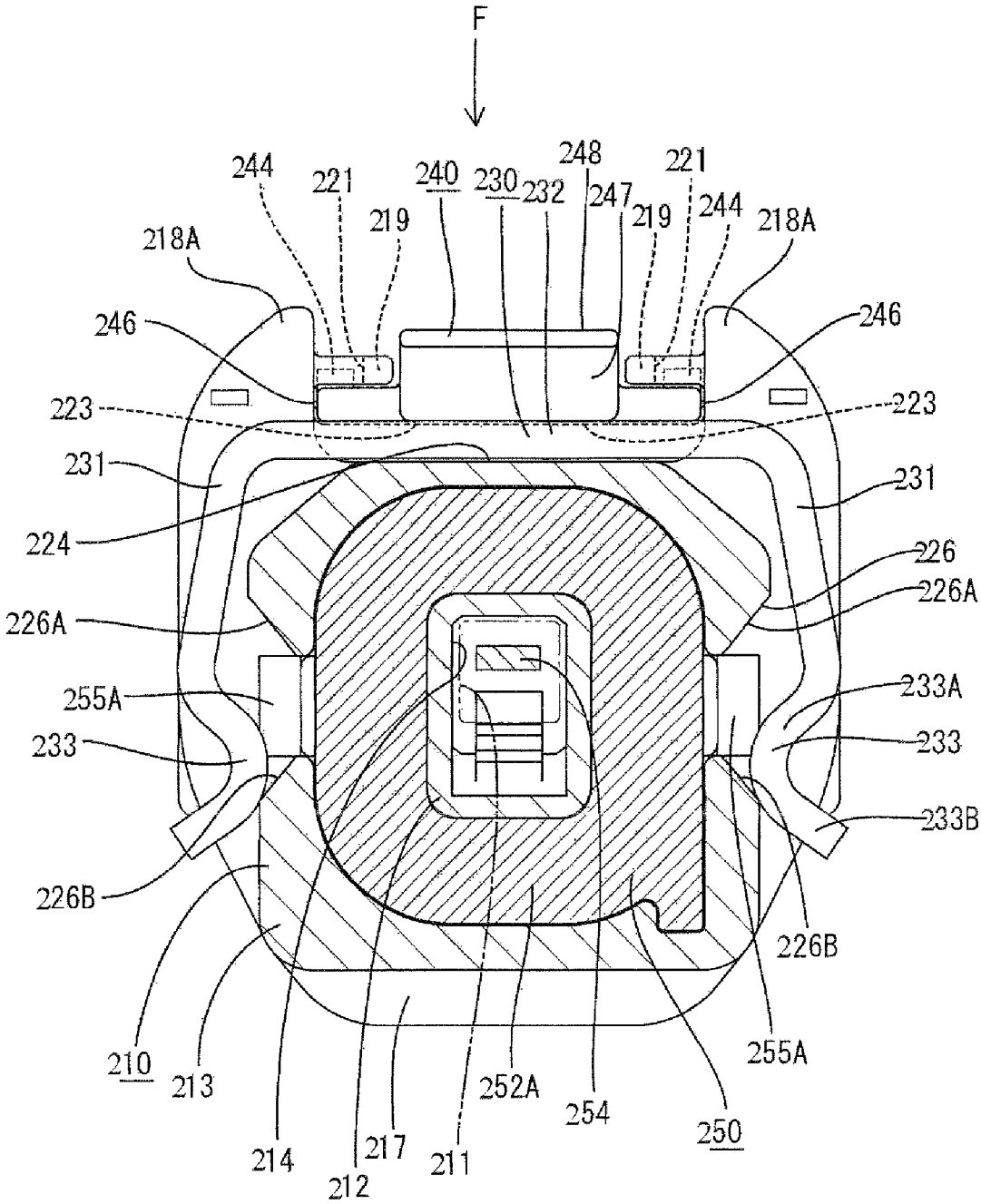
FIG. 32 is a lateral section showing the state of FIG. 31.
Figure 33:
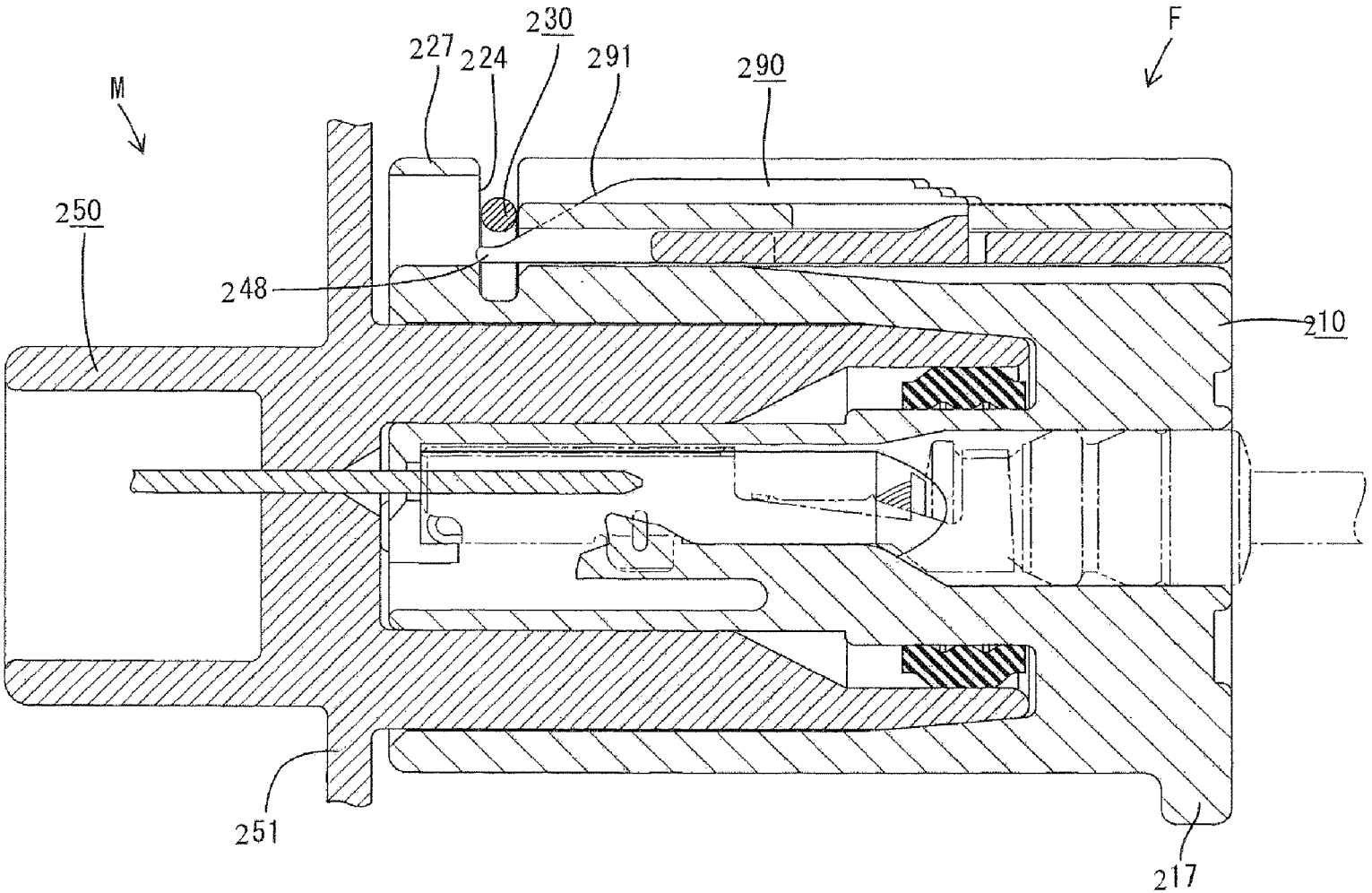
FIG. 33 is a longitudinal section showing a state where two connectors are locked by a locking structure according to a second embodiment.
Figure 34:
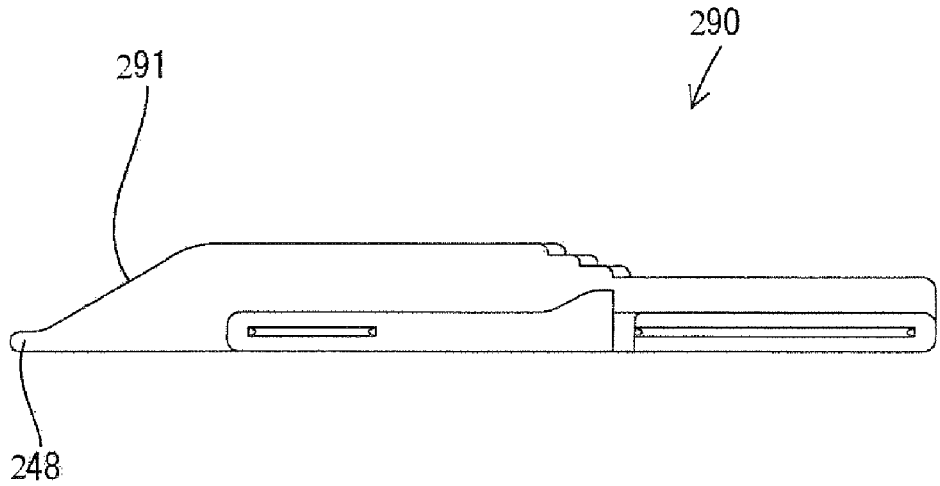
FIG. 34 is a side view of a slider.
Figure 35:
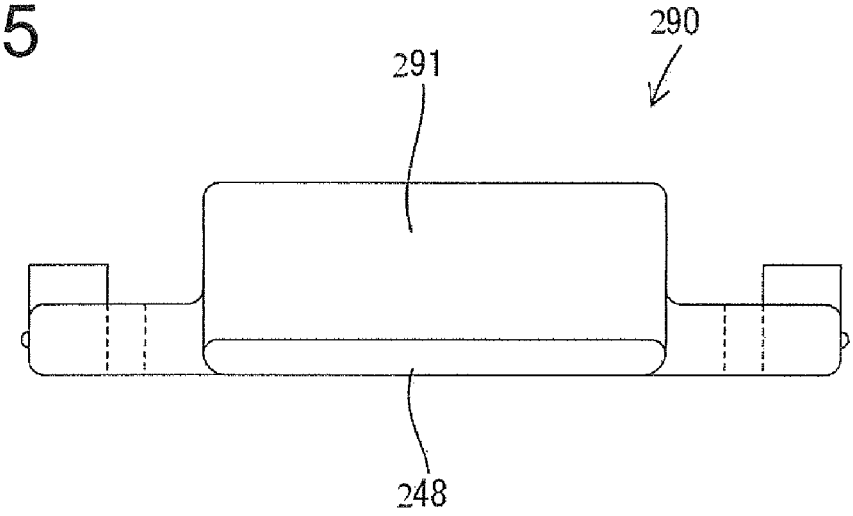
FIG. 35 is a front view of the slider.
Figure 36:
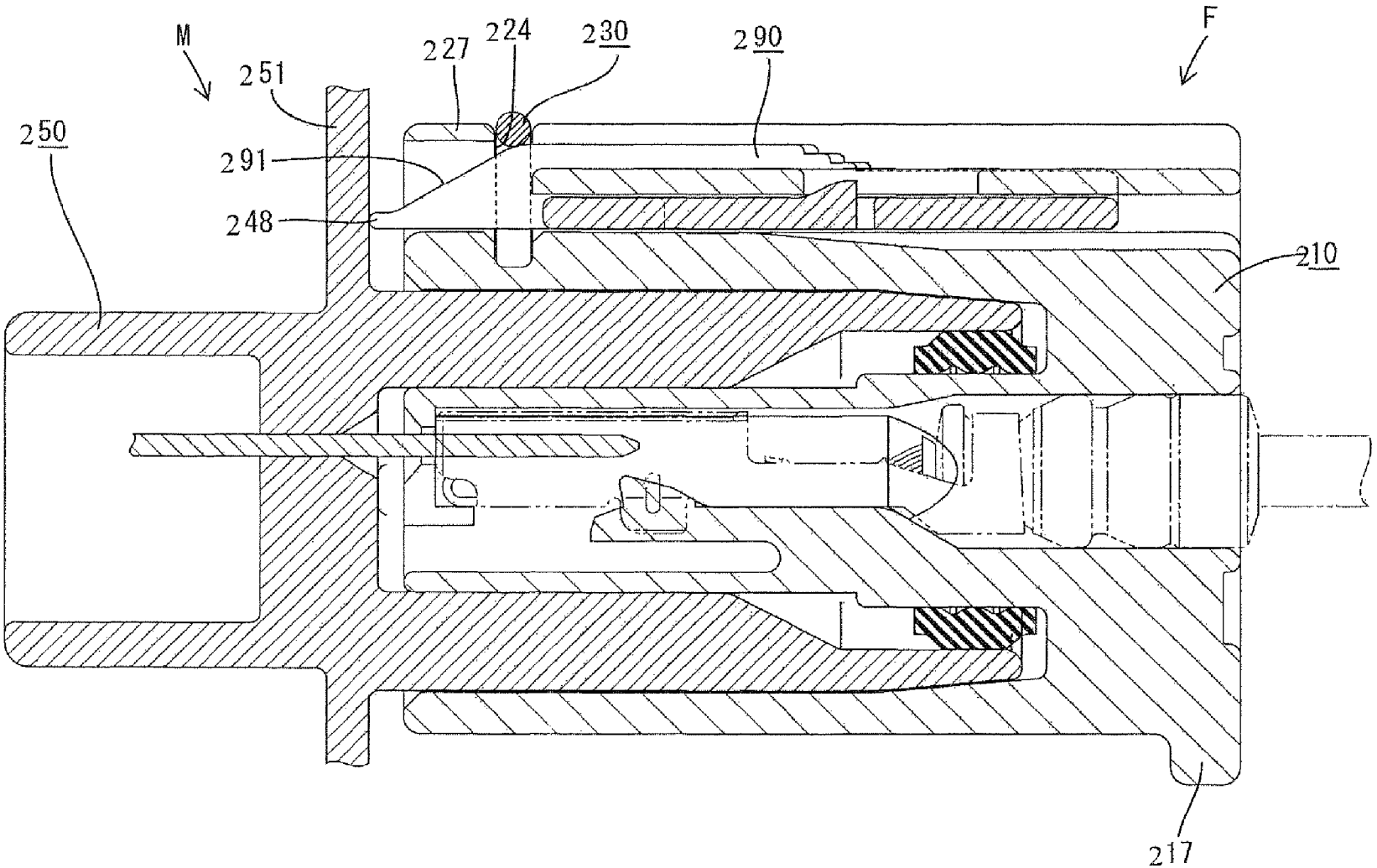
FIG. 36 is a longitudinal section showing a state where a locked state of the pair of connectors is canceled.
Figure 37:
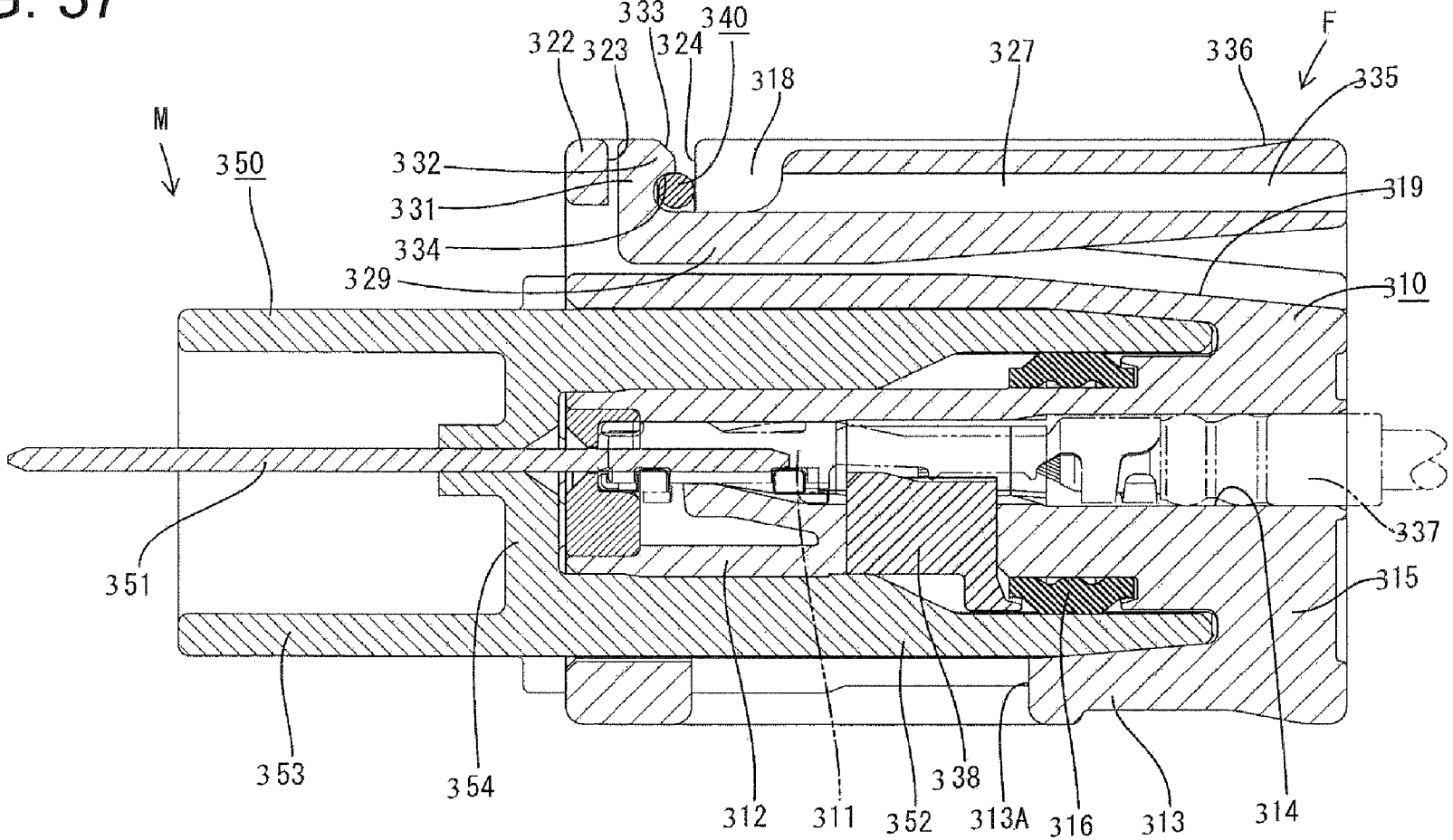
FIG. 37 is a longitudinal section showing a state where a connector assembly according to one further embodiment is locked in a properly connected state.
Figure 38:
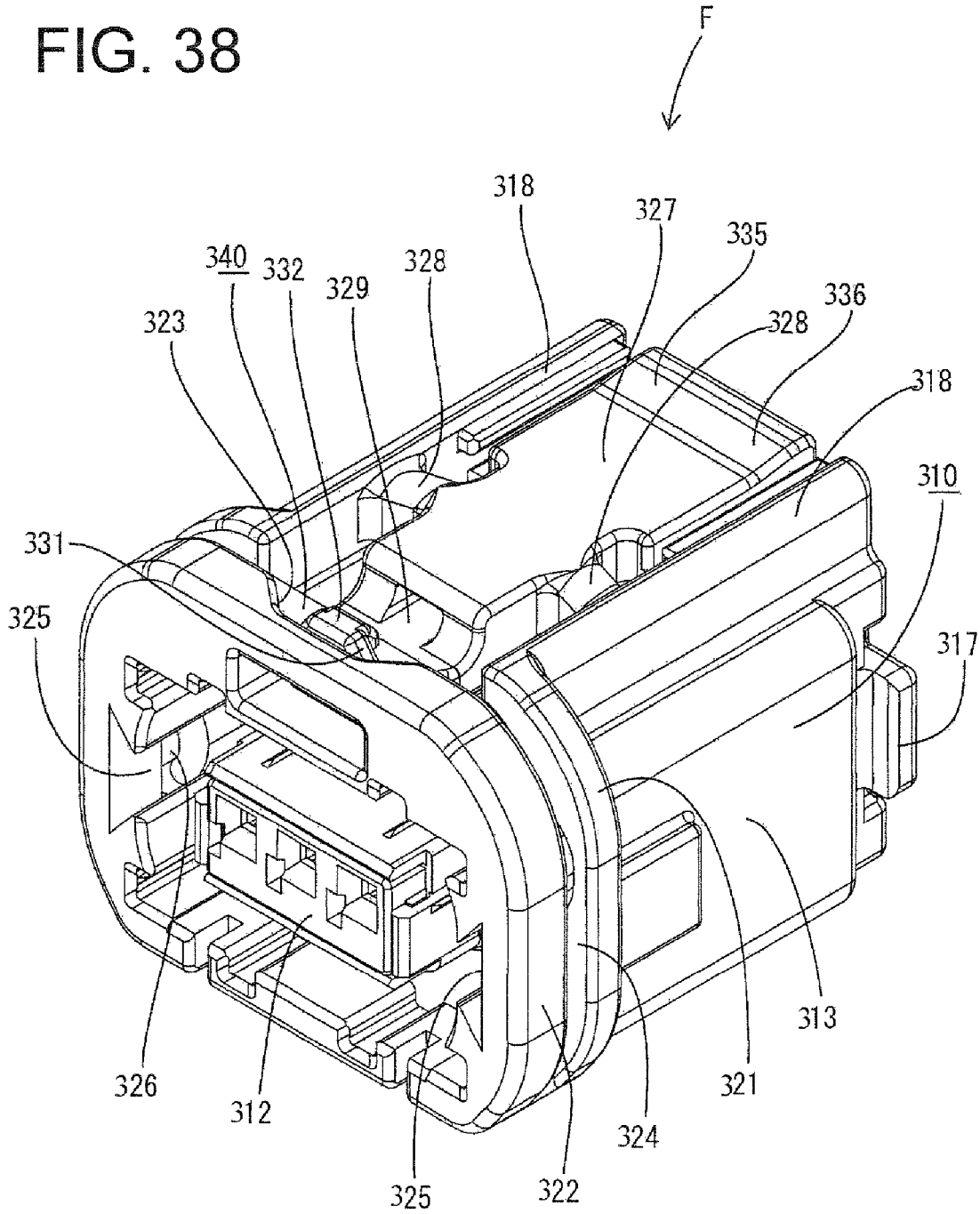
FIG. 38 is an external perspective view of a female connector.
Figure 39:
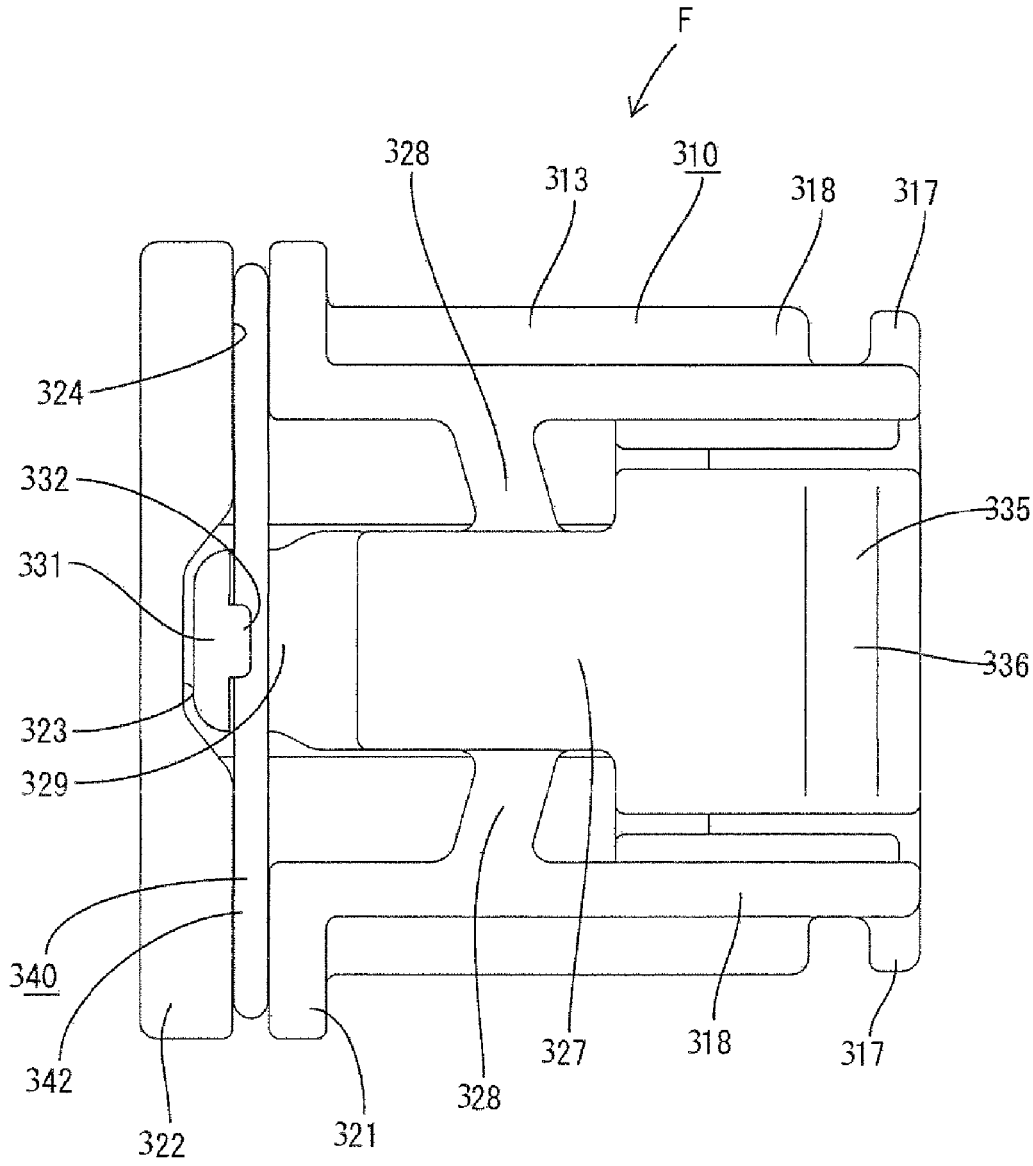
FIG. 39 is a plan view of the female connector.
Figure 40:
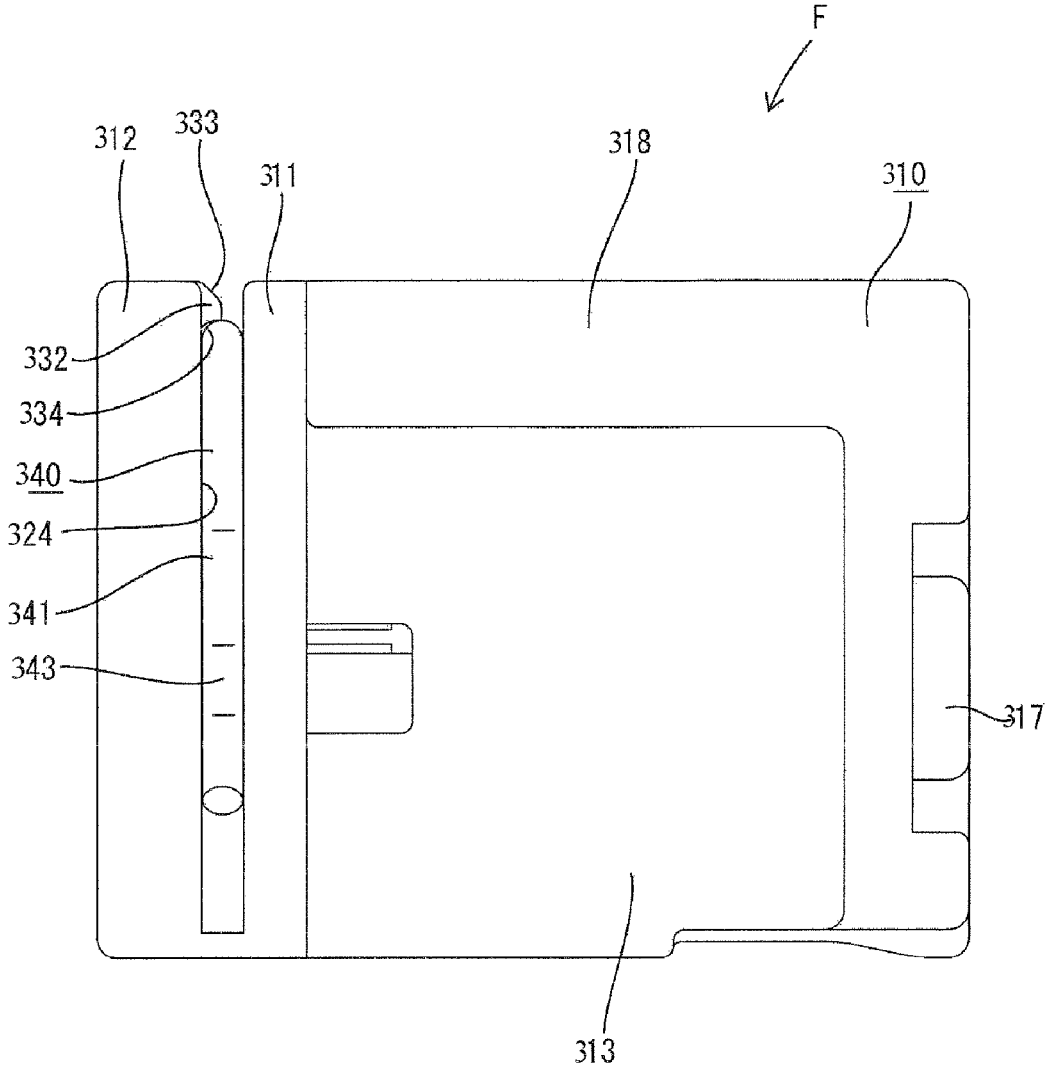
FIG. 40 is a side view of the female connector.

The main body 241 has a pressing surface 247 for sliding contact with the upper member 232 of the spring 230 to displace the spring 230 to the retracted position RP as the slider 240 is slid (see FIG. 27). The pressing surface 247 is formed in a part of the main body 241 before the guiding ribs 242 and inclined up and away from the guiding ribs 242 towards the front end. Thus, the pressing surface 247 thins the main body 241 towards the front end.

The slider 240 slides in forward and backward directions in a widthwise central part of the female housing 210 between the standing walls 218, and the pressing surface 247 presses a widthwise central part of the upper member 232 of the spring 230 between the legs 231.

The pressing surface 247 of the slider 240 does not press the spring 230 when the slider 240 is at a rearmost position in its slidable range and the female housing 210 is in a state lockable with the male housing 250 (see FIG. 22). This position of the slider 240 is called a lockable position. The pressing surface 247 of the slider 240 presses the spring 230 and displaces the spring 230 to the retracted position RP for canceling a locked state with the male housing 250 when the slider 240 is at a foremost position in its slidable range (see FIG. 31). This position of the slider 240 is called an unlocking position. The projections 244 are at the rear ends of the engaging windows 221 and engage the engaging surfaces 255A (see FIG. 29) when the slider 240 is at the lockable position. However, the projections 244 are at the front ends of the engaging windows 221 (see FIG. 30) when the slider 240 is at the unlocking position. The positions of the projections 244 can be seen through the engaging windows 221 to confirm visually or with an external detecting device, such as a camera, whether the slider 240 is at the lockable position or at the unlocking position.

A contact 248 projects forward from the front edge of the pressing surface 247 of the slider 240 and at a side of the upper member 232 of the spring 230 opposite to the female housing 210 (see FIG. 22). The contact 248 extends over substantially the entire width of the main body 241 and has a dimension substantially equal to or longer than about one third of the width of the upper member 232 when the slider 240 is at the lockable position (see FIG. 23). The contact 248 preferably projects more forward than the lift preventing portion 227 and is held in contact with the outer wall 251 of the device when the slider 240 is at the unlocking position (see FIG. 31).

The spring 230 is at the inserted position IP, and the slider 240 is at the lockable position prior to locking the connectors M, F. The female housing 210 then is gripped by fingers and is oriented so that the passages 225 of the female housing 210 aligned with the engaging projections 255 of the male housing 250. The female housing 210 then is pushed gradually into the male connector M so that the engaging projections 255 move forward in the passages 225. As a result, the front surfaces of the engaging projections 255 contact the engaging portions 233 of the spring 230 and cause the legs 231 to displace resiliently away from each other. At this time, the contact portion 248 of the slider 240 is above the spring 230 and prevents the spring 230 from lifting in response to forces exerted on the legs 231.

The projecting end surfaces of the engaging projections 255 move forward of the spring 230 when the connectors F, M reach a properly connected state. Thus, the legs 231 resiliently return so that the engaging portions 233 and the engaging surfaces 255A face each other in forward and backward directions for locking the housings 210, 250 together. Inner spaces of the two housings 210, 250 are sealed by the seal ring 216 and rubber plugs 229 for the wires, and the male and female terminals 211, 254 are connected electrically when the connectors F, M reach this properly connected state.

The two properly connected and locked connectors F, M can be separated if necessary. More particularly, fingertips are placed on the contact 248 of the slider 240 at the lockable position to slide the slider 240 forward. Thus, the pressing surface 247 slides in contact with the upper member 232 of the spring 230 to press the spring 230 down, and the front end portion of the slider 240 is inserted into the insertion hole 228A below the lift preventing portion 227. The engaging portions 233 are guided outwardly along the inclinations of the lower surfaces 226B of the communicating portions 226 as the spring 230 is pressed down by the pressing surface 247 so that the legs 231 are deformed away from each other (see FIG. 32). The engaging portions 233 are at the bottom ends of the lower surfaces 226B of the communicating portions 226 and are retracted from the passages 225 when the slider 240 reaches the unlocking position. Thus, the engaging projections 255 are freed from the locked state and can move back. At this time, the contact 248 of the slider 240 engages with the outer wall 251 of the device (see FIG. 31). Fingers then are placed on the finger placing portion 217 of the female housing 210 to pull the female housing 210 back while the slider 240 is pressed against the outer wall 251 of the device so that the two connectors F, M are separated.

The pressing surface 247 slides in contact with the spring 230 and presses the spring 230 to the retracted position RP merely by sliding the slider 240, thereby canceling the locked state. The spring 230 need not be operated directly by fingertips so that operability is good. The locked state can be canceled without any problem even if the outer wall 251 of the device prevents fingers from directly contacting the spring 230, as in this embodiment. Labor and time required for an unlocking operation are saved as compared with a case where the unlocking operation is performed using a jig.

The female housing 210 can be pulled out in a separating direction by sliding the slider 240 so that the contact 248 engages the outer wall 251 of the device after the slider 240 and the pressing surface 247 presses the spring 230 to the retracted position RP. Thus, a connector separating operation can be performed easily, as compared with the case where the male connector M has to be pulled out while holding the female housing 210 with fingertips.

The slider 240 is slid to the lockable position after separating the connectors F, M. As a result, the force for pressing the spring 230 down is released and the engaging portions 233 are pressed against the lower surfaces 226B of the communicating portion 226 by resilient restoring forces of the legs 231. The engaging portions 233 are guided into the passages 225 by the inclinations of the lower surfaces 226B of the communicating portions 226 so that the spring 230 is displaced from the retracted position RP to the inserted position IP. Accordingly, the spring 230 is set automatically to the inserted position IP merely by returning the slider 240 to the initial position IP. The spring 230 need not be set to the inserted position IP again for reconnecting the connectors F, M, and labor and time for the next locking operation is saved.

The spring 230 reaches the retracted position RP from the inserted position IP by being displaced in the direction towards the female housing 210. In other words, the displacing direction of the spring 230 during the unlocking operation is opposite to the separating direction of the spring 230 from the female housing 210. Thus, the spring 230 is prevented from being separated inadvertently from the female housing 210 during the unlocking operation.

The contact 248 of the slider 240 is above the upper member 232 of the spring 230 and prevents upward displacements of the spring 230. Thus, displacement and backlash of the spring 230 are prevented and the connector assembly can be used under high vibration.

The slider 240 presses the widthwise central part of the spring 230 between the legs 231. Thus, the force for pressing the spring 230 acts in a well-balanced manner and the unlocking operation is performed efficiently.

The female housing 210 has the lift preventing portion 227 to prevent lift of the front end of the slider 240 during the sliding operation. Thus, it is not necessary to press the slider 240 to ensure that the slider 240 does not lift upon pressing the spring 230 down. As a result, the unlocking operation can be performed easily.

A locking structure according to a further embodiment of the invention is described with reference to FIGS. 33 to 36. The locking structure of this embodiment differs from the previous embodiment in that the spring 230 reaches the retracted position RP from the inserted position IP by being displaced up and away from the female housing 210. Elements that are the same as to similar to the previous embodiment are not described again, but merely are identified by the same reference numerals.

The locking structure of this embodiment employs a spring 230 with two resiliently displaceable leg portions 231 to lock a female connector F and the male connector M together. The spring 230 is mounted to a mounting portion 224 of a female housing 210 and is displaceable between an inserted position IP and a retracted position RP. The spring 230 is moved up and out from the inserted position IP to the retracted position RP. Engaging portions 233 of the spring 230 project into passages 225 when the spring is at the inserted position IP. However, the engaging portions 233 retract from the passages 225 and cancel a locked state when the spring 230 reaches the retracted position RP. Upper surfaces 226A of communicating portions 226 of the female housing 210 are inclined to guide the engaging portions 233 of the spring 230 to the passages 225.

A slider 290 is assembled to the female housing 210 and is slidable in forward and backward directions corresponding to a connecting direction with a male housing 250, as in the previous embodiment. The rearmost position in a slidable range is a lockable position and the foremost position therein is an unlocking position.

A pressing surface 291 is formed on a main body 241 of the slider 290 for sliding contact with an upper member 232 of the spring 230 to press the upper member 232 up and out so that the spring 230 is displaced up to the retracted position RP as the slider 290 is slid. The pressing surface 291 is on a part of the main body 241 before guiding ribs 242 and inclines down towards the guiding ribs 242 and towards the front end (see FIG. 34).

A contact 248 projects at the front of the main body 241, as in the previous embodiment. The contact 248 is above the upper member 232 of the spring 230 when the slider 290 is at the lockable position (see FIG. 33) and projects forward from a lift preventing portion 227 at the front end of the female housing 210 when the slider 290 is at the unlocking position (see FIG. 36). Similar to the previous embodiment, the contact 248 contacts an outer wall 251 of the male housing 250 after the spring 230 is pressed to the retracted position.

An operation of locking the male and female connectors M and F in a properly connected state is performed similar to the previous embodiment. An operation of separating the properly connected connectors F, M also is performed similar to previous embodiment by sliding the slider 290. More particularly, fingertips are placed on a finger contact 243 of the slider 290 at the lockable position to slide the slider 290 forward. The pressing surface 291 then slides in contact with the upper member 232 of the spring 230 to displace the spring 230 up. Thus, the engaging portions 233 are guided out along the inclinations of the upper surfaces 226A of the communicating portions 226 to deform the legs 231 away from each other. The engaging portions 233 are at upper ends of the upper surfaces 226A of the communicating portions 226 and are retracted from the passages 225 when the slider 290 reaches the unlocking position, thereby canceling the locked state. At this time, the contact 248 of the slider 290 is in contact with the outer wall 251 of the male connector M, and fingers on the finger placing portion 217 of the female housing 210 can pull the female housing 210 back to separate the connectors F, M while the slider 290 is pressed against the outer wall 251, similar to the previous embodiment.

The invention is not limited to the above described and illustrated embodiments. For example, the following modifications are also embraced by the technical scope of the present invention.

Although the invention is applied to the locking structure of a connector assembly in the above embodiments, it can be applied to a locking structure for a pair of any members connectable with each other.

The locked state is canceled by sliding the slider 240 forward in the above embodiments. However, the locked state may be canceled by sliding the slider backward. At this time, the pressing surface of the slider may be inclined to press the spring to the retracted position by a backward sliding operation.

A locking structure according to a further embodiment of the invention is described with reference to FIGS. 33 to 43. The locking structure of this embodiment is applied to female and male connectors F, M. Ends of the connectors to be connected are referred to herein as the front ends and reference is made to FIG. 33 concerning upper and lower sides.

The male connector M includes a male housing 350 made e.g. of synthetic resin. The male housing 350 includes wide substantially rectangular tubular front and rear receptacles 352 and 353. The front receptacle 352 has an open front end and the rear receptacle 353 has an open rear end. Male terminals 351 penetrate a back wall 354 of the male housing 350 between the front and rear receptacles 352 and 353 and are arranged substantially side by side in the width direction. Front and rear parts of the male terminals 351 respectively project forward and backward in the front and rear receptacles 352 and 353.

Figure 41:
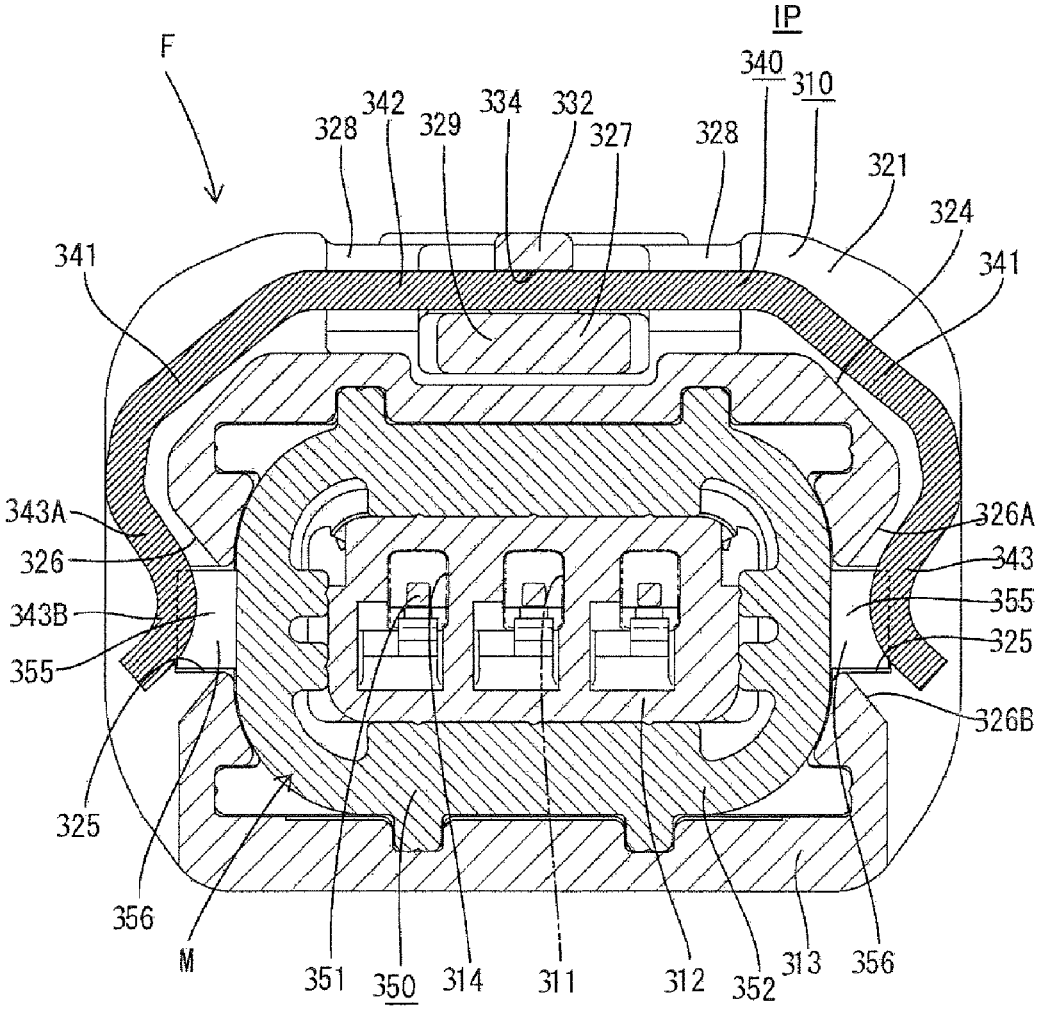
FIG. 41 is a lateral section showing a state where two connectors are locked in a properly connected state.
Figure 42:
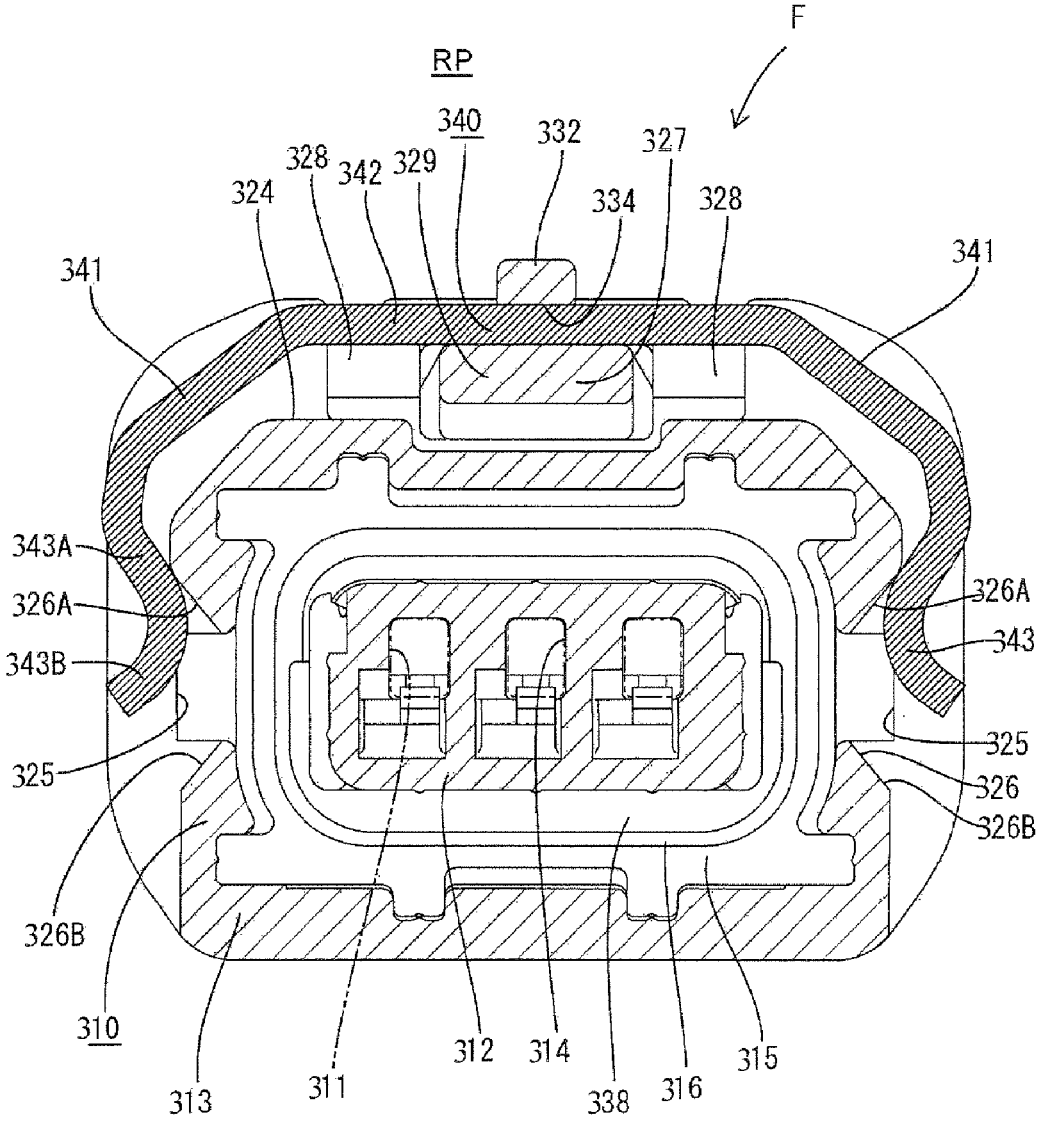
FIG. 42 is a lateral section showing the female connector in an unlocked state.
Figure 43:
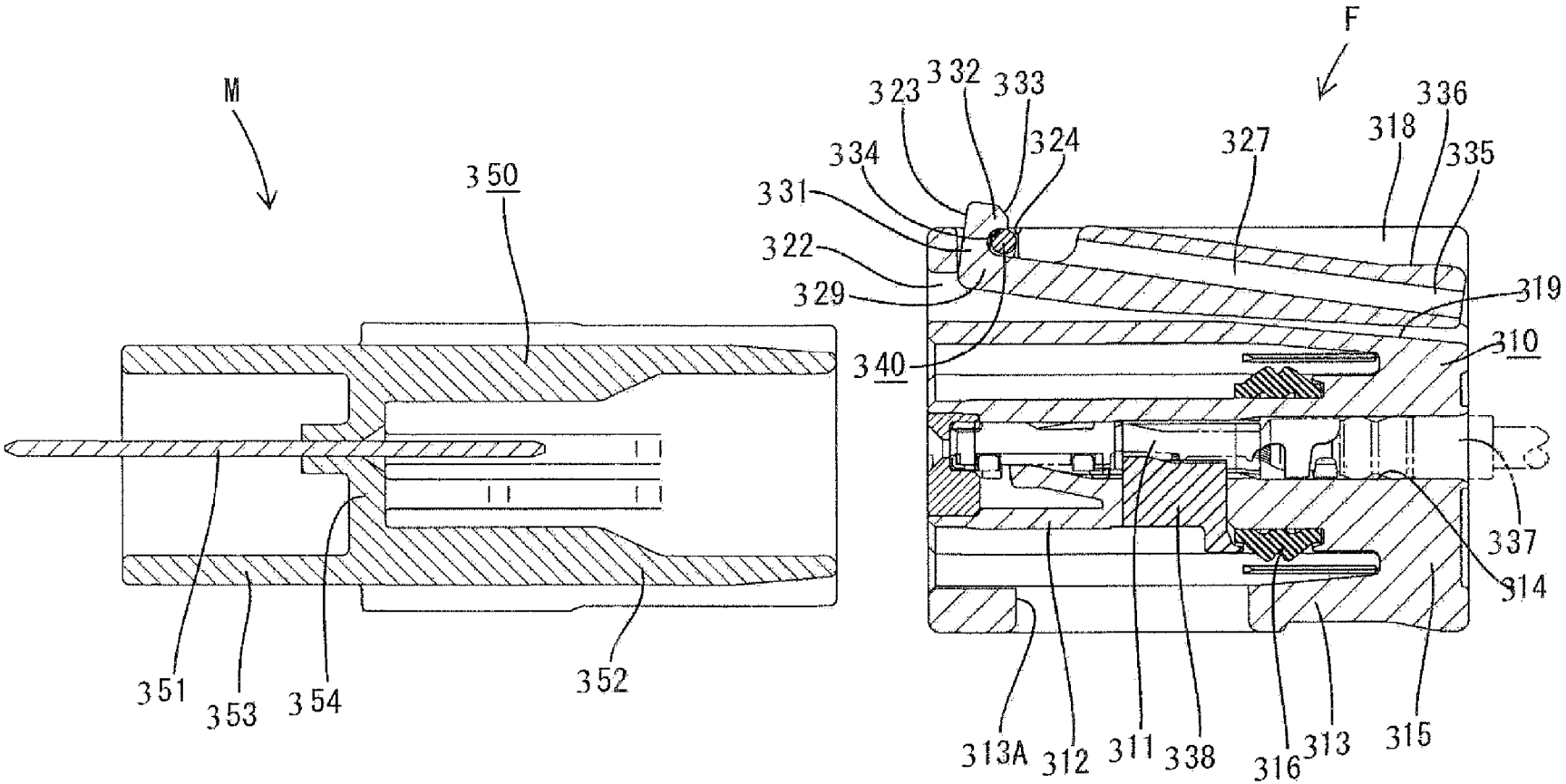
FIG. 43 is a longitudinal section showing a state where the two connectors are separated.

Engaging projections 355 project laterally from opposite left and right surfaces of the male housing 350 (see FIG. 41). The engaging projections 355 are at substantially central positions of the male housing 350 in forward and backward directions, and are substantially in the vertical center of the male housing 350. Front surfaces of the engaging projections 355 are inclined moderately out from the front towards the rear, whereas engageable surfaces 356 are defined at the rear of the engaging projections 355.

The female connector F includes a female housing 310 that is made e.g. of synthetic resin and that is connectable with the male housing 350. The female housing 310 includes a terminal accommodating portion 312 for accommodating female terminals 311 and an outer tube 313 surrounds the outer peripheral surface of the terminal accommodating portion 312.

The terminal accommodating portion 312 is a wide substantially rectangular column that can fit into the front receptacle 352 of the male housing 350. Cavities 314 are formed in the terminal accommodating portion 312 and female terminals 311 are insertable into the cavities 314 from behind.

The outer tube 313 extends between the rear and front ends of the terminal accommodating portion 312, and a connecting portion 315 unitarily joins the rear end of the outer tube 313 to the rear end of the terminal accommodating portion 312. A clearance is defined between the outer tube 313 and the terminal accommodating portion 312 and can receive the front receptacle 352 of the male housing 350. A seal ring 316 is mounted on a back part of the outer peripheral surface of the terminal accommodating portion 312. The seal ring 316 is squeezed between the front receptacle 352 and the terminal accommodating portion 312 to provide sealing between the housings. An opening 313A is formed in the lower surface of the outer tube 313 to assemble a retainer 338 for retaining the female terminals 311 in the terminal accommodating portion 312.

Finger placing portions 317 project laterally from rear parts of the left and right surfaces of the female housing 310. Fingertips can be placed on the finger placing portions 317 to pull the female housing 310 for separating the connectors F, M.

Standing walls 318 are provided on the upper surface of the outer tube 313. The standing walls 318 extend continuously in forward and backward directions from the rear end of the female housing 310 to a position near the front end thereof.

A rear recess 319 is formed in a part of the upper surface of the outer tube 313 between the standing walls 318 from an intermediate position in forward and backward directions to the rear of the female housing 310. The depth of the rear recess 319 is increased gradually towards the rear.

First positioning walls 321 extend substantially circumferentially along the opposite left and right surfaces of the outer tube 313 from the front ends of the standing walls 318. A second positioning wall 322 is provided on the outer tube 313 before the first positioning walls 321. The second positioning wall 322 extends substantially circumferentially over the upper surface and the opposite side surfaces of the outer tube 313. The second positioning wall 322 and the first positioning walls 321 are substantially parallel to each other and spaced in forward and backward directions (see FIG. 39).

A front recess 323 is formed substantially in a widthwise center of the second positioning wall 322 and becomes gradually deeper from the opposite widthwise sides towards the center. A depth in a central part of the front recess 323 preferably is less than about ⅔, more preferably about half the thickness of the second positioning wall 322 in forward and backward directions.

A mounting portion 324 is recessed in a part of the outer tube 313 between the first positioning walls 321 and the second positioning wall 322 near the front end.

Passages 325 are formed in the opposite left and right walls of the outer tube 313 and can receive engaging projections 355 of the male housing 350. Each) passage 325 extends back from the front end of the outer tube 313 and communicates with the mounting portion 324.

Communicating portions 326 provide communication with the mounting portion 324 and the passages 325 and have upper surfaces 326A and lower surfaces 326B that incline to approach each other from the outer side towards the inner side. A vertical dimension of the communicating portions 326 at the inner sides is substantially equal to that of the engaging projections 355 (see FIG. 41).

A downwardly-open U-shaped or W-shaped spring 340 is mounted on or to the mounting portion 324 of the female housing 310. The spring 340 includes two legs 341 that resiliently displaceable in directions substantially facing each other and an upper member 342 connects the upper ends of the legs 341. The legs 341 extend substantially vertically down form opposite ends of the upper member 342 in a natural unbiased state.

Bottom ends of the legs 341 are bent to define engaging portions 343 that converge inwardly towards each other and that project into the passages 325. The engaging portions 343 include upper inclined sides 343A inclined inwardly towards each other and lower inclined sides 343B. Thus, the engaging portions 343 have a smaller extension in a vertical direction towards the inner side. Boundaries between the upper and lower inclined sides 343A and 343B of the engaging portions 343 are rounded.

The spring 340 is mounted for displacement between an inserted position IP (see FIG. 41) and a retracted position RP (see FIG. 42) where. The engaging portions 343 pass into the passages 325 when the spring 340 is at the inserted position IP. However, the engaging portions 343 are retracted from the passages 325 when the spring is at the retracted position RP. The engaging projections 355 move along the passages 325 during the connection process and press the engaging portions 343 in the passages 325 to deform the legs 341 outwardly. The engageable surfaces 356 pass the engaging portions 343 when the two connectors F, M reach a properly connected state. Thus, the legs 341 resiliently restore so that the engaging portions 343 engaging the engageable surfaces 356 to lock the male housing 350. The spring 340 reaches the retracted position RP by being displaced up and out away from the female housing 310 from the inserted position IP. The engaging portions 343 are retracted from the passages 325 to cancel the locked state when the spring 340 reaches the retracted position RP. The engaging portions 343 retracted from the passages 325 are at the outer sides of the upper surfaces 326A of the communicating portions 326.

An unlocking arm 327 extends in forward and backward directions from the rear end of the female housing 310 to the front recess 323 of the second positioning wall 322 at a position between the standing walls 318. Rotary shafts 328 connect opposite widthwise sides of the unlocking arm 327 to the standing walls 318 (see FIGS. 38 and 39). Thus, the unlocking arm 327 can incline like a seesaw about rotary shafts 328. The rotary shafts 328 are at substantially longitudinal central positions of the unlocking arm 327. The unlocking arm 327 is substantially parallel to the upper surface of the outer tube 313 when in the natural unbiased state (see FIG. 33).

A pressing portion 329 is defined at the front end of the unlocking arm 327 and is below the spring 340. Thus, the pressing portion 329 can press the spring 340 up and out away from the female housing 310 when the unlocking arm 327 is inclined. A front wall 331 stands up at a front end of the unlocking arm 327, and the pressing portion 329 can be deflected down and in by the front wall 331. The front wall 331 enters the front recess 323 of the second positioning wall 322. Rear surfaces of the front wall portion 331 and the second positioning wall 322 are substantially flush when the unlocking arm 327 is in a natural state. The front wall 331 has a converging shape so that the width thereof is gradually decreased toward the upper end.

At least one bulge 332 projects back at the upper end of the front wall 331. A projecting distance of the bulging portion 332 is substantially equal to half the width of the spring 340 in forward and backward directions. The bulge 332 is at a side of the spring 340 opposite to the pressing portion 329 and is at a widthwise central part of the upper member 342 of the spring 340 (see FIGS. 39 and 41).

A mount guiding surface 333 is defined at the top of the bulge 332 and inclines down toward the projecting end. Thus, the spring 340 can be mounted smoothly on the mounting portion 324. A restraining surface 334 is defined at the lower surface of the bulge 332 and restrains the upper side 342 of the spring 340 from above. The projecting end of the restraining surface 334 is arcuate and projects slightly down to press the upper end of the spring 340.

The bulge 332 is unitary with the unlocking arm 327 and a space having a dimension substantially equal to the vertical dimension of the upper member 342 of the spring 340 is defined between the suppressing surface 334 and the pressing portion 329. Thus, a widthwise central part of the upper member 342 of the spring 340 is held between the restraining surface 334 and the pressing portion 329 with substantially no vertical clearance.

The spring 340 is substantially entirely held between the first positioning walls 321 and the front wall 331, the second positioning wall 322 with substantially no clearance defined in forward and backward directions. The heights of the first and second positioning walls 321, 322 are set to be located before and after the spring 340 even if the spring 340 is displaced between the inserted position IP and the retracted position RP.

An unlocking portion 335 is defined at the rear end of the unlocking arm 327 and is wider than a part of the unlocking arm 327 before the rotary shafts 328. A pressable slant 336 is formed on the upper surface of the unlocking portion 335 and inclines gradually up toward the rear. The lower surface of the unlocking portion 335 is inclined up towards the rear to thin the unlocking portion 335 towards the rear. The inclined lower surface of the unlocking portion 335 and the rear recess 319 of the female housing 310 ensure a sufficient downward displacement of the unlocking portion 335 while suppressing the height of the female housing 310.

When the unlocking arm 327 is in the natural state, the spring 340 is held at the inserted position IP and the female housing 310 is in a state lockable with the female housing 350. A state of the unlocking arm 327 at this time is called a lockable state (see FIG. 33). When the unlocking portion 335 is pressed to incline the unlocking arm 327, the pressing portion 329 presses the spring 340 up and the spring 340 is displaced to the retracted position RP, i.e. the locked state with the male housing 350 is canceled. This state of the unlocking arm 327 is called an unlocking state (see FIG. 42).

The unlocking arm 327 is in the lockable state, and the spring 340 is at the inserted position IP at the start of a connecting operation. The male and female connectors M, F are connected by gripping the female housing 310 by fingers and orienting the passages 325 of the female housing 310 with respect to the engaging projections 355 of the male housing 350. The female connector F then is pushed gradually into the male connector M. Thus, the engaging projections 355 move forward in the passages 325 and the front surfaces of the engaging projections 355 contact the engaging portions 343 of the spring 340. The engaging projections 355 move forward and onto the engaging portions 343 to displace the legs 341 away from each other. At this time, the bulge 332 of the unlocking arm 327 is above the spring 340. Thus, the spring 340 cannot be lifted up in response to the forces that displace the legs 341.

The legs 341 resiliently return when the connectors F, M reach the properly connected state and the engaging portions 343 engage the engaging projections 355 to lock the two housings 310, 350 together. In the properly connected state of the two connectors F, M, the seal ring 316 and rubber plugs 337 for wires seal inner spaces of the housings 310, 350, and the male and female terminals 311, 351 are connected electrically.

In the two connectors F, M properly connected in this way, the spring is held between the bulge 332 and the pressing portion 329. Thus, vertical and circumferential displacements of the spring 340 relative to the mounting portion 324 are prevented. The spring 340 and the engaging projections 355 of the male housing 350 reliably are held engaged by preventing the displacements of the spring 340. Thus, locking reliability can be improved.

In addition, the spring 340 is held closely between the restraining surface 334 and the pressing portion 329 to prevent shaking. Displacement and backlash of the spring 340 in forward and backward directions are prevented because the spring 340 is held closely between the first positioning walls 321 and the second positioning wall 322. Since relative displacements of the spring 340 and the female housing 310 can be prevented in this way, the two connectors F, M can sustain the use in a high-vibration environment.

The connectors F, M are locked by placing fingertips on the pressable slant 336 of the unlocking arm 327 and pressing the unlocking portion 335 down. The unlocking arm 327 then inclines and the pressing portion 329 displaces the spring 340 up. The bulge 332 is in the widthwise center of the spring 340 prevents upward displacement of the spring 340. Thus the spring 340 cannot displace so that one side is lifted up from the pressing portion 329.

The engaging portions 343 are guided out along the inclinations of the upper surfaces 326A of the communicating portions 326 and the legs 341 are deformed away from each other as the spring 340 is displaced up by the pressing portion 329. The engaging portions 343 are at the upper ends of the upper surfaces 326A of the communicating portions 326 and retracted from the passages 325 when the unlocking arm 327 reaches the unlocking state. The bulge 332 is provided above the spring 340 to ensure that the spring 340 is not separated from the pressing portion due to an excessively strong force for pulling the spring 340 up.

The pressing portion 329 is deflected toward the side, toward which the spring 340 is pressed, upon pressing the spring 340. Thus, separation of the spring 340 from the pressing portion 329 during the unlocking operation can be avoided.

The pressing portion 329 of the unlocking arm 327 presses the widthwise central part of the spring 340. Thus, the force for pressing the spring 340 acts on the spring 340 in a well-balanced manner and the unlocking operation can be performed efficiently.

When the unlocking arm 327 is operated to enable the engaging projections 355 to move backward, i.e. free them from the locked state, fingers are placed on the finger placing portions 317 of the female housing 310 and the female housing 310 is held from the substantially opposite sides and pulled backward, thereby separating the two connectors F, M.

Fingers pressing the unlocking portion 335 are moved away after separating the connectors F, M. Thus, the unlocking arm 327 naturally resiliently returns to the lockable state to release a force for pressing the spring 340. The engaging portions 343 then are pressed against the upper surfaces 326A of the communicating portions 326 by resilient restoring forces of the legs 341 and guided into the passages 325 by the inclinations of the upper surfaces 326A. Accordingly, the spring 340 is displaced from the retracted position RP towards or to the inserted position IP and is set automatically to the inserted position IP merely by moving the fingertips away from the unlocking portion 335. Therefore, the spring 340 need not be set to the inserted position IP again upon reconnecting the two connectors F, M and time and labor required for connecting and locking the connectors F, M can be saved.

The displacement of the spring 340 when the female connector F is left alone can be prevented by providing the bulge 332. Here, if the spring 340 is displaced when the female connector F is left alone, the spring 340 has to be set to the correct position again upon connecting the female connector F with the male connector M, which requires labor and time. However, by providing the bulge 332 as in this embodiment, the displacement of the spring 340 can be prevented. Therefore, it is unnecessary to set the spring 340 again and labor and time required for the connector connecting operation can be saved.

The invention is not limited to the above described and illustrated embodiment. For example, the following modifications also are embraced by the technical scope of the present invention.

Although the present invention is applied to the locking structure of the connector device in the above embodiments, it can be applied to a locking structure for a pair of any members connectable with each other.

The unlocking arm 327 is made inclinable like a seesaw by the rotatable rotary shafts in the above embodiment. However, the unlocking arm may have other connections provided that it is inclinable like a seesaw. For example, a supporting leg may stand up from the upper surface of the female housing and the unlocking arm may be inclined with this supporting leg as a supporting point.

What is claimed is:

1. A connector assembly, comprising a first connector with a first housing and a second connector with a second housing, the first and second connectors being connectable with one another, wherein:

a spring including at least one pair of resiliently displaceable legs being mounted on a mounting portion of second housing;

the second housing being formed with passages for receiving engageable portions on the first housing upon connecting the connectors;

the legs projecting into the respective passages via communicating portions communicating the passages and the mounting portion;

the engageable portions contacting the legs to move forward in the passages while resiliently displacing the legs upon connecting the connectors;

engageable surfaces facing rearwardly on of the engageable portions and arranged to face the communicating portions and inclined to produce forces for pushing the other housing forward upon receiving resilient restoring forces of the legs when the connectors reach a properly connected state; and a fitting space of the second connector is formed with at least one slanted surface inclined to reduce the width of the fitting space toward a back side of the fitting space.

2. The connector assembly of claim 1, wherein the slanted surface and the first connector are set to contact at a position where a clearance is defined before the first connector in a connecting direction with the second connector.

3. The connector assembly of claim 1, wherein a part of the first connector to contact the slanted surface of the second connector is formed with at least one inclined surface inclined substantially in conformity with the slanted surface.

4. The connector assembly of claim 1, wherein the spring is displaceable between an inserted position where the legs project into the passages and a retracted position where the legs are retracted from the passages, and the communicating portions and the legs have guiding portions inclined with respect to a displacing direction of the spring.

5. The connector assembly of claim 1, wherein the mounting portion is on an outer peripheral surface of the second connector, and peripherally extending walls provided before and after the mounting portion on the outer peripheral surface of the second connector.

6. A locking structure, comprising:

a first member having engageable portions;

a second member connectable with the first member, the second member having passages that align with the engageable portions when first member is connected with the second member;

a spring mounted on a front portion of the second member with respect to a connecting direction with the first member, the spring having two resiliently displaceable legs, the spring being displaceable transverse to the connecting direction between an inserted position where the legs project into the passages and a retracted position where the legs are retracted from the passages, the spring being lockingly engaged with the engageable portions of the first member that has been connected properly with the second member when the spring is at the inserted position, the spring canceling the locked state by being displaced to the retracted position; and an unlocking arm on the second member and extending substantially in the connecting direction, the unlocking arm; being inclinable like a seesaw, a pressing portion being formed at a front end portion of the unlocking arm and being between the spring and the first member for displacing the spring from the inserted position and an unlocking portion formed at a rear end of the unlocking arm for displacing the pressing portion.

7. The locking structure of claim 6, further comprising a supporting arm extending substantially in the connecting direction and supporting the unlocking arm, a rear end portion of the supporting arm being connected with the rear end of the unlocking arm and a front end of the supporting arm being connected with the second member, and a supporting point being formed on one of the unlocking arm and the second member for contacting the other of the unlocking arm and the second member in an intermediate part of the unlocking arm in forward and backward directions when the unlocking portion is pressed to bring the unlocking arm and the second member closer together.

8. The locking structure of claim 6, further comprising guiding tapers at sides of entrances to the passages towards which the legs resiliently return for guiding engaging portions of the legs into the passages when the spring is at the retracted position.

9. The locking structure of claim 6, wherein the pressing portion is shaped to be deflected towards the spring.

10. A locking structure, comprising:

a first member having engageable portions;

a second member connectable with the first member, the second member having passages that align with the engageable portions when first member is connected with the second member;

a spring mounted on a front portion of the second member with respect to a connecting direction with the first member, the spring having two resiliently displaceable legs, the spring being displaceable transverse to the connecting direction between an inserted position where the legs project into the passages and a retracted position where the legs are retracted from the passages, the spring being lockingly engaged with the engageable portions of the first member that has been connected properly with the second member when the spring is at the inserted position, the spring canceling the locked state by being displaced to the retracted position; and a slider assembled with the second member and being displaceable substantially along the connecting direction with the first member, the slider being formed with at least one pressing surface inclined to press the spring to the retracted position as the slider is displaced.

11. The locking structure of claim 10, wherein a contact projects from the slider for contacting the first member in the connecting direction after the spring is displaced to the retracted position.

12. The locking structure of claim 10, further comprising guiding tapers at sides of entrances to the passages towards which the legs resiliently return for guiding engaging portions of the legs into the passages when the spring is at the retracted position.

13. The locking structure of claims 10, wherein the spring reaches the retracted position from the inserted position by being displaced in a direction towards the first member.

14. The locking structure of claim 13, wherein the contact projects substantially in the connecting direction at a side of the spring substantially opposite to the second member.

15. The locking structure of claim 10, wherein the slider is configured to press a substantially central part of the spring between the legs.

16. The locking structure of claim 10, further comprising at least one lift preventing portion arranged at a side of the slider substantially opposite to the second member.

17. A locking structure, comprising:

a first member having engageable portions;

a second member connectable with the first member, the second member having passages that align with the engageable portions when first and second members are connected;

a spring mounted on a front portion of the second member with respect to a connecting direction with the first member, the spring having two resiliently displaceable legs and being displaceable transverse to the connecting direction between an inserted position where the legs project into the passages and a retracted position where the legs are retracted from the passages, the spring being locked with the engageable portions of the first member that has been connected properly with the second member when the spring is at the inserted position, the spring canceling the locked state by being displaced to the retracted position; and an unlocking arm on the second member and extending substantially in the connecting direction, the unlocking arm being inclinable like a seesaw, a pressing portion being formed at a front end portion of the unlocking arm and being between the spring and the first member for displacing the spring from the inserted position and an unlocking portion formed at a rear end of the unlocking arm for displacing the pressing portion, the unlocking arm including at least one bulge at a side of the spring substantially opposite to the pressing portion.

18. The locking structure of claim 17, wherein the bulge aligns with a substantially middle part of the spring between the legs.

19. The locking structure of claim 17, wherein the pressing portion is shaped to be deflected towards the spring.

20. The locking structure of claim 17, wherein the spring is mounted in a substantially circumferentially extending groove portion formed in the one member.

* * * * *